US008960458B1

(12) United States Patent
Klein et al.

(10) Patent No.: US 8,960,458 B1
(45) Date of Patent: Feb. 24, 2015

(54) STORAGE APPARATUS

(75) Inventors: Richard B. Klein, Overland Park, KS (US); Mark A. Etter, Independence, MO (US); Todd Michael Pickrell, Stroudsburg, PA (US)

(73) Assignee: Lynk, Inc., Lenexa, KS (US)

( * ) Notice: Subject to any disclaimer, the term of this patent is extended or adjusted under 35 U.S.C. 154(b) by 48 days.

(21) Appl. No.: 13/615,948

(22) Filed: Sep. 14, 2012

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 87/02*** | (2006.01) |
| ***A47B 47/03*** | (2006.01) |

(52) U.S. Cl.
CPC ..... *A47B 87/0261* (2013.01); *A47B 47/03* (2013.01); *A47B 87/0207* (2013.01)
USPC ..... 211/188; 211/186; 211/126.11

(58) Field of Classification Search
CPC ..... A47F 5/13; A47F 7/08; A47F 5/0892; A47F 5/01; A47F 5/10; A47F 5/0043; A47K 3/004; D06F 57/122; D06F 81/02; A47B 87/0276; A47B 47/02; A47B 47/021; A47B 47/0207; A47B 55/00; A47B 47/03; A47B 55/02; A47B 87/0207; A47B 3/12; A47B 7/02; A47B 96/025; A47B 47/0083; A47B 43/00; A47B 67/04; A47B 88/0455; A47B 61/00; A47B 87/0253; A47B 87/0215; A47B 3/0812; A47B 23/001; A47B 96/028; A47B 87/02; A47B 87/0246; A47B 87/0261
USPC ..... 211/134, 119.003, 119.005, 133.6, 211/126.2, 194, 188, 153, 135, 149, 195, 211/133.1, 128.1, 130.1, 12.11, 126.9, 186; 108/92, 93, 97, 98, 108, 186
See application file for complete search history.

(56) References Cited

U.S. PATENT DOCUMENTS

| | | | | | |
|---|---|---|---|---|---|
| 1,947,825 | A | | 2/1934 | Brooks | |
| 2,569,729 | A | * | 10/1951 | Nold | 297/250.1 |
| 2,633,996 | A | | 4/1953 | Litchfield | |
| 2,844,262 | A | * | 7/1958 | Maldon | 211/188 |
| 3,013,670 | A | * | 12/1961 | Mayer | 108/181 |
| 3,289,614 | A | * | 12/1966 | Frazier | 108/91 |
| 3,289,615 | A | * | 12/1966 | Marschak | 108/97 |
| 3,417,875 | A | * | 12/1968 | Barker | 211/86.01 |
| 4,343,245 | A | * | 8/1982 | Edwards | 108/193 |

(Continued)

OTHER PUBLICATIONS

Under Shelf Wrap Holder, printed from internet on Feb. 24, 2012 at www.spacesavers.com/Storage/Shelving-Shelf-Organizers/Under-Shelf-Wrap Holder. (1 pg).

(Continued)

*Primary Examiner* — Jennifer E Novosad
(74) *Attorney, Agent, or Firm* — Stinson Leonard Street, LLP

(57) ABSTRACT

An add-on shelf has a pair of legs at least one of which having a locking structure that is configured to removably lock the leg to an existing structure and a support structure that supports a shelf deck. A void space is positioned between the legs, shelf deck, and existing structure. Alternatively, a width adjustable storage apparatus has first and second sections operable to engage each other in a plurality of adjustable positions each corresponding to a different width of a shelf surface formed by the sections, and first and second supports that engage an existing structure for supporting the first and second sections. The shelf surface is positioned in a generally horizontal plane and the first and second sections do not extend above that generally horizontal plane.

16 Claims, 43 Drawing Sheets

(56) References Cited

U.S. PATENT DOCUMENTS

| | | | | | |
|---|---|---|---|---|---|
| 4,444,320 | A * | 4/1984 | Chap | 211/134 |
| 4,732,284 | A * | 3/1988 | Remmers | 211/188 |
| 4,915,238 | A * | 4/1990 | Cassel | 211/37 |
| 5,035,335 | A * | 7/1991 | Massoudnia | 211/188 |
| 5,074,223 | A * | 12/1991 | Remmers | 108/91 |
| D324,142 | S * | 2/1992 | Cassel | D6/462 |
| 5,086,936 | A * | 2/1992 | Remmers | 211/126.15 |
| 5,097,971 | A * | 3/1992 | Norris et al. | 211/126.6 |
| 5,152,407 | A * | 10/1992 | Massoudnia et al. | 211/126.8 |
| 5,251,973 | A * | 10/1993 | Hazan | 312/257.1 |
| 5,377,598 | A | 1/1995 | Kirchner et al. | |
| 5,499,584 | A | 3/1996 | Taylor | |
| 5,803,277 | A * | 9/1998 | Alvarez-Momoitio | 211/188 |
| 6,286,691 | B1 * | 9/2001 | Oberhaus et al. | 211/118 |
| 6,318,570 | B1 * | 11/2001 | Mueller et al. | 211/181.1 |
| 6,321,921 | B1 * | 11/2001 | Massoudnia | 211/188 |
| D457,752 | S * | 5/2002 | Wood et al. | D6/462 |
| D460,294 | S * | 7/2002 | Webb et al. | D6/462 |
| D587,492 | S * | 3/2009 | Gusdorf | D6/462 |
| 7,516,853 | B1 | 4/2009 | Murillo, Jr. | |
| D635,379 | S | 4/2011 | Klein et al. | |
| 8,025,163 | B2 * | 9/2011 | McAllister et al. | 211/90.03 |
| 8,186,523 | B2 * | 5/2012 | Liang | 211/188 |
| D679,924 | S * | 4/2013 | Klein et al. | D6/566 |
| 2008/0074021 | A1 | 3/2008 | Croft et al. | |
| 2009/0026161 | A1 * | 1/2009 | Scriba et al. | 211/144 |
| 2012/0205327 | A1 * | 8/2012 | Gusdorf | 211/10 |

OTHER PUBLICATIONS

Allsop, Camden TV Stand, printed from internet on Feb. 23, 2012 at www.allsop.com/monitor-stands/camden-tv-stand-walnut/. (1 pg).

Undershelf Mesh Basket—Slides on Shelf, printed from internet on Dec. 6, 2012 at www.bing.com/images/search?q=shelf+slide+on+basket&view=detail&id=3FA197. (1 pg).

Lynk Shelf Divider—Chrome, printed from internet on Mar. 15, 2012 at www.google.com/products/catalog?q=lynk+shelf+divider&rls=com. Offered for sale more than one year prior to the Sep. 14, 2012 filing date of this application. (2 pgs).

HDS, Expandable Shelf Chrome Plated, printed from internet on Mar. 27, 2012 at www.amazon.com/SS10106-Expandable-Shelf-Chrome-Plated/dp/B20052DXDUO/ref=sr_1_50?s=home-garden&ie=UTF8&qid=1332884096&sr=1-50. (3 pgs).

InterDesign, York Lyra Expandable Shelf, Bronze, printed from the internet on Mar. 27, 2012 at www.amazon.com/InterDesign-York-Expandable-Shelf-Bronze/dp/B0043XBE9Q/ref=sr_1_7?s=home-garden&ie=UTF8&qid=1332883509&sr=1-7. Offered for sale more than one year prior to the Sep. 14, 2012 filing date of this application. (3 pgs).

Rubbermaid, Small Expanding Helper Shelf 15" L×6" W ×6" H Expand, printed from the internet on Mar. 27, 2012 at www.amazon.com/Small-Expanding-Helper-Shelf-Expand/dp/B004BAKERO/ref=sr_1_47?s=home-garden&ie=UTF8&qid=1332884078&sr=1-47. (3 pgs).

Seville Classics, SHE14052 Expandable Kitchen Counter Shelf, printed from the internet on Mar. 27, 2012 at www.amazon.com/Seville-Classics-SHE14052-Expandable-Kitchen/dp/B002ZNJHZE/ref=sr_1_1?s=home-garden&ie=UTF8&qid=1332883509&sr=1-1. Offered for sale more than one year prior to the Sep. 14, 2012 filed of this application. (4 pgs).

Bed Bath & Beyond, Metal Mesh Expandable Cabinet Shelf, printed from the internet on Mar. 15, 2012 at www.bedbathandbeyond.com/product.asp?SKU=18748860. (2 pgs).

InterDesign, York Lyra Expandable Shelf, Chrome/Silver, printed from the internet on Mar. 27, 2012 at www.amazon.com/InterDesign-Expandable-Shelf-Chrome-Silver/dp/B0052WG334/ref=sr_1_6?s=home-garden&ie=UTF8&qid=1332883509&sr=1-6. Offered for sale more than one year prior to the Sep. 14, 2012 filing date of this application. (3 pgs).

Kennedy International Expandable Cabinet Shelf, printed from the internet on Mar. 27, 2012 at www.amazon.com/Kennedy-International-Expandable-Cabinet-Shelf/dp/B0071HL9JY/ref=sr_1_38?s=home-garden&ie=UTF8&qid=1332884014&sr=1-38. (3 pgs).

Rubbermaid Inc., 1J2700BLA Large Expandable Wire Helpers Shelf, printed from the internet on Mar. 27, 2012 at www.amazon.com/Rubbermaid-1J2700BLA-Large-Expandable-Helpers/dp/B004BAIITU/ref=sr_1_44?s=home-garden&ie=UTF8&qid=1332884050&sr=1-44. (3 pgs).

Bed Bath & Beyond, Medium Cabinet Shelf, printed from the internet on Mar. 15, 2012 at www.bedbathandbeyond.com/product.asp?SKU=12176295. (2 pgs).

Organize.com, Kitchen and Household Helper Shelf, printed from the internet on Mar. 15, 2012 at www.organize.com/kitchen-household-helper-shelf-grayline-housewares.html. (3 pgs).

Organize.com, Large Helper Shelf, printed from the internet on Mar. 15, 2012 at www.organize.com/large-helper-shelf-grayline-housewares.html?green=82C58DC1-16EB-594F-B873-44DC96AE8039. (3 pgs).

Walmart, Anchor Hocking 2-Tier Bamboo Corner Shelf, printed from the internet on Mar. 27, 2012 at www.walmart.com/ip/Anchor-Hocking-2-Tier-Bamboo-Corner-Shelf/16507390. Offered for sale more than one year prior to the Sep. 14, 2012 filing date of this application. (2 pgs).

Bed Bath & Beyond, Cabinet Shelf, printed from the Internet on Mar. 15, 2012 at www.bedbathandbeyond.com/product.asp?SKU=11197477. (2 pgs).

Organize.com, Linus Rectangular Pantry Shelf, printed from the internet on Mar. 15, 2012 at www.organize.com/linus-rectangular-shelf.html. Offered for sale more than one year prior to the Sep. 14, 2012 filing date of this application. (3pgs).

Target, Bamboo 3-Tier Corner Shelf, printed from the internet on Mar. 27, 2012 at www.target.com/...CPNG=furniture&adgroup=kitchen+dining2&LNM=Kitchen%20shelf%20organizer&MT=broad&LID=30p348429&KID=6077e322-8431-87a9-7b69-000065638d3a. Offered for sale more than one year prior to the Sep. 14, 2012 filing date of this application. (3 pgs).

Seville Classics, SHE14049 2-Tier Corner Shelf Organizer, printed from the internet on Mar. 27, 2012 at www.amazon.com/Seville-Classics-SHE14049-2-Tier-Organizer/dp/B002QCHSZA/ref=sr_1_12?s=home-garden&ie=UTF8&qid=1332883509&sr=1-12. Offered for sale more than one year prior to the Sep. 14, 2012 filing date of this application. (4 pgs).

Organize.com, Chrome Cabinet Shelf Organizer, printed from the internet on Mar. 15, 2012 at www.organize.com/rectangular-wire-shelf-chrome.html. Offered for sale more than one year prior to the Sep. 14, 2012 filing date of this application. (3pgs).

Bed Bath & Beyond, Metal Mesh Cabinet Shelf, printed from the internet on Mar. 15, 2012 at www.bedbathandbeyond.com/product.asp?SKU=18748878. (2 pgs).

Schulte Adjustable Shelf, White, printed from the internet on Mar. 27, 2012 at www.amazon.com/Schulte-2313171111-Adjustable-Shelf-White/dp/B0030M17HA/ref=sr_1_4?s=home-garden&ie=UTF8&qid=1332883509&sr=1-4. (3 pgs).

The Container Store, Photograph of Metal Wire Shelf. Copyright 2006 (2 pgs).

U.S. Appl. No. 29/432,222, filed Sep. 14, 2012, Klein et al.

* cited by examiner

STORAGE APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed to a storage apparatus, and in particular, to a stand-alone or add-on shelving unit that can be positioned on an existing support structure such as an existing shelf to provide additional storage space. In a first embodiment, the shelving unit is configured to engage and lock to the existing support structure. In a second embodiment, the shelving unit is configured to be expandable.

2. Description of Related Art

There are a variety of stand-alone or add-on shelves designed to be positioned on an existing shelf for increasing the storage capacity of the shelf. One such type of stand-alone shelf simply includes vertical legs that are supported by an existing shelf and a horizontal shelf surface extending between the legs. While this type of shelf presents an additional surface on which items may be stored, it may slide or move with respect to the existing shelf when items are placed on or removed from it. In order to prevent sliding, another type of add-on shelf includes a clamping structure that engages the existing shelf. This shelf, however, includes structure positioned between the existing shelf and the horizontal shelf surface of the add-on shelf that substantially prevents items from being placed on the existing shelf beneath the horizontal surface, and therefore the overall storage capacity of the existing shelf is reduced.

There are also width adjustable shelves that are supported by an existing shelf for increasing its storage capacity. One type of width adjustable shelf includes two sections that slide with respect to each other for altering the width of the shelf. The shelf includes six legs, one at each of the four corners of the shelf and two that support the middle of the shelf. The middle legs may interfere with storing items on the existing shelf beneath the width adjustable shelf. Another type of width adjustable shelf has two sections that are operable to engage each other in a plurality of width adjustable positions. Each section has a shelf surface joined to a vertical leg that is supported by an existing shelf. The shelf surfaces engage each other in each of the width adjustable positions via structures that extend above the horizontal plane of the shelf surfaces. The structures extending above the horizontal plane may interfere with storing and removing items placed on the shelf surface. While the prior art stand-alone or add-on shelving units are useful, a need remains in the art for stand-alone or add-on shelving units that can be effectively utilized to enhance storage in any area in the home or office.

BRIEF SUMMARY OF THE INVENTION

A first embodiment of the present invention is directed toward an add-on shelf that is configured to engage and lock to an existing structure, such as an existing shelf, for increasing storage capacity. The add-on shelf has a pair of legs and a shelf deck that is supported by the legs. At least one of the legs and preferably each of the legs has a locking structure that is configured to removably lock the leg to the existing structure. The locking structure preferably engages the existing structure to substantially prevent movement or rotation of the leg when items are placed on and removed from the shelf deck. There is a substantially void space positioned between the legs, the shelf deck and the existing structure. The void space allows a user of the shelf to access all of the storage space positioned between the shelf deck and the existing structure.

Preferably, the legs are removably coupled to the shelf deck or are operable to pivot with respect to the shelf deck such that the legs and shelf deck can lay generally flat against each other to reduce the overall volume of the add-on shelf for shipping or storage. The shelf deck may be positioned either above or below the existing structure. In one embodiment, the legs are operable to support multiple shelf decks that are vertically spaced. The add-on shelf may also include a third leg that is spaced from the pair of legs and another shelf deck that is supported by the third leg and one of the other legs at the same height as the first shelf deck. In another embodiment, the shelf deck has two sections that are operable to engage each other in a plurality of adjustable positions each corresponding to a different width of the shelf deck.

A second embodiment of the present invention is directed toward a width adjustable storage apparatus that is configured to be supported by an existing structure, such as an existing shelf, for increasing storage capacity. The storage apparatus has first and second sections that are operable to engage each other in a plurality of adjustable positions for presenting a shelf surface. Each of the adjustable positions corresponds to a different width of the shelf surface. First and second supports are coupled with the first and second sections, respectively, and are operable to engage the existing structure for supporting the first and second sections with respect to the existing structure. The shelf surface is positioned in a generally horizontal plane, and the first and second sections do not extend above the generally horizontal plane when engaging each other to prevent interference with items placed on the shelf surface. Preferably, a substantially void space is positioned between the supports, the shelf surface, and the existing structure. The void space allows a user of the shelf to access all of the storage space positioned between the shelf deck and the existing structure.

In the second embodiment, the first section of the storage apparatus may have a first pair of generally parallel frame bars and a first plurality of spaced apart support bars each supported by the first pair of frame bars and positioned generally perpendicular to the frame bars. The second section has a second pair of generally parallel frame bars and a second plurality of spaced apart support bars each supported by the second pair of frame bars and positioned generally perpendicular to the second pair of frame bars. One of the second plurality of support bars is operable to be supported by the first pair of frame bars in a plurality of adjustable positions in which the one of the second plurality of support bars is positioned between adjacent support bars of the first plurality of support bars. Each of the adjustable positions corresponds to a different width of the shelf surface.

The supports may pivot with respect to the sections such that the supports and sections can lay generally flat against each other to reduce the overall volume of the storage apparatus for shipping or storage. The supports may also be integral with the sections. The supports may engage the existing structure for supporting the shelf surface either above or below the existing structure. The supports may also include a locking structure that is configured to removably lock the supports to the existing structure.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
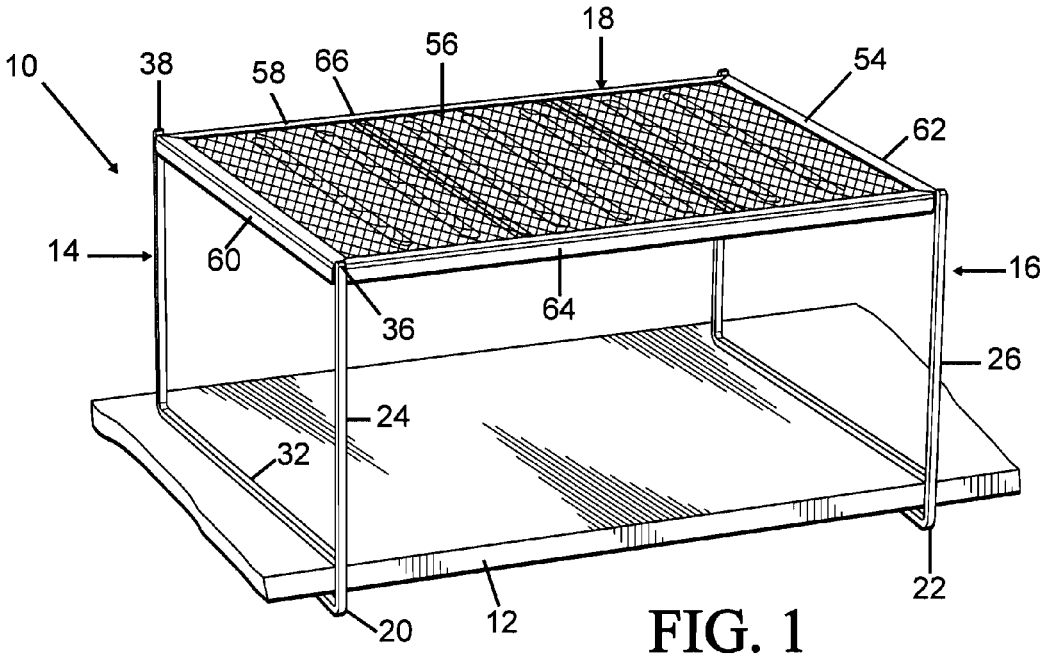
FIG. 1 is a perspective view of an embodiment of add-on shelf that is operable to removably lock to an existing shelf.

An add-on shelf in accordance with one embodiment of the present invention is generally shown in FIG. 1 as 10. The add-on shelf 10 is configured to engage an existing structure, such as the conventional shelf 12, for creating additional storage space above the conventional shelf 12. The add-on shelf 10 includes a pair of legs 14 and 16 and a shelf deck 18 that is supported by the legs 14 and 16. Leg 14 has a locking structure 20, best shown in FIG. 3, that is configured to removably lock the leg 14 to shelf 12, and leg 16 has a locking structure 22 that is configured to removably lock the leg 16 to shelf 12. The locking structures 20 and 22 removably lock the legs 14 and 16 to shelf 12 so that the legs 14 and 16 substantially do not move as a user places items on and removes items from shelf deck 18. Legs 14 and 16 have support structures 24 and 26, respectively, that are integral with and extend upward from locking structures 20 and 22. The support structures 24 and 26 support shelf deck 18. The add-on shelf 10 is configured such that there is a substantially void space positioned between the legs 14 and 16, the shelf deck 18, and shelf 12 for providing access to shelf 12 and items positioned thereon.

Figure 3:
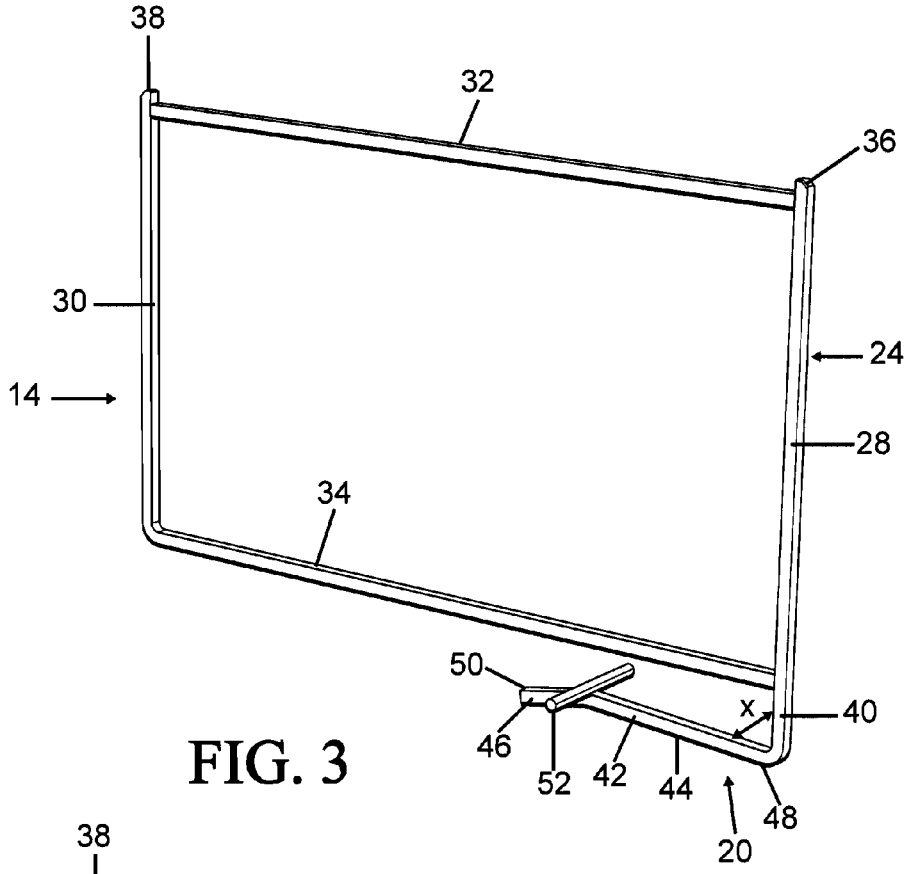
FIG. 3 is a perspective view of a leg of the shelf shown in FIG. 1.

Because legs 14 and 16 are substantially identical, only leg 14 is described in detail herein. Referring to FIG. 3, the support structure 24 of leg 14 includes a generally rectangular frame having front and rear bars 28 and 30 each joined to top and bottom bars 32 and 34. The top bar 32 supports the shelf deck 18 (shown in FIG. 1), and the bottom bar 34 abuts and is supported by the shelf 12 when the leg 14 is locked to shelf 12. Upper portions 36 and 38 of the front and rear bars 28 and 30, respectively, extend upward above the top bar 32 to prevent forward or rearward movement of shelf deck 18 when the shelf deck 18 is supported by the top bar 32 as shown in FIG. 1.

The locking structure 20 of leg 14 is a generally L-shaped clamp with a vertical first section 40 that is integral with front bar 28 and extends downward below bottom bar 34 and a generally horizontal second section 42 that is integral with and extends away from first section 40 beneath bottom bar 34. The second section 42 includes a first portion 44 that is integral with first section 40 and a second portion 46 that extends downward at an angle from first portion 44. The first and second sections 40 and 42 are joined such that there is an angle X between the sections 40 and 42. Before locking structure 20 is locked to a structure, angle X is preferably between approximately 85 to 95 degrees. The second section 42 has a first end 48 adjacent first section 40 and a second end 50. The locking structure 20 flexes with respect to support structure 24 so that second end 50 is operable to move toward and away from bottom bar 34.

Figure 4:
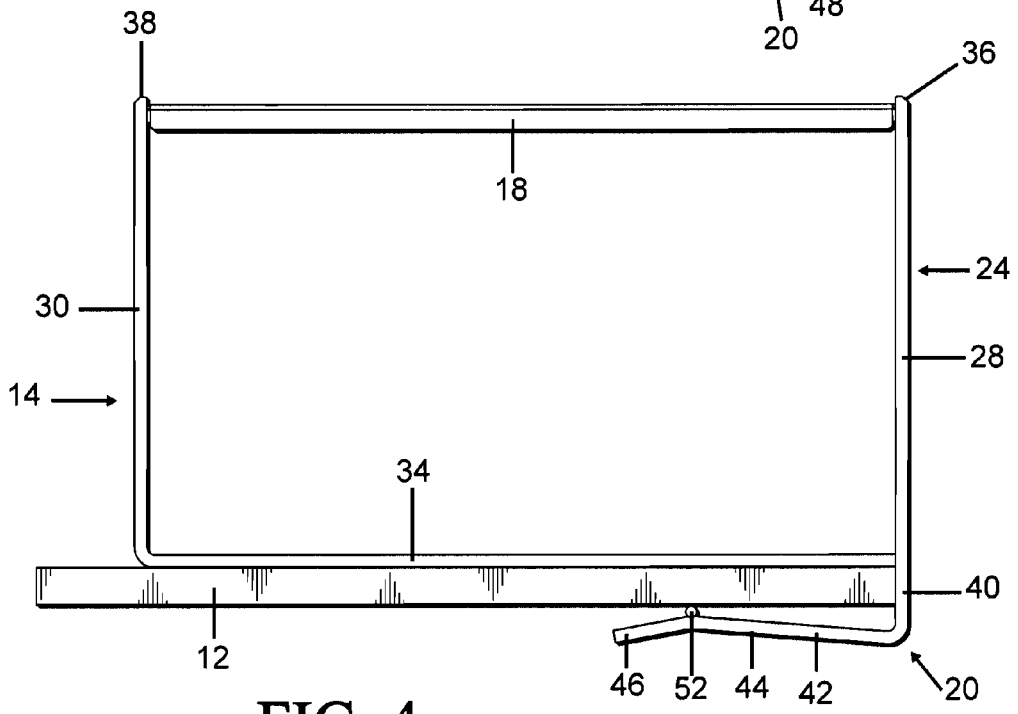
FIG. 4 is a side view of the shelf shown in FIG. 1.
Figure 5:
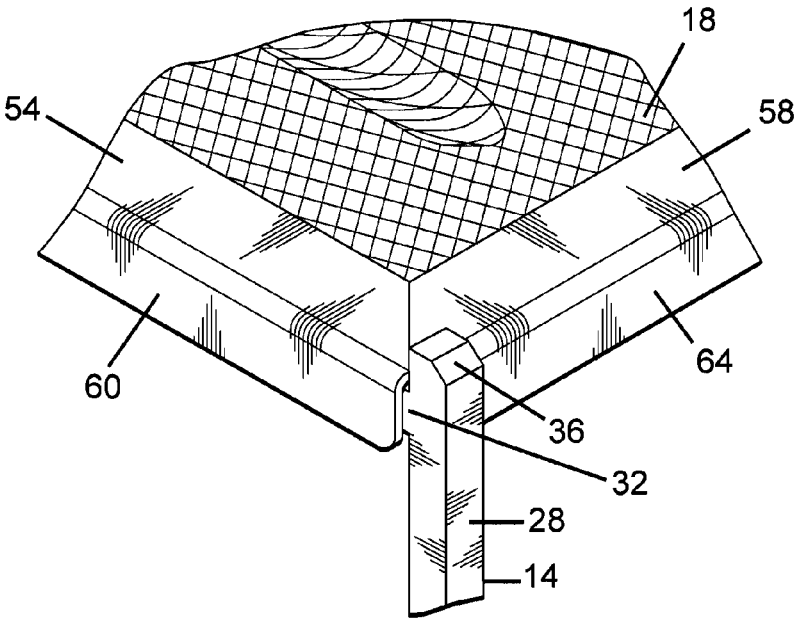
FIG. 5 is a detail view of a corner portion of a shelf deck and leg of the shelf shown in FIG. 1.
Figure 6:
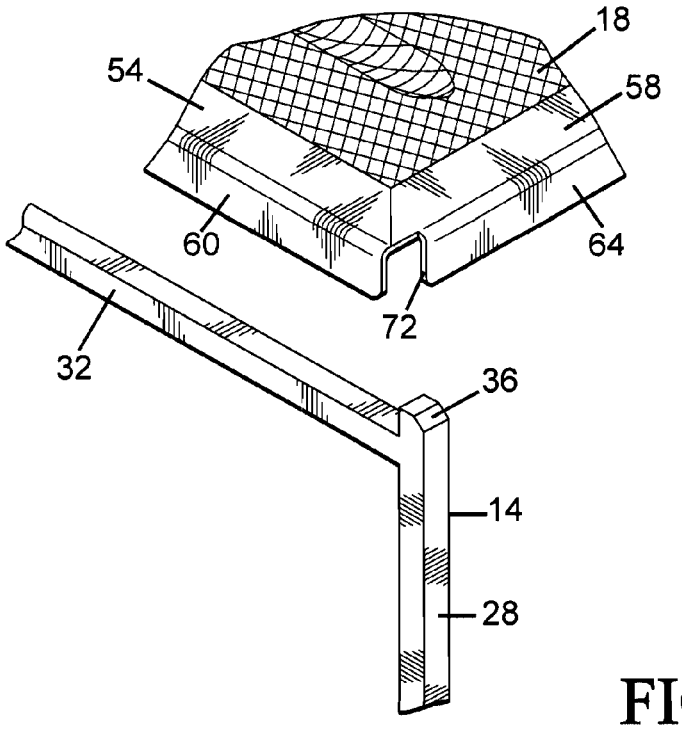
FIG. 6 is an exploded view of the corner portion of the shelf deck and leg shown in FIG. 5.

A horizontal stabilizer bar 52 is joined to the second section 42 where the first and second portions 44 and 46 meet. The stabilizer bar 52 extends laterally to both sides of the second section 42. Substantially all of leg 14 is positioned in a generally vertical plane except for stabilizer bar 52, which extends laterally to both sides of that vertical plane to stabilize the leg 14 when it is locked to shelf 12. As shown in FIG. 4, when leg 14 is locked to shelf 12, the stabilizer bar 52 abuts a lower surface of shelf 12 to substantially prevent leg 14 from rotating about a horizontal axis aligned with bottom bar 34. It is also within the scope of the invention for the stabilizer bar 52 to be joined to the bottom bar 34 and extend laterally from both sides of the bottom bar 34.

The locking structure 20 flexes with respect to the support structure 24 to clamp the shelf 12 between the stabilizer 52 and bottom bar 34 thereby locking leg 14 to shelf 12. Preferably, the distance between the stabilizer 52 and the bottom bar 34 is slightly less than the thickness of shelf 12 so that stabilizer 52 must be moved downward away from bottom bar 34 in order to clamp the shelf 12 between the stabilizer 52 and bottom bar 34. If the distance between stabilizer 52 and bottom bar 34 is less than the thickness of shelf 12, stabilizer 52 and bottom bar 34 exert a clamping force on shelf 12 when shelf 12 is positioned between the stabilizer 52 and bottom bar 34. The clamping force exerted by stabilizer 52 and bottom bar 34 and the tendency of stabilizer 52 to substantially prevent leg 14 from rotating about an axis aligned with bottom bar 34 support leg 14 in a generally vertical position when shelf 12 is clamped between stabilizer 52 and bottom bar 34.

Figure 2:
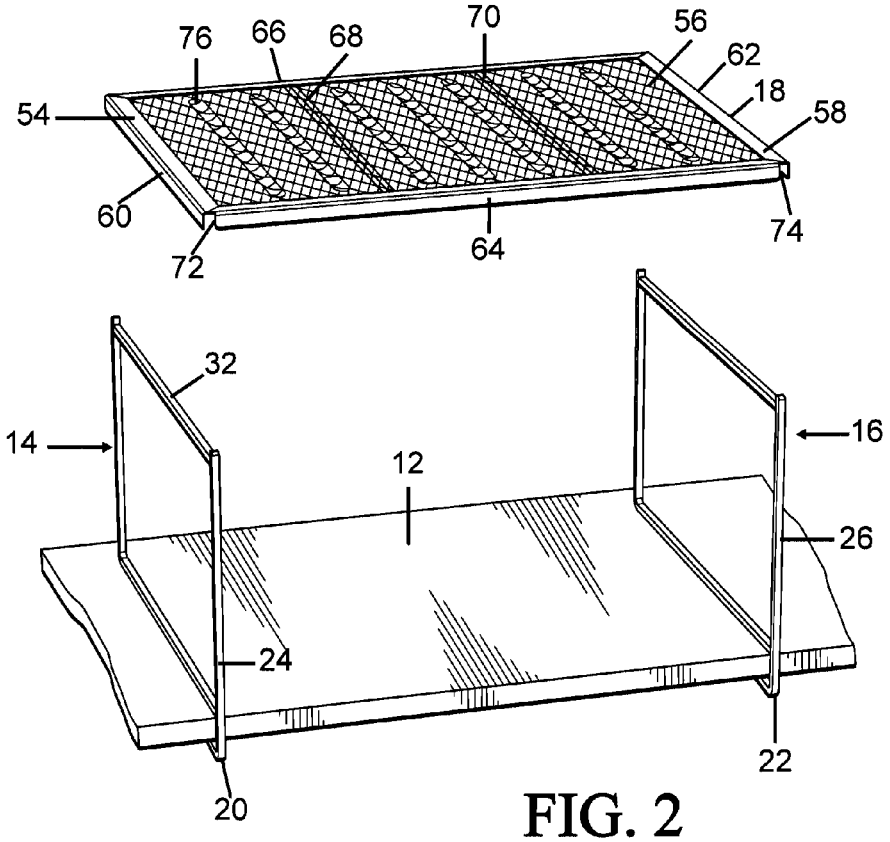
FIG. 2 is an exploded view of the shelf shown in FIG. 1.

Referring to FIG. 2, shelf deck 18 includes a frame 54 and a generally horizontal surface 56 formed from wire mesh or expanded metal that is joined to the frame 54 preferably by welding. The frame 54 includes a top portion 58 shaped generally in the outline of a rectangle that forms a top surface of the shelf deck 18 along with horizontal surface 56. Left and right side surfaces 60 and 62 and front and rear surfaces 64 and 66 extend downward from top portion 58 so that each in combination with top portion 58 has a generally L-shaped cross-section. Frame 54 also includes two cross-bars 68 and 70 that are joined with top portion 58 and extend between front and rear surfaces 64 and 66 for supporting horizontal surface 56. It is within the scope of the invention for the frame 54 to have more or less than two cross-bars for other sizes of shelf decks.

Front surface 64 is configured such that there are rectangular gaps 72 and 74 formed between front surface 64 and left and right side surfaces 60 and 62, respectively. Rear surface 66 is also configured such that there are similar rectangular gaps (not shown) formed between rear surface 66 and left and right side surfaces 60 and 62. The rectangular gaps 72 and 74 in front surface 64 preferably have a width that is slightly larger than the width of the top bar 32 of leg 14 and the top bar of leg 16 such that the top bar 32 of leg 14 can be received by the gap 72 and the top bar of leg 16 can be received by the gap 74. The rectangular gaps (not shown) in rear surface 66 also preferably have a width that is slightly larger than the width of the top bars 32 of leg 14 and 16 for receiving the top bars in a similar manner. When the top bars 32 of legs 14 and 16 are received by the rectangular gaps 72 and 74 in front and rear surfaces 64 and 66, the top portion 58 of frame 54 is supported by the top bars 32 of legs 14 and 16 and the shelf deck 18 is positioned as shown in FIG. 1. In this position, the left side surface 60 abuts the top bar 32 of leg 14 and the right side surface 62 abuts the top bar of leg 16 to substantially prevent the shelf deck 18 from moving laterally with respect to legs 14 and 16. A plurality of elongate depressions, one of which is identified as 76, are formed in horizontal surface 56 to increase the stiffness of the surface 56.

When the add-on shelf 10 is being shipped, or when it is not in use, legs 14 and 16 and shelf 18 can be laid substantially flat on top of each other so that the shelf 10 takes up minimal volume. The substantially planar shape of legs 14 and 16 and shelf 18 allow the legs 14 and 16 and shelf 18 to lay substantially flat.

The legs 14 and 16 and shelf deck 18 are preferably made from metal such as steel or aluminum, but it is within the scope of the invention for the legs and shelf deck to be made from other materials such as wood. The wire mesh or expanded metal horizontal surface 56 of shelf deck 18 has a wire grid with diamond shaped openings. It is within the scope of the invention for the wire grid to have openings with different shapes such as square or rectangle.

In use, leg 14 is locked to shelf 12 by flexing the locking structure 20 away from the support structure 24 and positioning the shelf 12 between the locking structure 20 and support structure 24. Leg 16 is locked to shelf 12 in a similar manner. Shelf deck 18 is then placed on top of the legs 14 and 16 so that it is supported by the legs 14 and 16 as described above. Items may then be placed on top of the shelf deck 18 and also on the shelf 12 beneath the shelf deck 18. In addition, the legs 14 and 16 serve as dividers operable to separate material that is placed on the existing shelf 12. For example, each of legs 14 and 16 can separate or divide one type of material placed on existing shelf 12 on one side of the legs 14 and 16 from another type of material placed on existing shelf 12 on the other side of the legs 14 and 16.

Figure 7:
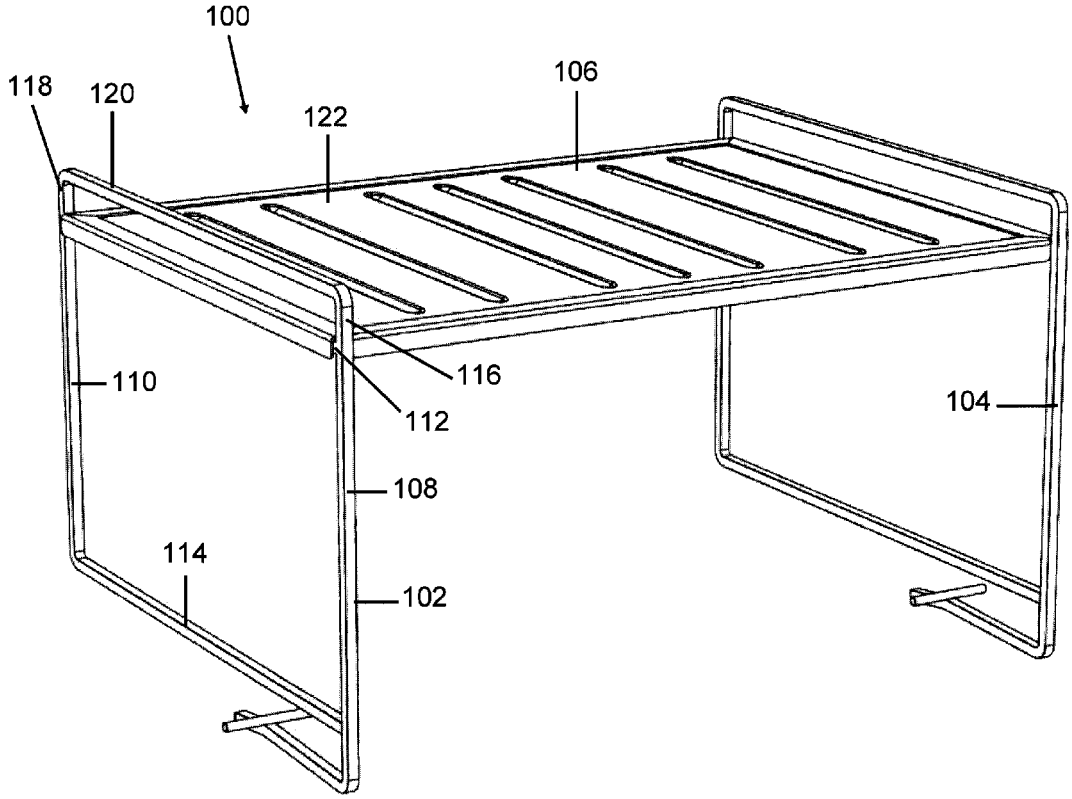
FIG. 7 is a perspective view of a first alternative embodiment of add-on shelf having legs with portions that extend above a shelf deck.

A first alternative embodiment of add-on shelf is shown in FIG. 7 as 100. Shelf 100 is substantially similar to shelf 10, shown in FIG. 1. Accordingly, only the differences between the two are described in detail herein. Shelf 100 has legs 102 and 104 that are operable to lock to an existing shelf and a shelf deck 106 that is supported by the legs 102 and 104 in a similar manner as described above with respect to shelf 10. The legs 102 and 104 are substantially similar. Accordingly, only leg 102 is described in detail herein. Leg 102 is substantially similar to leg 14, shown in FIG. 3, and has a rectangular frame with front and rear bars 108 and 110 and top and bottom bars 112 and 114. Upper portions 116 and 118 of the front and rear bars 108 and 110 extend above the top bar 112. Leg 102 differs from leg 14 because it has an upper rail 120 positioned above top bar 112. The upper rail 120 is substantially horizontal and is integral with and extends between the upper portions 116 and 118 of front and rear bars 108 and 110. The upper rail 120 is operable to prevent items from undesirably falling from shelf deck 106. Shelf deck 106 differs from shelf deck 18, shown in FIG. 1, because shelf deck 106 has a horizontal surface 122 that is substantially planar and continuous as opposed to the wire mesh surface shown in FIG. 1. However, it is within the scope of the invention for the surface 122 to be formed from wire mesh or expanded metal.

Figure 8A:
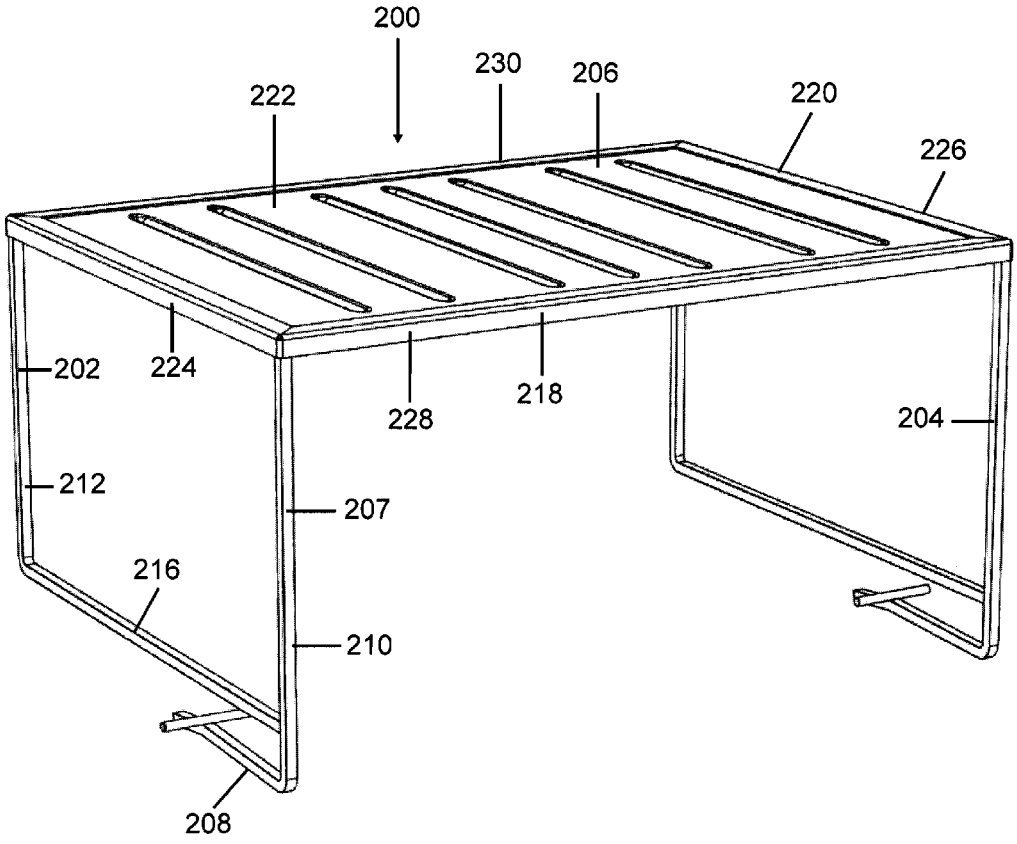
FIG. 8A is a perspective view of a second alternative embodiment of add-on shelf having a shelf deck that encloses an upper portion of legs.
Figure 8B:
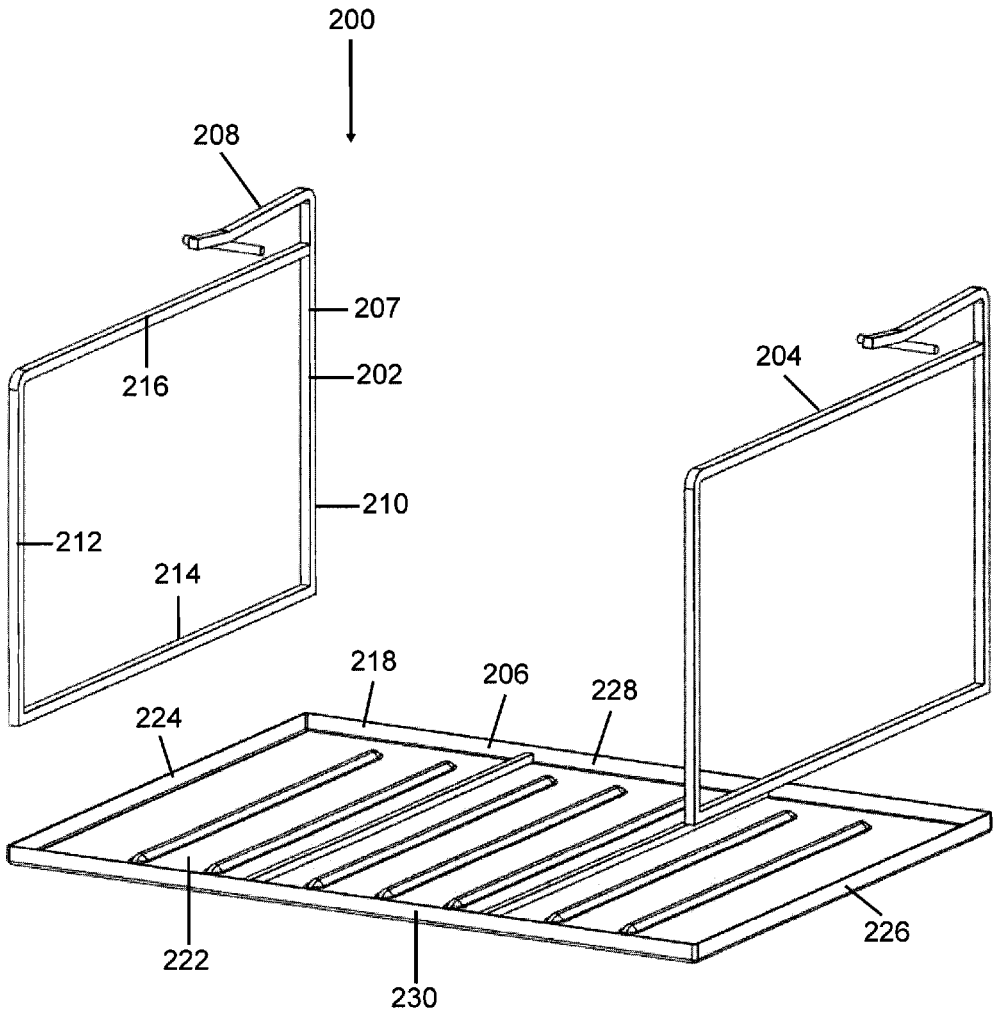
FIG. 8B is an exploded view showing the bottom of the shelf of FIG. 8A.

FIGS. 8A and 8B show a second alternative embodiment of add-on shelf 200. Shelf 200 has legs 202 and 204 that are operable to lock to an existing shelf and a shelf deck 206 that is supported by legs 202 and 204. Legs 202 and 204 are substantially similar. Accordingly, only leg 202 is described in detail herein. Leg 202 includes a support structure 207 and a locking structure 208 that is substantially similar to the locking structure of leg 14 shown in FIG. 1. The support structure 207 has a rectangular frame having front and rear bars 210 and 212 and top and bottom bars 214 and 216. The support structure 207 of leg 202 differs from the support structure of leg 14, shown in FIG. 1, because support structure 207 does not include upper portions extending above top bar 214.

Shelf deck 206 is substantially similar to the shelf deck 18 shown in FIG. 1 except that shelf deck 206 has a frame 218 that does not include gaps. The frame 218 includes a top portion 220 shaped in the outline of a rectangle that forms a top surface of the shelf deck 206 along with horizontal surface 222. Left and right side surfaces 224 and 226 and front and rear surfaces 228 and 230 extend downward from top portion 220 so that each in combination with top portion 220 has a generally L-shaped cross-section. When assembled, as shown in FIG. 1, the shelf deck 206 is supported by the top bar 214 of leg 202 and the top bar of leg 204. The distance between front and rear surfaces 228 and 230 is configured so that it is slightly larger than the distance between the front and rear bars 210 and 212 of legs 202 and 204 so that the top bar 214 of legs 202 and 204 fits within the front and rear surfaces 228 and 230. When shelf deck 206 is supported by legs 202 and 204, the front and rear surfaces 228 and 230 abut or are closely adjacent to the front and rear bars 210 and 212 of legs 202 and 204 to substantially prevent the shelf deck 206 from moving forward or rearward. Left and right side surfaces 224 and 226 also abut or are closely adjacent to the top bars 214 of legs 202 and 204 to substantially prevent the shelf deck 206 from moving left or right.

Figure 9A:
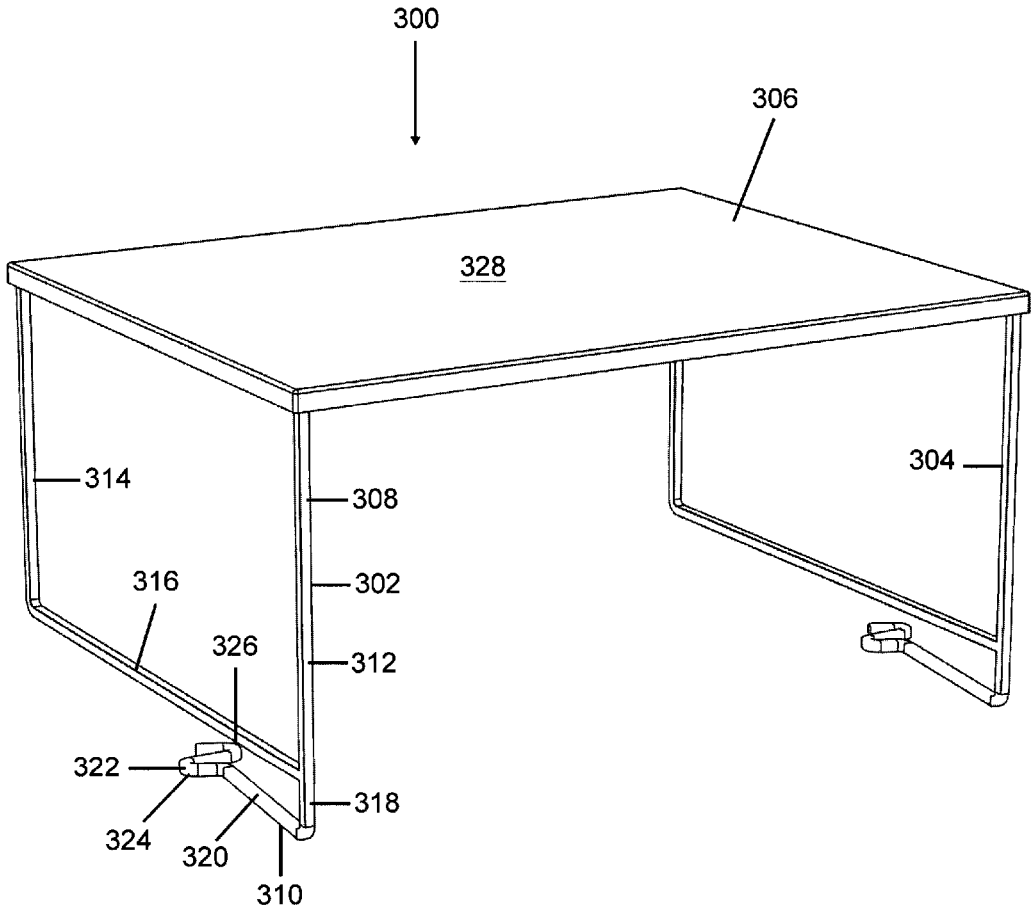
FIG. 9A is a perspective view of a third alternative embodiment of add-on shelf having legs that are received by openings in a shelf deck.
Figure 9B:
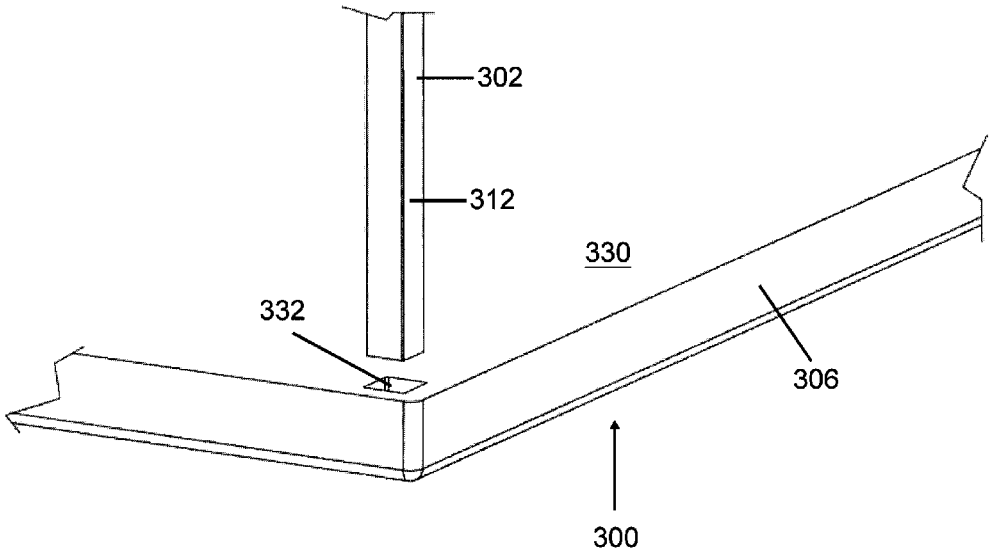
FIG. 9B is an exploded view of a portion of the shelf of FIG. 9A showing a leg and an opening in the shelf deck that receives the leg.

A third alternative embodiment of add-on shelf 300 is shown in FIGS. 9A and 9B. Shelf 300 includes legs 302 and 304 that are operable to lock to an existing shelf and a shelf deck 306 that is supported by legs 302 and 304. The legs 302 and 304 are substantially similar. Accordingly, only leg 302 is described in detail herein. Leg 302 includes a support structure 308 and a locking structure 310. The support structure 308 includes front and rear bars 312 and 314 and a bottom bar 316 joined with and extending between the front and rear bars 312 and 314. The locking structure 310 has a vertical first section 318 that is integral with front bar 312 and extends downward below bottom bar 316 and a generally horizontal second section 320 that is integral with and extends away from first section 318 beneath bottom bar 316. The second section 320 has a generally S-shaped end 322 with portions 324, 326 that extend laterally outward from either side of the remainder of leg 302, which besides generally S-shaped end 322 is positioned in a substantially vertical plane. The laterally extending portions 324 and 326 of generally S-shaped end 322 engage a lower surface of a shelf in a similar manner as the stabilizer bar 52, shown in FIG. 4, to substantially prevent the leg 302 from rotating about an axis aligned with bottom bar 316. The locking structure 310 otherwise performs in a substantially similar manner as the locking structure 20, shown in FIG. 3, in that it flexes away from support structure 308 to receive and lock a shelf between the support structure 308 and locking structure 310.

The shelf deck 306 has an upper surface 328 and a lower surface 330, shown in FIG. 9B. An opening 332 is formed in one of the corners of lower surface 330. The opening 332 is sized to receive an upper portion of front bar 312. There are additional openings (not shown) in the other three corners of lower surface 330 for receiving upper portions of rear bar 314 and the front and rear bars of leg 304. The openings 332 receive the upper portions of front and rear bars 312 and 314 of legs 302 and 304 for supporting shelf deck 306 and substantially preventing shelf deck 306 from moving forward, rearward, left or right when assembled, as shown in FIG. 9A. In another embodiment, it is also within the scope of the invention for the shelf deck 306 to have protrusions that are received by openings in the legs 302 and 304.

Figure 10A:
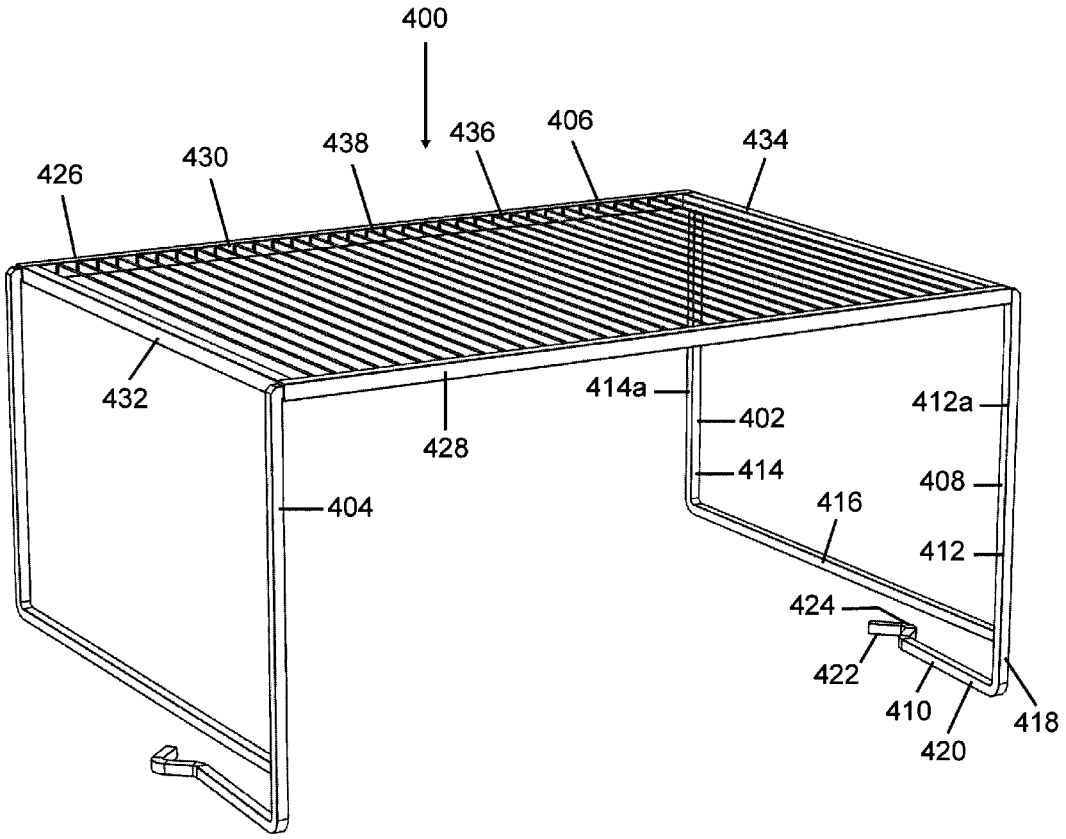
FIG. 10A is a perspective view of a fourth alternative embodiment of add-on shelf having legs that are received by openings in a shelf deck.
Figure 10B:
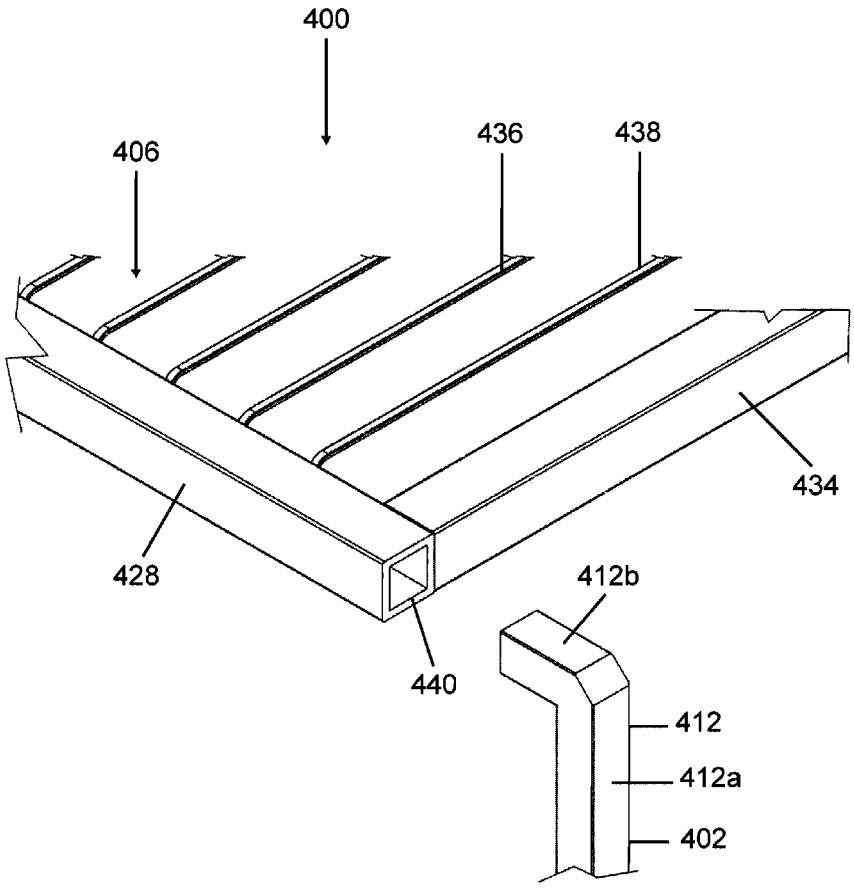
FIG. 10B is an exploded view of a portion of the shelf of FIG. 10A showing a leg and an opening in the shelf deck that receives the leg.

A fourth alternative embodiment of add-on shelf 400 is shown in FIGS. 10A and 10B. Shelf 400 includes legs 402 and 404 that are operable to lock to an existing shelf and a shelf deck 406 that is supported by legs 402 and 404. The legs 402 and 404 are substantially similar. Accordingly, only leg 402 is described in detail herein. Leg 402 includes a support structure 408 and a locking structure 410. The support structure 408 includes front and rear bars 412 and 414 and a bottom bar 416 joined with and extending between the front and rear bars 412 and 414. The front bar 412 includes a vertical portion 412*a* joined to bottom bar 416 and a horizontal portion 412*b* (shown in FIG. 10B) spaced apart from bottom bar 416. The rear bar 414 also includes a vertical portion 414*a* joined to bottom bar 416 and a horizontal portion (not shown) spaced apart from bottom bar 416. The locking structure 410 has a vertical first section 418 that is integral with front bar 412 and extends downward below bottom bar 416 and a generally horizontal second section 420 that is integral with and extends away from first section 418 beneath bottom bar 416. The second section 420 has a generally C-shaped end 422 with a portion 424 that extends laterally outward from the remainder of leg 402, which besides C-shaped end 422 is positioned in a substantially vertical plane. The laterally extending portion 424 of generally C-shaped end 422 engages a lower surface of a shelf in a similar manner as the stabilizer bar 52, shown in FIG. 4, to substantially prevent the leg 402 from rotating about an axis aligned with bottom bar 416. The locking structure 410 otherwise performs in a substantially similar manner as the locking structure 20, shown in FIG. 3, in that it flexes away from support structure 408 to receive and lock a shelf between the support structure 408 and locking structure 410.

The shelf deck 406 has a peripheral frame 426 with front, rear, left, and right bars 428, 430, 432, and 434. The shelf deck 406 has an upper surface 436 that is formed from a plurality of wires 438 that are joined to and extend between front and rear bars 428 and 430. An opening 440 (shown in FIG. 10B) is formed in an end of front bar 428. The opening 440 is sized to receive the horizontal portion 412*b* of front bar 412. There are additional openings (not shown) in the other end of front bar 428 and both ends of rear bar 430 for receiving upper, horizontal portions of rear bar 414 and of the front and rear bars of leg 404. The openings 440 receive the upper, horizontal portions of front and rear bars 412 and 414 of legs 402 and 404 for supporting shelf deck 406 and substantially preventing shelf deck 406 from moving forward, rearward, left or right when assembled, as shown in FIG. 10A. It is also within the scope of the invention for the openings 440 to be in the left and right bars 432 and 434 of shelf deck 406.

Figure 11A:
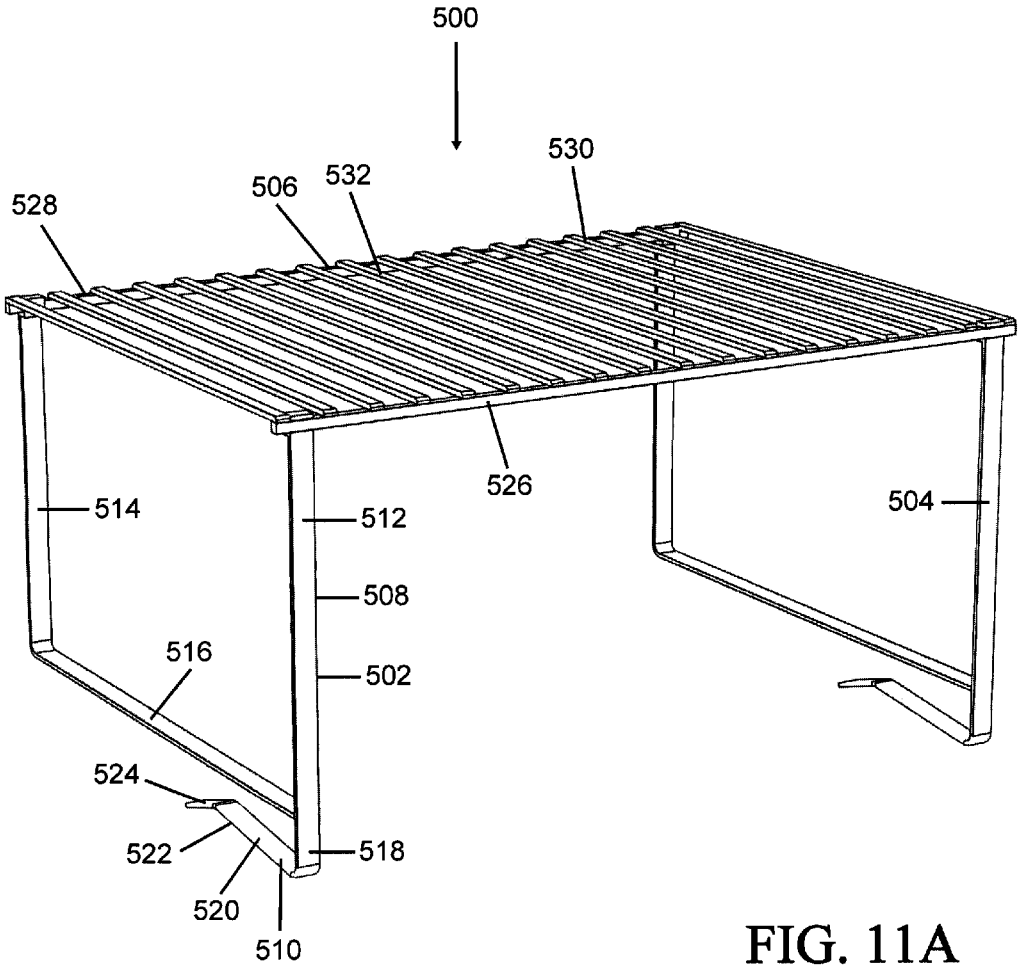
FIG. 11A is a perspective view of a fifth alternative embodiment of add-on shelf having legs with hooks that engage a shelf deck.
Figure 11B:
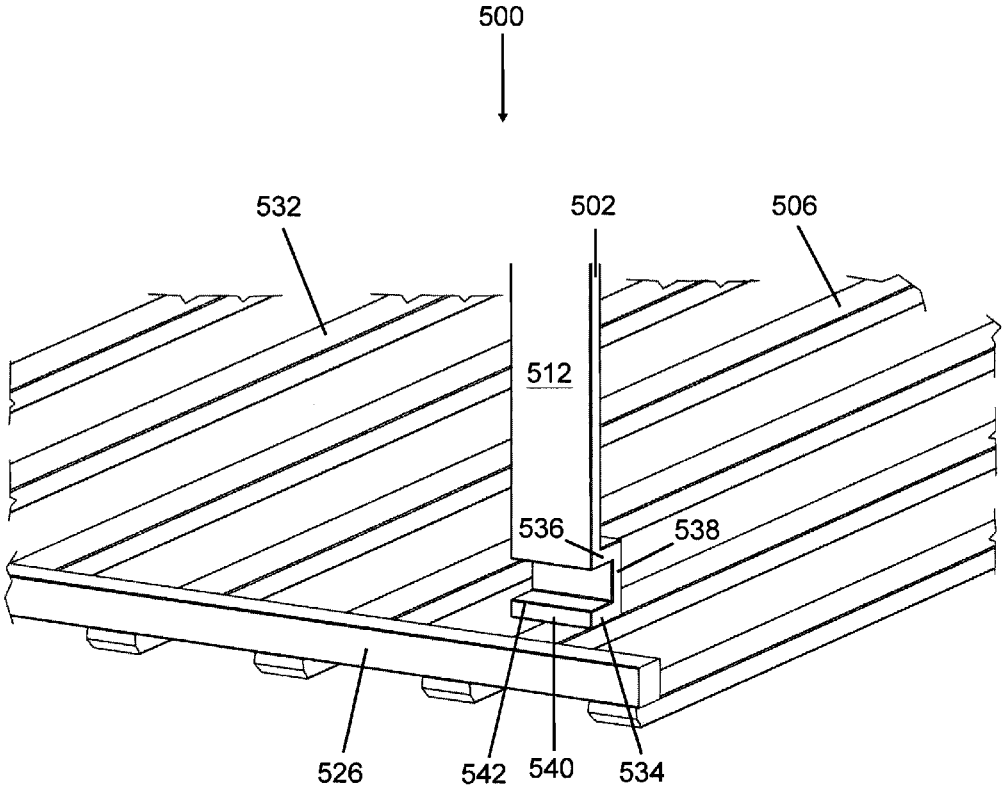
FIG. 11B is an exploded view of a portion of the shelf of FIG. 11A showing a hook that engages the shelf deck.

Referring to FIGS. 11A and 11B, a fifth alternative embodiment of add-on shelf 500 is shown. Shelf 500 includes legs 502 and 504 that are operable to lock to an existing shelf and a shelf deck 506 that is supported by legs 502 and 504. The legs 502 and 504 are substantially similar. Accordingly, only leg 502 is described in detail herein. Leg 502 includes a support structure 508 and a locking structure 510. The support structure 508 includes front and rear bars 512 and 514 and a bottom bar 516 joined with and extending between the front and rear bars 512 and 514. The locking structure 510 has a vertical first section 518 that is integral with front bar 512 and extends downward below bottom bar 516 and a generally horizontal second section 520 that is integral with and extends away from first section 518 beneath bottom bar 516. The second section 520 includes a first portion 522 that is integral with vertical first section 518 and a section portion 524 that extends downward at an angle from first portion 522.

Bottom bar 516 and second section 520 of locking structure 510 are made from relatively wide bars, and the wide surface of the bottom bar 516 and second section 520 engages an existing shelf to lock leg 502 to the shelf. The relatively wide surface of the bottom bar 516 and second section 520 assists in substantially preventing the leg 502 from rotating about an axis aligned with bottom bar 516 in a similar manner as the stabilizer 52 shown in FIG. 3. The locking structure 510 otherwise performs in a substantially similar manner as the locking structure 20, shown in FIG. 3, in that it flexes away from support structure 508 to receive and lock a shelf between the support structure 508 and locking structure 510.

The shelf deck 506 has a frame consisting of front and rear bars 526 and 528. The shelf deck 506 has an upper surface 530 that is formed from a plurality of bars 532 that are joined to and extend between front and rear bars 526 and 528. Referring to FIG. 11B, front bar 512 of leg 502 has an upper end that terminates in a C-shaped hook 534. The hook 534 includes a first horizontal section 536 joined with and extending substantially perpendicular from front bar 512, a vertical section 538 joined with and extending substantially perpendicular from horizontal section 536 such that it is parallel to front bar 512, and a second horizontal section 540 joined with and extending substantially perpendicular from vertical section 538. A slot 542 is formed by the sections 536, 538, and 540 of hook 534, which is sized for receiving the front bar 526 of shelf deck 506. Hooks similar to hook 534 are also formed on upper ends of the rear bar 514 of leg 502 and the front and rear bars of leg 504 for engaging the front and rear bars 526 and 528 of shelf deck 506 as shown in FIG. 11A. When the hooks 534 on legs 502 and 504 engage shelf deck 506, shelf deck 506 is supported by the legs 502 and 504 and the hooks 534 substantially prevent forward or rearward movement of shelf deck 506. The hooks 534 preferably engage the front and rear bars 526 and 528 of shelf deck 506 between adjacent bars 532 so that the hooks 534 abut the bars 532 for substantially preventing the shelf deck 506 from moving to the left or right. In another embodiment, it is also within the scope of the invention for the shelf deck 506 to have hooks that receive and engage portions of legs 502 and 504.

Figure 12A:
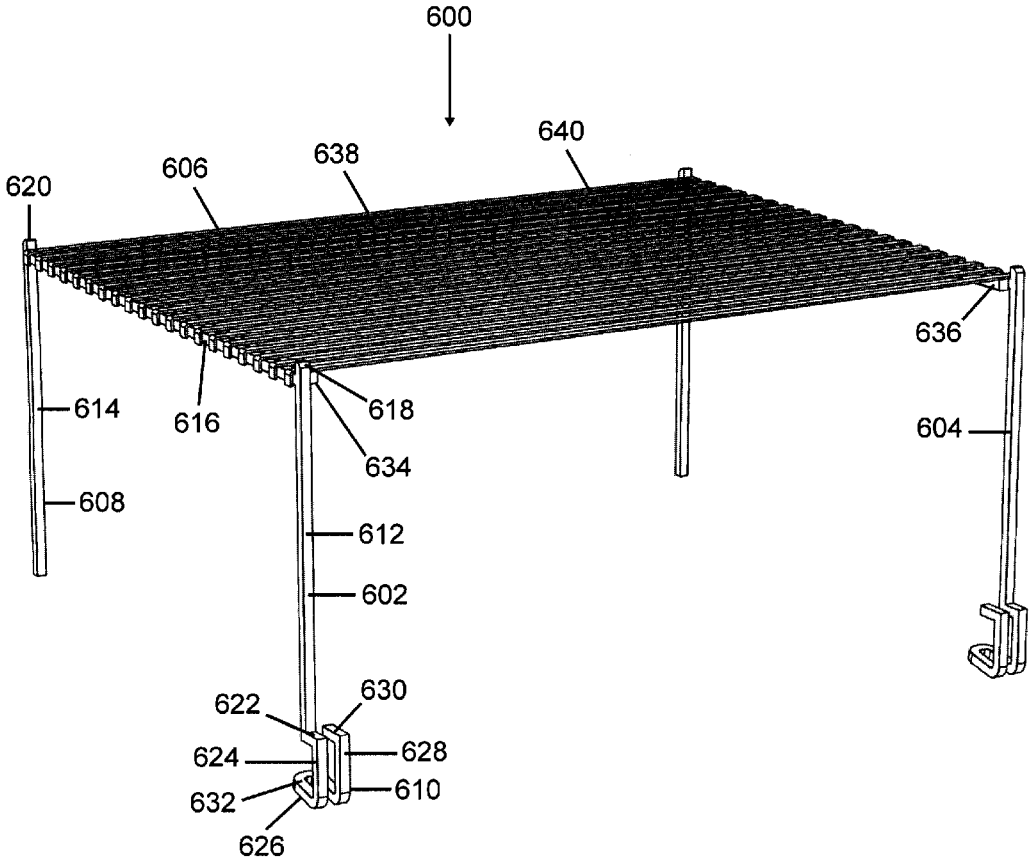
FIG. 12A is a perspective view of a sixth alternative embodiment of add-on shelf having a shelf deck that is supported by legs.
Figure 12B:
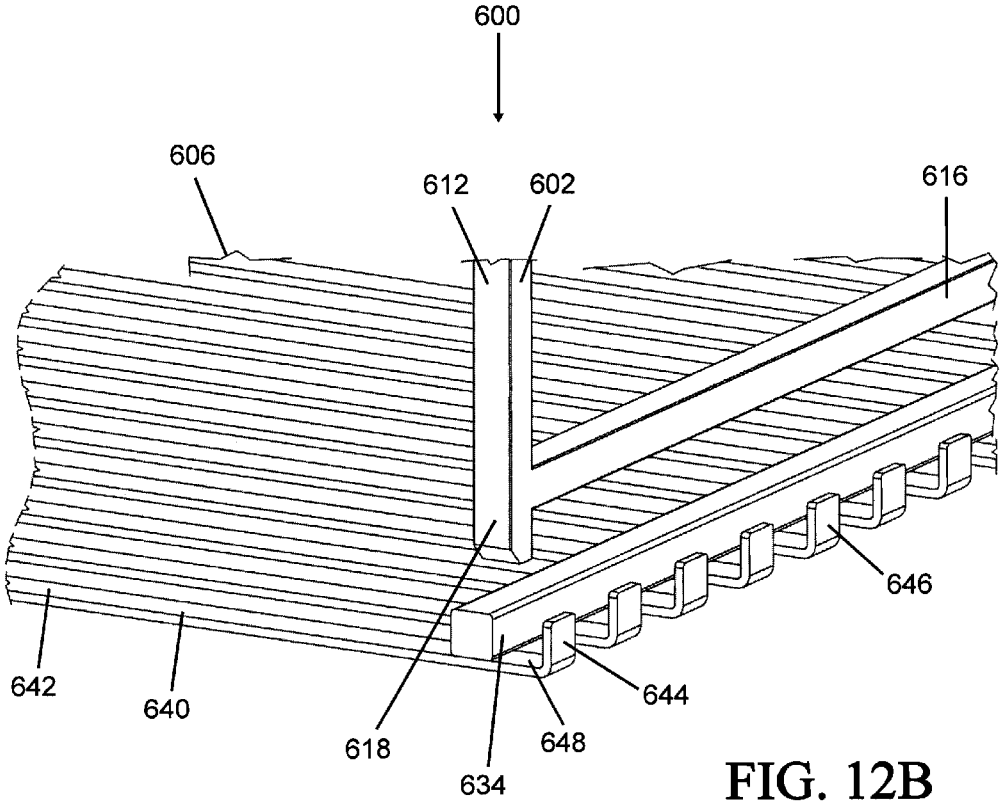
FIG. 12B is an exploded view of a portion of the shelf of FIG. 12A showing the underside of the shelf deck and upper portion of one of the legs.

A sixth alternative embodiment of add-on shelf 600 is shown in FIGS. 12A and 12B. Shelf 600 includes legs 602 and 604 that are operable to lock to an existing shelf and a shelf deck 606 that is supported by legs 602 and 604. The legs 602 and 604 are substantially similar. Accordingly, only leg 602 is described in detail herein. Leg 602 includes a support structure 608 and a locking structure 610. The support structure 608 includes front and rear bars 612 and 614 and a top bar 616 joined with and extending between the front and rear bars 612 and 614. Upper portions 618 and 620 of the front and rear bars 612 and 614, respectively, extend upward above the top bar 616 to prevent forward or rearward movement of shelf deck 606 when the shelf deck 606 is supported by the top bar 616 as shown in FIG. 12A.

The locking structure 610 is a C-shaped clamp operable to receive an existing shelf for locking leg 602 to the shelf. The locking structure 610 includes a first horizontal section 622 joined with and extending substantially perpendicular from front bar 612, a first vertical section 624 joined with and extending substantially perpendicular from horizontal section 622 such that it is parallel with front bar 612, a horizontal U-shaped section 626 joined with and extending substantially perpendicular from vertical section 624 underneath front bar 612, a second vertical section 628 joined with and extending substantially perpendicular from U-shaped section 626 such that it is parallel to and spaced apart from first vertical section 624, and a second horizontal section 630 joined with and extending substantially perpendicular from second vertical section 628 such that it is parallel to and spaced apart from first horizontal section 622. The sections of locking structure 610 form a slot 632 that is sized for receiving an existing shelf. The U-shaped section 626 may flex away from horizontal sections 622 and 630 to provide clearance for sliding an existing shelf into slot 632. If the existing shelf is slightly larger than the slot 632 such that U-shaped section 626 must flex away from horizontal sections 622 and 630, the horizontal sections 622 and 630 and U-shaped section 626 will exert a clamping force on the existing shelf to assist in locking the leg 602 to the existing shelf. When an existing shelf is received by slot 632, lower surfaces of the horizontal sections 622 and 630 abut an upper surface of the existing shelf and an upper surface of the U-shaped section 626 abuts a lower surface of the existing shelf. Lower surfaces of the front and rear bars 612 and 614 are supported by an upper surface of the existing shelf. The U-shaped section 626, second vertical section 628, and second horizontal section 630 of the locking structure 610 extend laterally outward to one side from the remainder of leg 602, which besides these sections of locking structure 610 is positioned in a substantially vertical plane. The laterally extending U-shaped section 626, second vertical section 628, and second horizontal section 630 of the locking structure 610 engage an existing shelf in a similar manner as the stabilizer bar 52, shown in FIG. 4, to substantially prevent the leg 602 from rotating about an axis aligned with first horizontal section 622.

The shelf deck 606 has a frame consisting of left and right bars 634 and 636. The shelf deck 606 has an upper surface 638 that is formed from a plurality of bars 640 that are joined to upper surfaces of and extend between left and right bars 634 and 636. Referring to FIG. 12B, each of the bars 640 has a horizontal middle section 642 and a vertical left end section 644 that is bent downward from the middle section 642. The combination of the vertical left end sections 644 of each of bars 640 creates a left side surface 646 of the shelf deck 606. There is a gap 648 positioned between the left side surface 646 and left bar 634 which is sized for receiving the top bar 616 of leg 602. Each of the bars 640 also has a vertical right end section (not shown) that is bent downward from the middle section 642 to in combination create a right side surface (not shown) of the shelf deck 606. There is also a gap (not shown) between the right side surface (not shown) and right bar 636 for receiving the top bar of leg 604. When the top bar 616 of leg 602 is received by the gap 648 between the left side surface 646 and left bar 634 and the top bar of leg 604 is received by the similar gap between the right side surface and right bar 636, the shelf deck 606 is supported by the top bar 616 of each leg 602 and 604. Further, the top bar 616 of leg 602 abuts the left side surface 646 of the shelf deck 606 and the top bar of leg 604 abuts the right side surface of the shelf deck 606 for substantially preventing the shelf deck 606 from moving to the left or right.

Figure 13A:
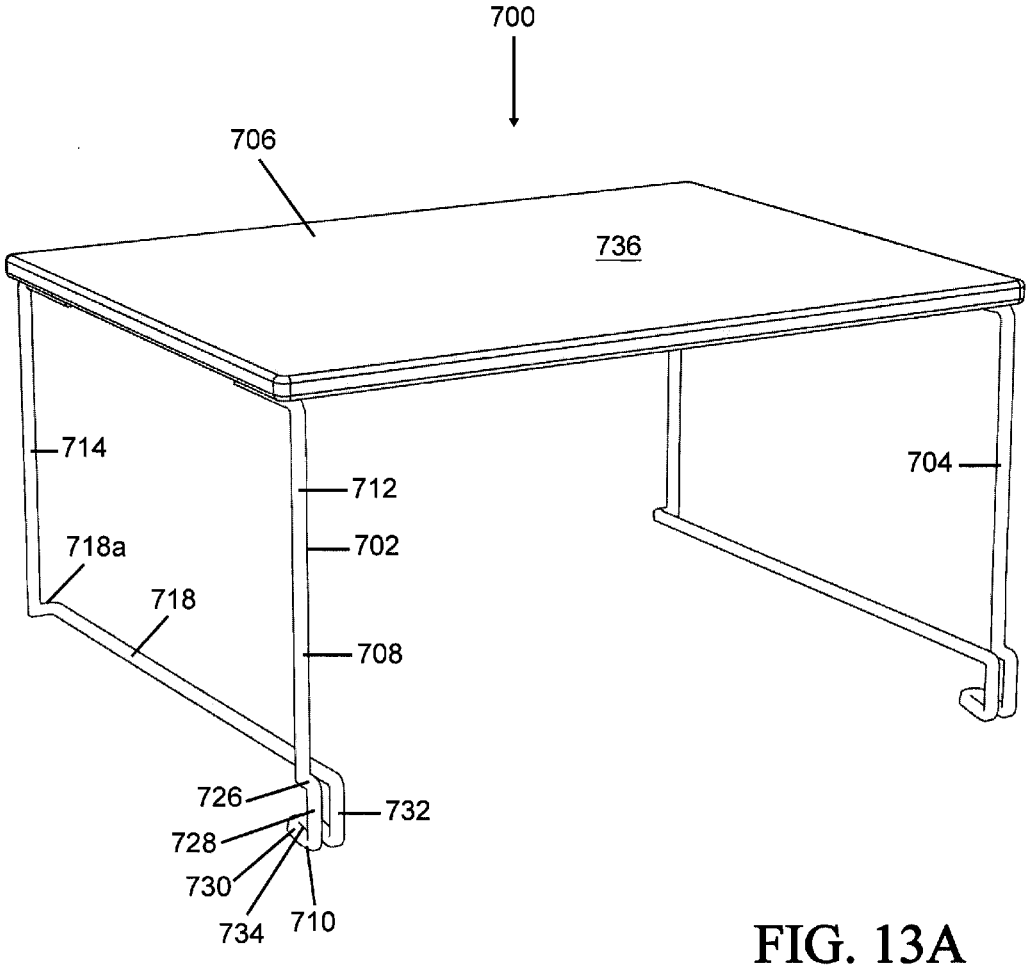
FIG. 13A is a perspective view of a seventh alternative embodiment of add-on shelf having a shelf deck with a slot that receives a portion of a leg.
Figure 13B:
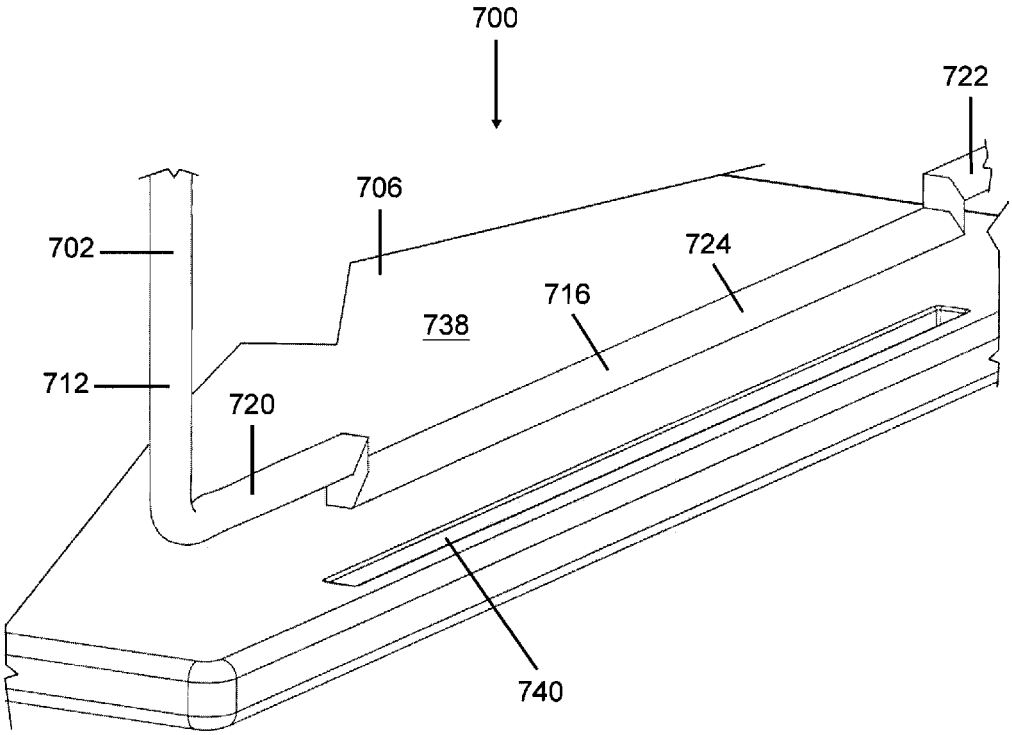
FIG. 13B is an exploded view of a portion of the shelf of FIG. 13A showing the slot in the shelf deck that receives a portion of the leg.

Referring to FIGS. 13A and 13B, a seventh alternative embodiment of add-on shelf is shown as 700. Shelf 700 includes legs 702 and 704 that are operable to lock to an existing shelf and a shelf deck 706 that is supported by legs 702 and 704. The legs 702 and 704 are substantially similar. Accordingly, only leg 702 is described in detail herein. Leg 702 includes a support structure 708 and a locking structure 710. The support structure 708 includes front and rear bars 712 and 714, a top bar 716 joined with and extending between the front and rear bars 712 and 714, and a bottom bar 718 joined with and extending between the rear bar 714 and locking structure 710. The bottom bar 718 has a first end section 718*a* that is joined to the rear bar 714 and is bent perpendicular to the remainder of the bottom bar 718, which horizontally offsets the bottom bar 718 from the top bar 716. Referring to FIG. 13B, the top bar 716 includes first and second portions 720 and 722 extending from front and rear bars 712 and 714, respectively, and a raised portion 724 joined with and extending between the first and second portions 720 and 722.

The locking structure 710 is a C-shaped clamp operable to receive an existing shelf for locking leg 702 to the shelf. The locking structure 710 includes a first horizontal section 726 joined with and extending substantially perpendicular from front bar 712, a first vertical section 728 joined with and extending substantially perpendicular from horizontal section 726 such that it is parallel with front bar 712, a horizontal U-shaped section 730 joined with and extending substantially perpendicular from vertical section 728 underneath front bar 712, and a second vertical section 732 joined with and extending substantially perpendicular from U-shaped section 730 such that it is parallel to and spaced apart from first vertical section 728. The bottom bar 718 is joined to the second vertical section 732. The sections of locking structure 710 form a slot 734 that is sized for receiving an existing shelf. The U-shaped section 730 may flex away from horizontal sections 726 and bottom bar 718 to provide clearance for sliding an existing shelf into slot 734. If the existing shelf is slightly larger than the slot 734 such that U-shaped section 730 must flex away from horizontal section 726 and bottom bar 718, the horizontal section 726 and bottom bar 718 and U-shaped section 730 will exert a clamping force on the existing shelf to assist in locking the leg 702 to the existing shelf. When an existing shelf is received by slot 734, lower surfaces of the horizontal section 726 and bottom bar 718 abut an upper surface of the existing shelf and an upper surface of the U-shaped section 730 abuts a lower surface of the existing shelf. The U-shaped section 730, second vertical section 732, and bottom bar 718 extend laterally outward to one side from the remainder of leg 702, which besides these sections is positioned in a substantially vertical plane. The laterally extending U-shaped section 730, second vertical section 732, and bottom bar 718 engage an existing shelf in a similar manner as the stabilizer bar 52, shown in FIG. 4, to substantially prevent the leg 702 from rotating about an axis aligned with first horizontal section 726.

The shelf deck 706 is a solid panel having top and bottom surfaces 736 and 738. Referring to FIG. 13B, a slot 740 is formed in bottom surface 738 adjacent a left side of the shelf deck 706. The slot 740 is sized for receiving the raised portion 724 of the top bar 716 of leg 702. There is another slot (not shown) on the opposite side of the bottom surface 738 for receiving a raised portion of the top bar of leg 704. When the shelf deck 706 is supported by the legs 702 and 704, the slot 740 receives the raised portion 724 and the slot (not shown) on the opposite side of the shelf deck 706 receives the raised portion (not shown) of leg 704 to substantially prevent the shelf deck 706 from moving forward, rearward, left, or right.

Figure 14A:
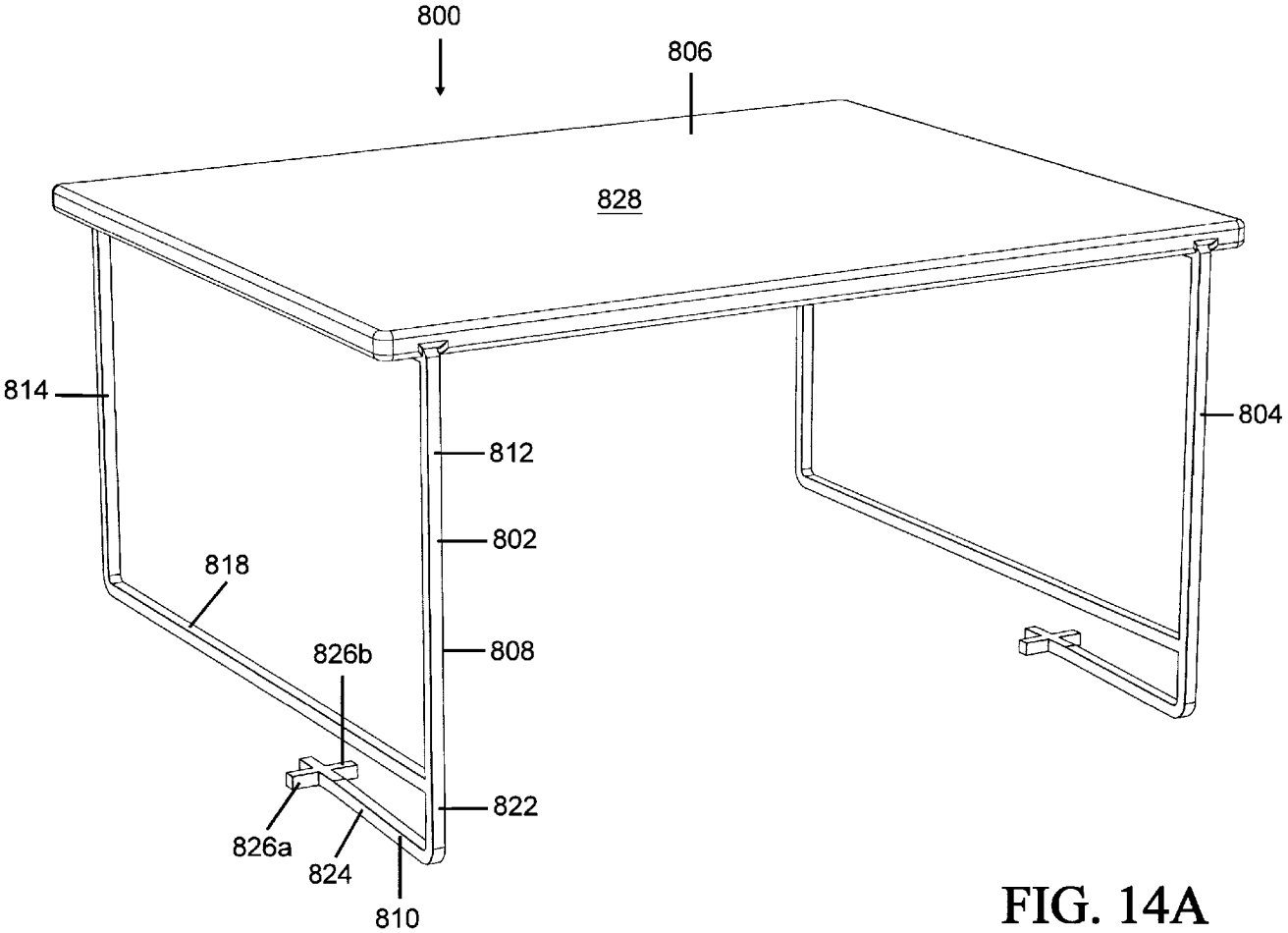
FIG. 14A is a perspective view of an eighth alternative embodiment of add-on shelf having a shelf deck with a slot that receives a portion of a leg.
Figure 14B:
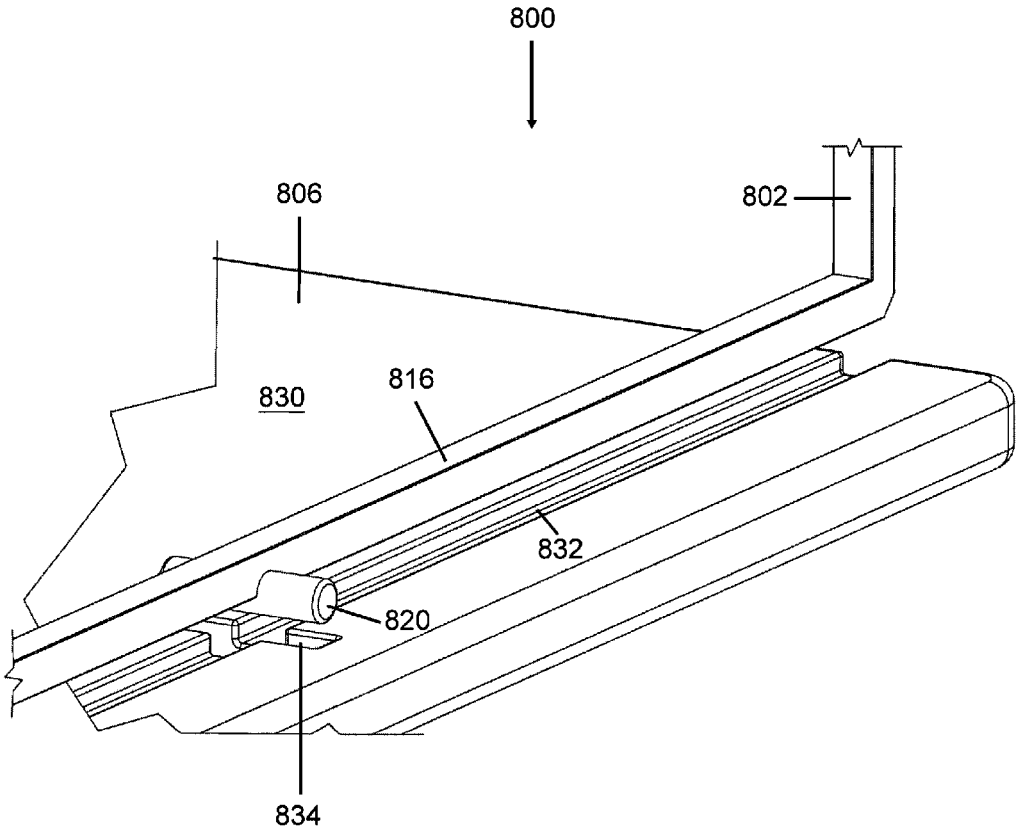
FIG. 14B is an exploded view of a portion of the shelf of FIG. 14A showing the slot in the shelf deck that receives a portion of the leg.

An eighth alternative embodiment of add-on shelf is shown in FIGS. 14A and 14B as 800. Shelf 800 includes legs 802 and 804 that are operable to lock to an existing shelf and a shelf deck 806 that is supported by legs 802 and 804. The legs 802 and 804 are substantially similar. Accordingly, only leg 802 is described in detail herein. Leg 802 includes a support structure 808 and a locking structure 810. The support structure 808 includes front and rear bars 812 and 814, a top bar 816 (shown in FIG. 14B) joined with and extending between the front and rear bars 812 and 814, and a bottom bar 818 joined with and extending between the front and rear bars 812 and 814. Referring to FIG. 14B, a cross-bar 820 is joined to and extends laterally out from either side of top bar 816.

The locking structure 810 includes a vertical section 822 that is integral with front bar 812 and extends downward from front bar 812, and a horizontal section 824 that is joined to vertical section 822 and that extends generally perpendicular from vertical section 822 underneath bottom bar 818. A pair of stabilizing cross-bars 826*a* and 826*b* are joined to and extend laterally outward from either side of horizontal section 824. Besides cross-bars 826*a* and 826*b*, the majority of leg 802 is positioned in a substantially vertical plane. The laterally extending cross-bars 826*a* and 826*b* engage a lower surface of a shelf in a similar manner as the stabilizer bar 52, shown in FIG. 4, to substantially prevent the leg 802 from rotating about an axis aligned with bottom bar 818. The locking structure 810 otherwise performs in a substantially similar manner as the locking structure 20, shown in FIG. 3, in that it flexes away from support structure 808 to receive and lock a shelf between the support structure 808 and locking structure 810.

The shelf deck 806 is a solid panel having top and bottom surfaces 828 and 830. Referring to FIG. 14B, a pair of intersecting slots 832 and 834 are formed in bottom surface 830 adjacent a left side of the shelf deck 806. Slot 832 is sized for receiving top bar 816, and slot 834 is sized for receiving cross-bar 820. There is another pair of intersecting slots (not shown) on the opposite side of the bottom surface 830 for receiving a top bar and cross-bar of leg 804. When the shelf deck 806 is supported by the legs 802 and 804, the slots 832 and 834 receive the top bar 816 and cross-bar 820 and the slots (not shown) on the opposite side of the shelf deck 806 receive the top bar and cross-bar (not shown) of leg 804 to substantially prevent the shelf deck 806 from moving forward, rearward, left, or right.

Figure 15:
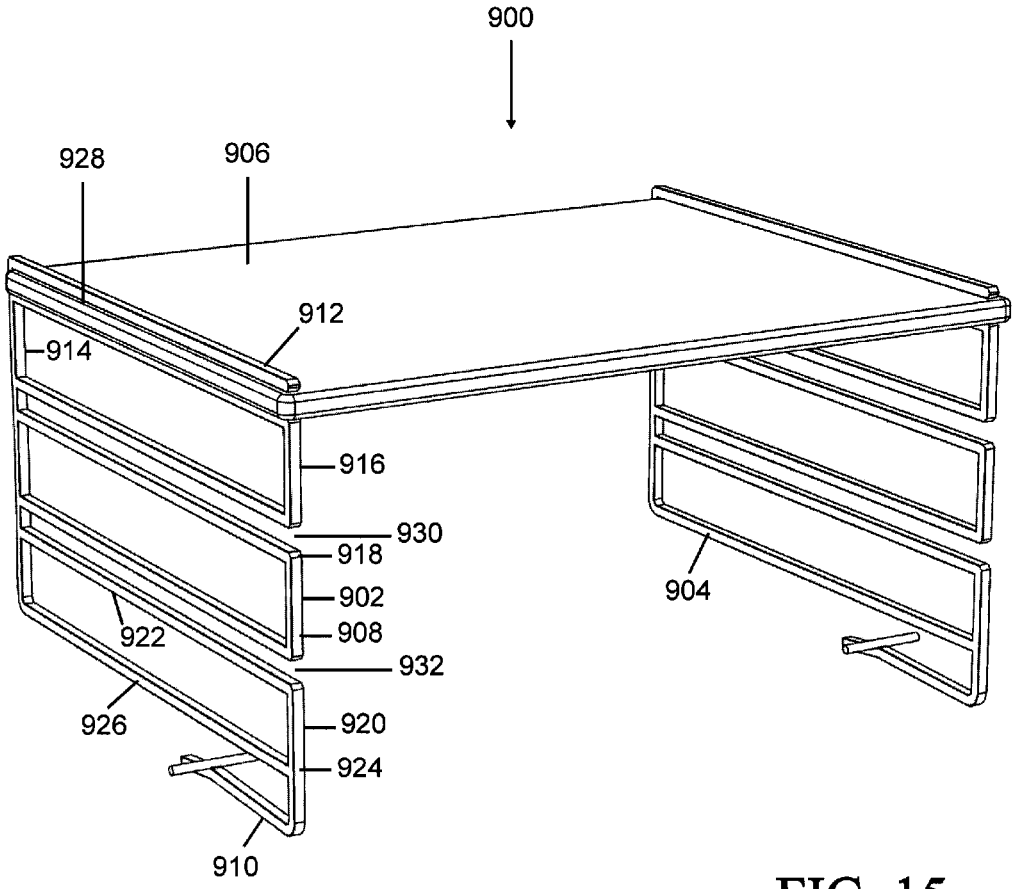
FIG. 15 is a perspective view of a ninth alternative embodiment of add-on shelf having legs that are operable to support a shelf deck in a plurality of vertical positions.

FIG. 15 shows a ninth alternative embodiment of add-on shelf 900. Shelf 900 includes legs 902 and 904 that are operable to lock to an existing shelf and a shelf deck 906 that is supported by legs 902 and 904. The legs 902 and 904 are substantially similar. Accordingly, only leg 902 is described in detail herein. Leg 902 includes a support structure 908 and a locking structure 910. The support structure 908 includes a top bar 912 joined to a rear bar 914 and three C-shaped sections 916, 918, and 920 joined with and extending outward from the rear bar 914 beneath the top bar 912. Each C-shaped section 916, 918, and 920 is substantially identical. Accordingly, only C-shaped section 920 is described in detail herein. C-shaped section 920 includes a top bar 922 joined with and extending outward from rear bar 914, a front bar 924 joined with and extending downward from top bar 922, and a bottom bar 926 joined with and extending rearward from front bar 924. The bottom bar 926 of C-shaped section 920 abuts and is supported by an existing shelf. A slot 928 is formed between top bar 912 and C-shaped section 916, a slot 930 is formed between C-shaped sections 916 and 918, and another slot 932 is formed between C-shaped sections 918 and 920. The slots 928, 930, and 932 are sized for receiving shelf deck 906. The slots 928, 930, and 932 may be slightly smaller than the thickness of shelf deck 906 and the top bar 912 and C-shaped sections 916, 918, and 920 may flex away from each other so that shelf deck 906 will fit within the slots 928, 930, and 932. If this is the case, the top bar 912 and C-shaped sections 916, 918, and 920 adjacent the shelf deck 906 exert a clamping force on the shelf deck 906. While FIG. 15 shows shelf deck 906 positioned within slot 928, the shelf deck 906 may be placed in any of the slots 928, 930, and 932 desired by the user. Further, the shelf 900 may have additional shelf decks similar to shelf deck 906 that fit within slots 930 and/or 932. The locking structure 910 of leg 902 is substantially similar to the locking structure 20 shown in FIG. 3 and described above. Accordingly, the locking structure 910 is not described in detail herein.

Figure 16:
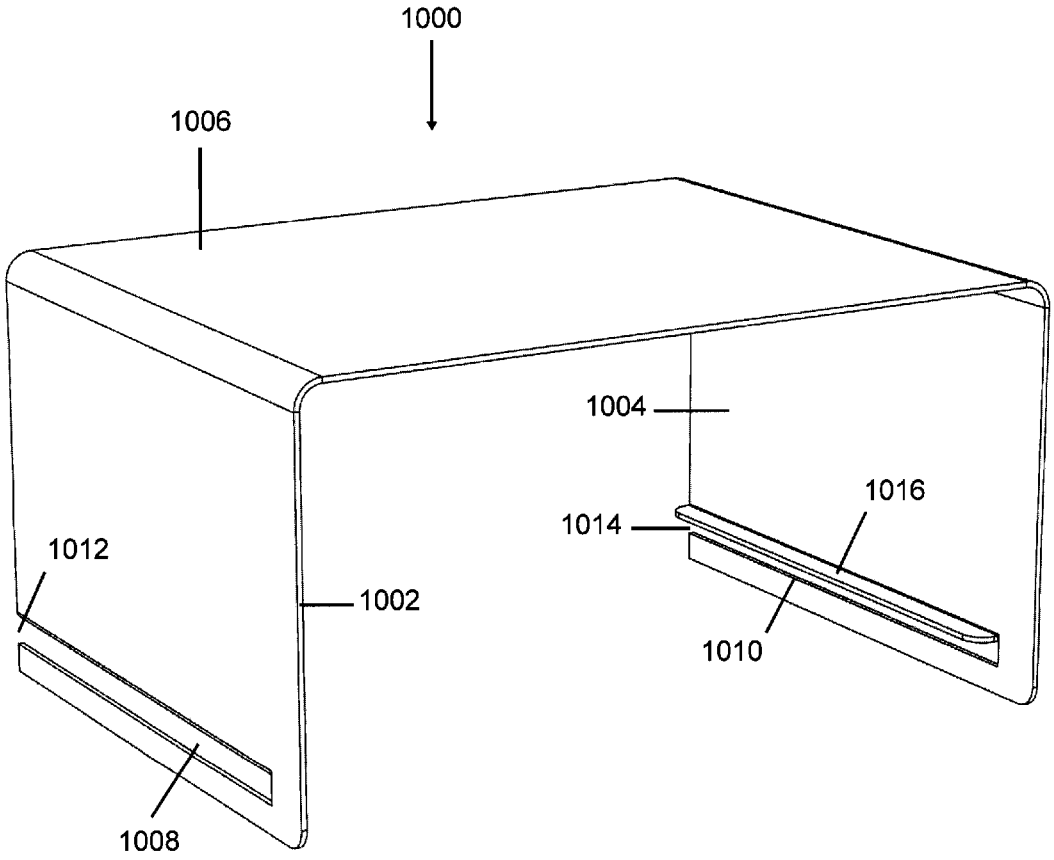
FIG. 16 is a perspective view of a tenth alternative embodiment of add-on shelf having a shelf deck that is integral with a pair of legs.

FIG. 16 shows a tenth alternative embodiment of add-on shelf 1000, which has legs 1002 and 1004 that are integral with a shelf deck 1006. The legs 1002 and 1004 each extend downward from the shelf deck 1006 and are substantially perpendicular with the shelf deck 1006. Slots 1008 and 1010 are formed in lower portions of legs 1002 and 1004, respectively. The slots 1008 and 1010 have openings 1012 and 1014, respectively, along rearward edges of the legs 1002 and 1004. An existing shelf is received by the slots 1008 and 1010 for locking the add-on shelf 1000 to the existing shelf. A horizontal stabilizer 1016 is joined with and extends outward from an inner surface of leg 1004. The stabilizer 1016 is substantially perpendicular to leg 1004 and is positioned adjacent slot 1010. A similar stabilizer (not shown) is joined to an inner surface of leg 1002. The stabilizers 1016 engage and abut an upper surface of an existing shelf received by slots 1008 and 1010 for supporting the add-on shelf in a substantially vertical position.

Figure 17:
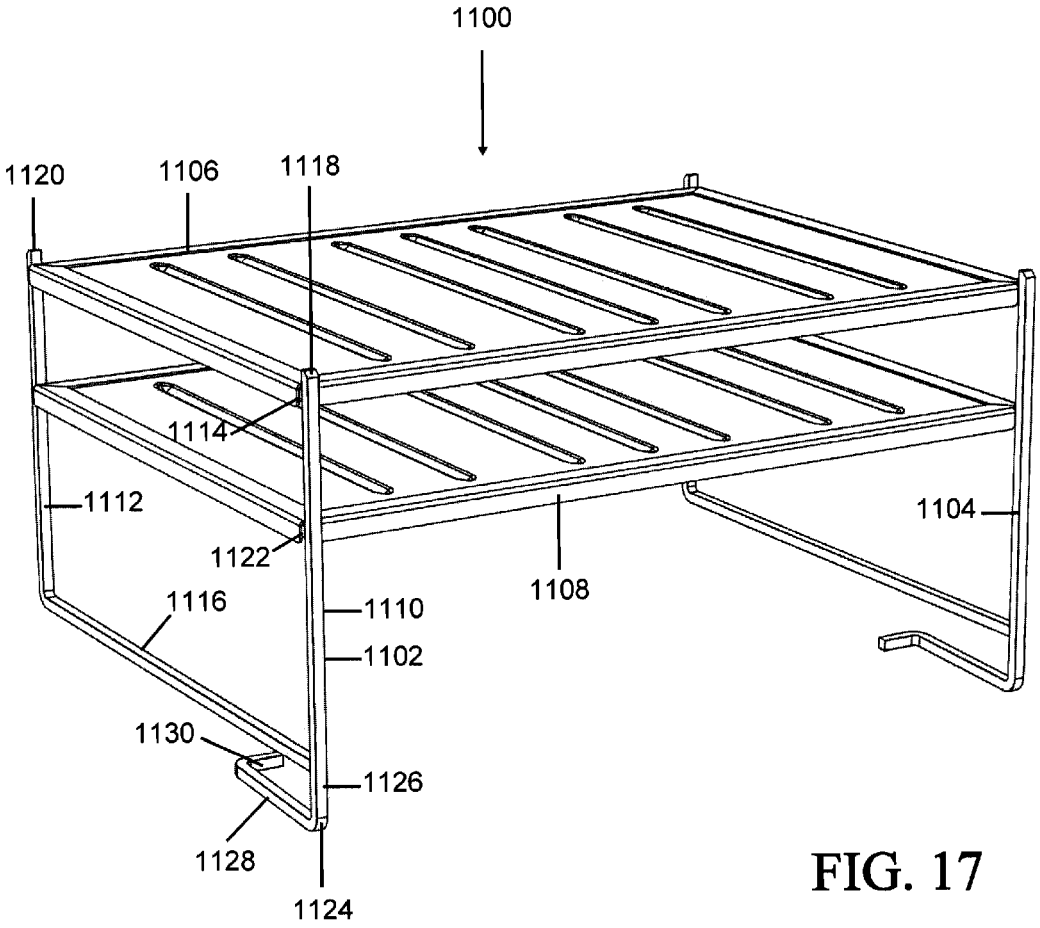
FIG. 17 is a perspective view of an eleventh alternative embodiment of add-on shelf having legs that support a pair of vertically spaced apart shelf decks.

An eleventh alternative embodiment of add-on shelf is shown in FIG. 17 as 1100. Shelf 1100 includes legs 1102 and 1104 that are operable to lock to an existing shelf and a pair of shelf decks 1106 and 1108 that are supported by the legs 1102 and 1104. The legs 1102 and 1104 are substantially similar. Accordingly, only leg 1102 is described in detail herein. Leg 1102 has a rectangular frame with front and rear bars 1110 and 1112 joined to a top bar 1114 and bottom bar 1116. Upper portions 1118 and 1120 of the front and rear bars 1110 and 1112 extend above the top bar 1114. A horizontal bar 1122 positioned below top bar 1114 is joined with and extends between front and rear bars 1110 and 1112. A locking structure 1124 of leg is integral with and extends downward from front bar 1110. The locking structure 1124 includes a vertical section 1126 integral with front bar 1110, a horizontal section 1128 extending perpendicular from vertical section 1126 beneath bottom bar 1116, and a stabilizer bar 1130 integral with and extending laterally from one side of horizontal section 1128. The laterally extending stabilizer bar 1130 engages a lower surface of a shelf in a similar manner as the stabilizer bar 52, shown in FIG. 4, to substantially prevent the leg 1102 from rotating about an axis aligned with bottom bar 1116. The locking structure 1124 otherwise performs in a substantially similar manner as the locking structure 20, shown in FIG. 3, in that it flexes away from bottom bar 1116 to receive and lock a shelf between the bottom bar 1116 and locking structure 1124.

The shelf decks 1106 and 1108 are substantially similar to the shelf deck 18 shown in FIG. 2 and described above and the shelf deck 106 shown in FIG. 7, and as such are not described in detail herein. The shelf deck 1106 is supported by the top bar 1114 of leg 1102 and the top bar of leg 1104, and the shelf deck 1108 is supported by the horizontal bar 1122 of leg 1102 and a similar horizontal bar of leg 1104 so that it is vertically spaced below shelf deck 1106. The manner in which the shelf decks 1106 and 1108 are supported by the legs 1102 and 1104 is substantially similar to the manner in which shelf deck 18, shown in FIG. 1, is supported by legs 14 and 16. It is within the scope of the invention for the legs 1102 and 1104 to be configured to have additional horizontal bars for supporting additional shelf decks.

Figure 18A:
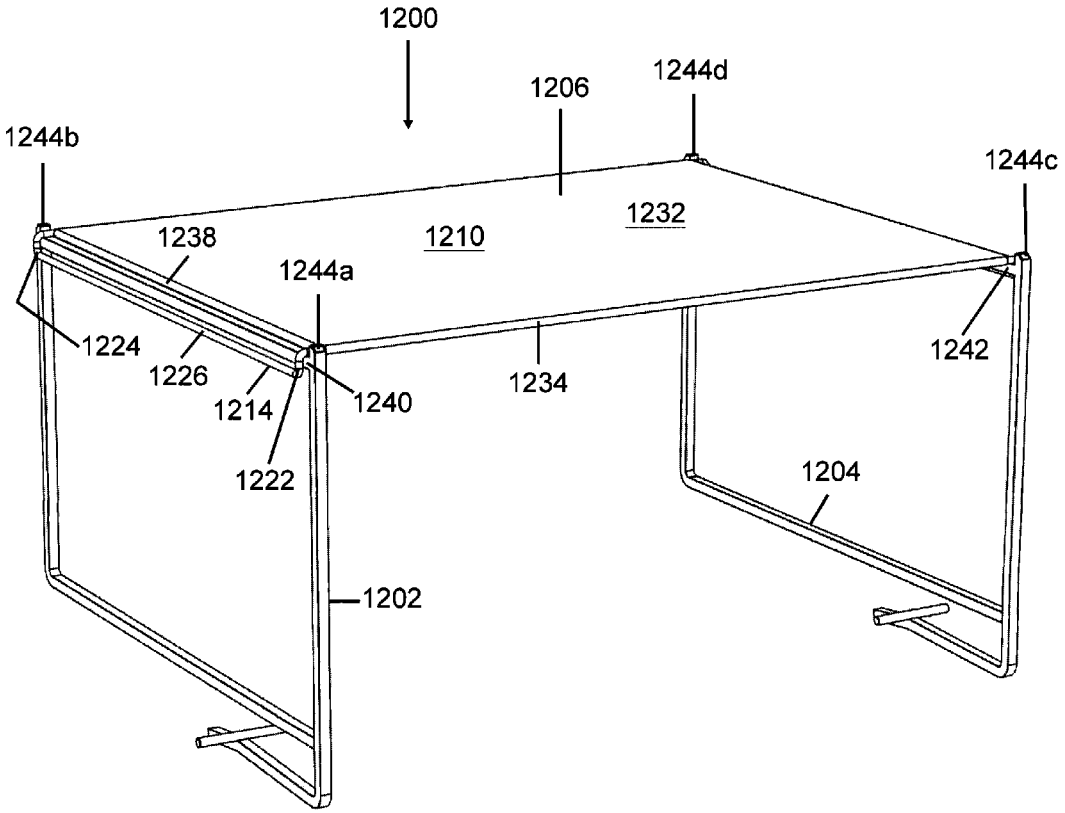
FIG. 18A is a perspective view of a twelfth alternative embodiment of add-on shelf having a shelf deck with a frame and a flexible material stretched over the frame.
Figure 18B:
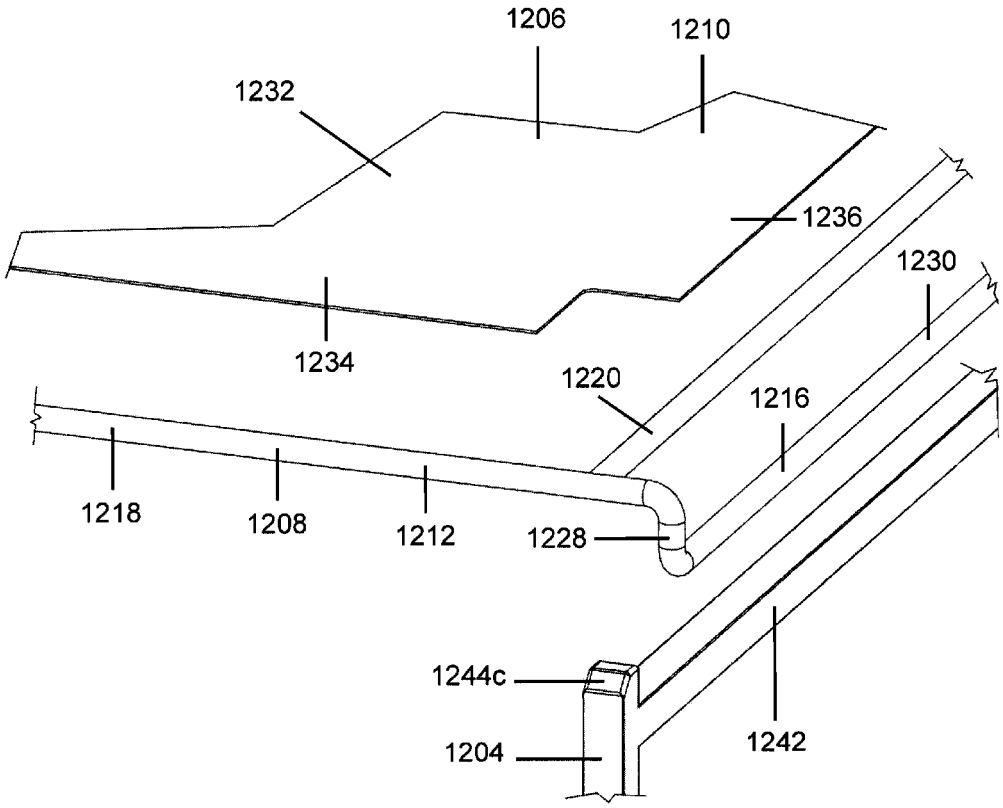
FIG. 18B is an exploded view of a portion of the shelf of FIG. 18A showing an upper portion of a leg that supports the frame.

FIGS. 18A and 18B show a twelfth alternative embodiment of add-on shelf 1200. Shelf 1200 includes legs 1202 and 1204 and a shelf deck 1206 supported by legs 1202 and 1204. Each of legs 1202 and 1204 is substantially similar to the legs 14 and 16, shown in FIG. 3 and described above. Accordingly, legs 1202 and 1204 are not described in detail herein. Referring to FIG. 18B, the shelf deck 1206 includes a wire frame 1208 and a flexible cover 1210 that forms an upper surface of the shelf deck 1206. The wire frame 1208 includes a rectangular section 1212 and left and right end sections 1214 and 1216 that are integral with and curve downward from the remainder of the frame. The rectangular section 1212 includes a front bar 1218 (FIG. 18B) and a rear bar (not shown) each joined to a left bar (not shown) and a right bar 1220 (FIG. 18B). The left end section 1214 includes front and rear vertical sections 1222 and 1224 that are integral with and extend downward from front bar 1218 and rear bar (not shown) of rectangular section 1212, respectively, and a horizontal section 1226 integral with and extending between the vertical sections 1222 and 1224. Right end section 1216 also includes a similar front vertical section 1228, rear vertical section (not shown), and horizontal section 1230.

The cover 1210 has a large generally rectangular middle section 1232, and a front section 1234, rear section (not shown), right section 1236, and left section 1238 extending outward from the middle section 1232. The front section 1234, rear section (not shown), right section 1236, and left section 1238 curl around respectively the front bar 1218, rear bar (not shown), right bar 1220, and left bar (not shown) of frame 1208 and each may be joined to itself or the middle section 1232 for securing the cover 1210 to the frame 1208 in a taut manner that enables the cover 1210 to support items placed thereon. When the shelf deck 1206 is supported by legs 1202 and 1204, the vertical sections 1222, 1224, and 1228 abut upper bars 1240 and 1242 of legs 1202 and 1204 for substantially preventing left and right movement of the shelf deck 1206. The front bar 1218 and rear bar (not shown) of the frame 1208 abut upper portions 1244*a-d* of the legs 1202 and 1204 for substantially preventing forward and rearward movement of the shelf deck 1206. The cover may be made from any material such as a woven or knit fabric or plastic sheet.

Figure 19A:
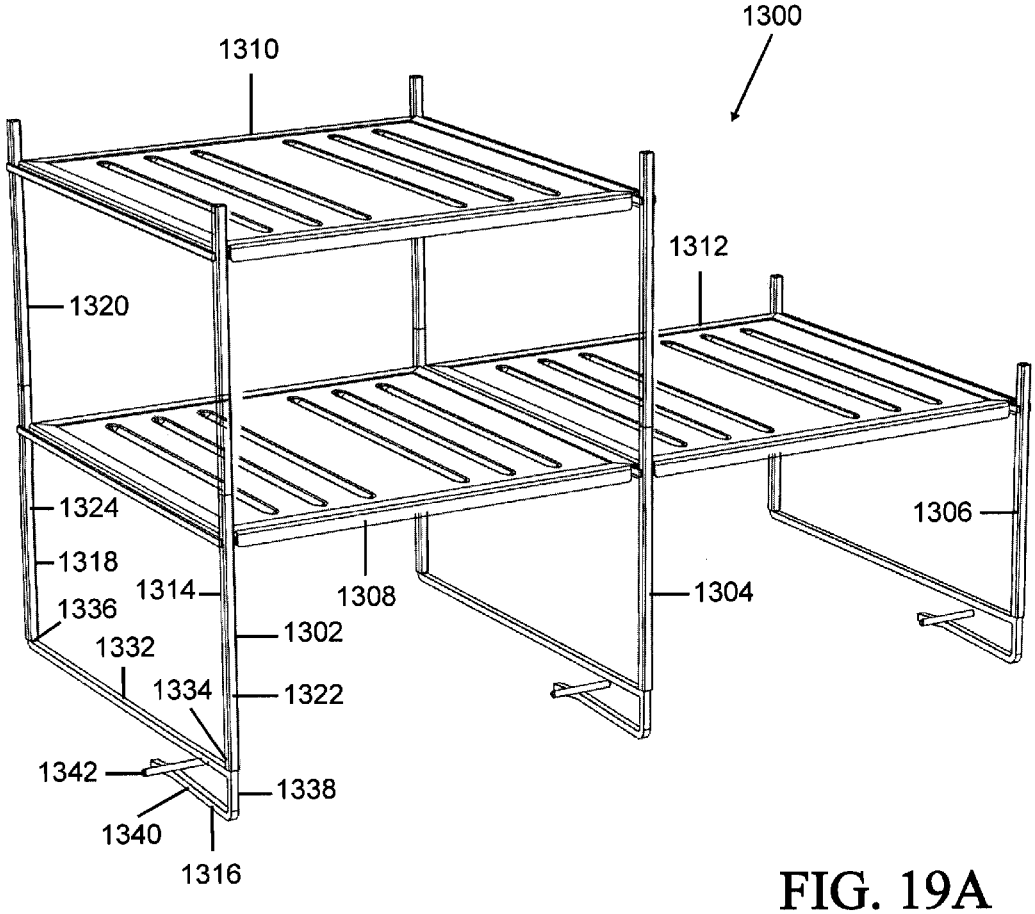
FIG. 19A is a perspective view of a thirteenth alternative embodiment of add-on shelf having a plurality of support legs and shelf decks.
Figure 19B:
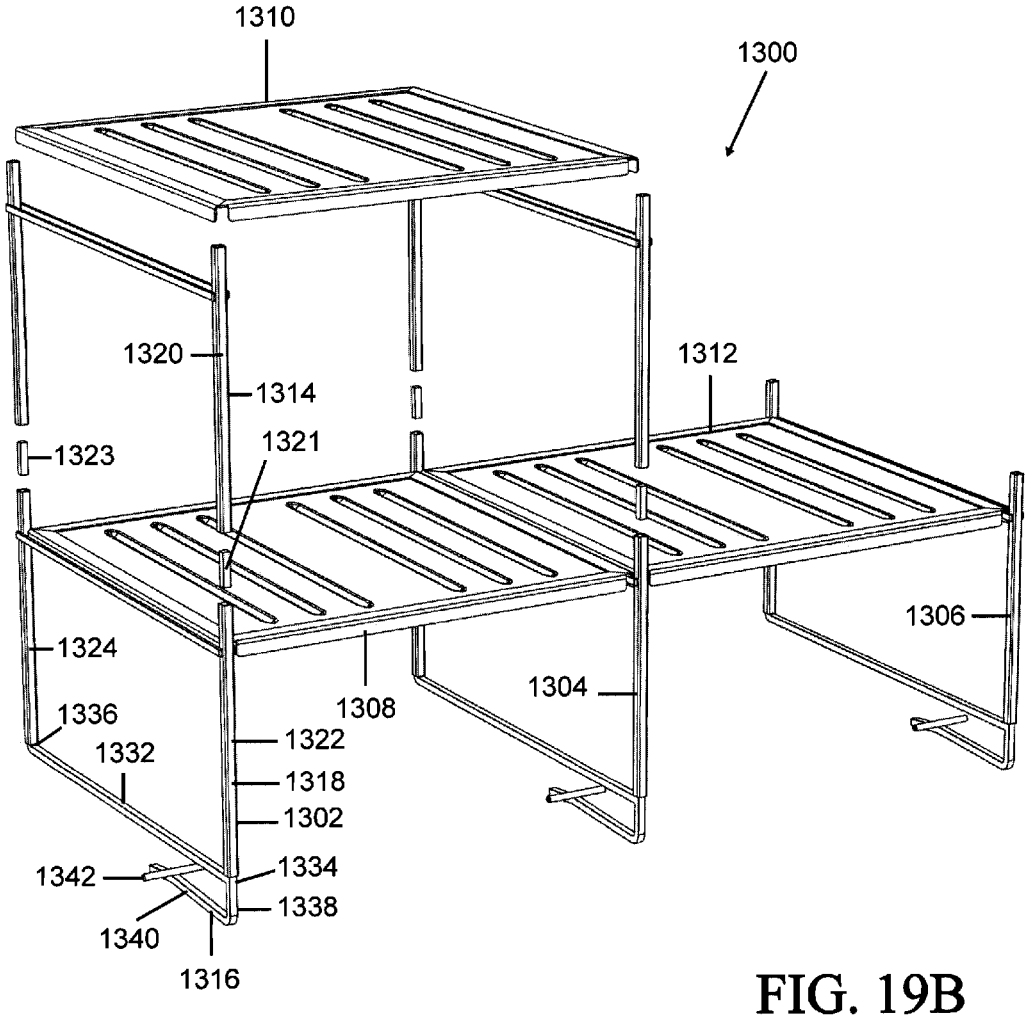
FIG. 19B is an exploded view of the shelf shown in FIG. 19A.
Figure 19C:
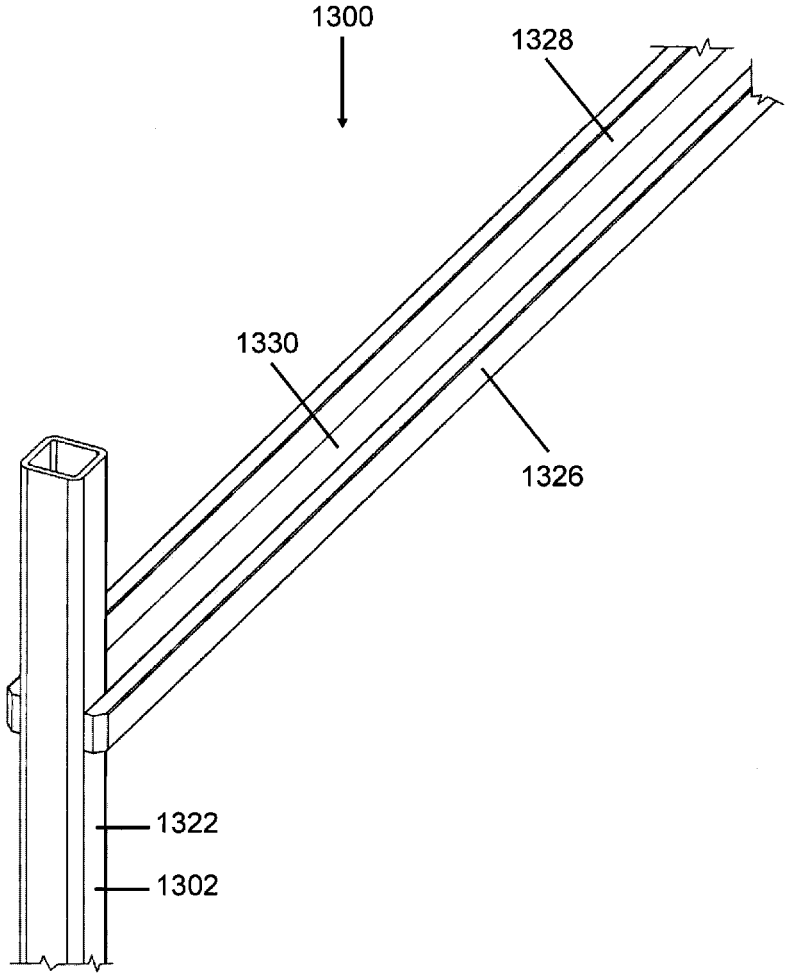
FIG. 19C is a detail view of an upper portion of a shelf leg of the shelf shown in FIG. 19A.

A thirteenth alternative embodiment of add-on shelf 1300 is shown in FIGS. 19A-19C. The shelf 1300 includes three legs 1302, 1304, and 1306 that support three shelf decks 1308, 1310, and 1312. As discussed herein, it is within the scope of the invention for the shelf 1300 to have any number of legs and shelf decks. The legs 1302, 1304, and 1306 are substantially similar except that leg 1306 does not have an upper section as described below with respect to legs 1302 and 1304. Accordingly, only leg 1302 is described in detail herein. Leg 1302 includes a support structure 1314 and a locking structure 1316. The support structure 1314 includes lower and upper sections 1318 and 1320 which are coupled with coupling sections 1321 and 1323, shown in FIG. 19B. The lower and upper sections 1318 and 1320 are substantially similar. Accordingly, only lower section 1318 is described in detail herein. The lower section 1318 includes vertical front and rear bars 1322 and 1324 joined together by a pair of spaced apart horizontal bars 1326 and 1328, shown in FIG. 19C. The horizontal bars 1326 and 1328 are joined to opposite sides of front and rear bars 1322 and 1324 to present a gap 1330 between the bars 1326 and 1328. Referring to FIG. 19C, the front bar 1322 is a hollow bar having a substantially square cross-section. Rear bar 1324 has a similar configuration.

The locking structure 1316 includes a horizontal bottom bar 1332 integral with vertical front and rear bars 1334 and 1336 extending upward from the bottom bar 1332. The vertical front and rear bars 1334 and 1336 are removably received by the hollow front and rear bars 1322 and 1324 of the lower section 1318 for supporting the lower section 1318 above the locking structure 1316. The locking structure 1316 includes a vertical section 1338 integral with and extending downward from bottom bar 1332, a horizontal section 1340 integral with and extending from vertical section 1338 beneath bottom bar 1332 and a stabilizer bar 1342 joined to horizontal section 1340, which are similar to and function in substantially the same manner as the locking structure 20 shown in FIG. 3 and described above.

Referring to FIG. 19B, the coupling sections 1321 and 1323 are removably received respectively by front and rear bars 1322 and 1324. There is an obstruction or plate within upper portions of the hollow front and rear bars 1322 and 1324 to support the coupling sections 1321 and 1323 when they are received by the bars 1322 and 1324 so that a portion of the coupling sections 1321 and 1323 extends above the bars 1322 and 1324. Optionally, each coupling section 1321 and 1323 may have a flange (not shown) that extends around the coupling section 1321 and 1323 and is supported by the top of one of front and rear bars 1322 and 1324 so that a portion of the coupling section 1321 and 1323 extends above the bars 1322 and 1324. The portion of the coupling sections 1321 and 1323 extending above the bars 1322 and 1324 is removably received by lower sections of the hollow front and rear bars of upper section 1320 for supporting the upper section 1320 above the lower section 1318. Leg 1304 has a locking structure, lower section, and upper section that support each other in a similar manner. Leg 1306 has a locking structure and a lower section that support each other in a similar manner. It is within the scope of the invention for the legs 1302, 1304, and 1306 to have additional sections such as upper section 1320 stacked on top of upper section 1320 to increase the height and storage capacity of the add-on shelf 1300. Preferably, a user can purchase any number of locking structures 1316, lower and upper sections 1318 and 1320, coupling sections 1321 and 1323 and shelf decks 1308, 1310, and 1312 to configure the add-on shelf 1300 in a desired manner.

The shelf decks 1308, 1310, and 1312 are each substantially similar to the shelf deck 18 shown in FIG. 1 and described above and the shelf deck 106 shown in FIG. 7. Accordingly, they are not described in detail herein. The shelf deck 1308 is supported by the horizontal bar 1326 (FIG. 19C) of leg 1302 and a similar horizontal bar of leg 1304. The shelf deck 1312 is supported by horizontal bars of legs 1304 and 1306 that are similar to the bars 1326 and 1328 shown in FIG. 19C. The shelf decks 1308 and 1312 can both be supported by the horizontal bars of the lower section of leg 1304 at the same height because the lower section has two horizontal bars similar to bars 1326 and 1328 with a gap 1330 between the bars. The gap 1330 between the bars 1326 and 1328 is sized so that the right side surface of shelf deck 1308 and the left side surface of shelf deck 1312 can fit within the gap so that the surfaces are adjacent or abutting. This allows the shelf decks 1308 and 1312 to present a substantially continuous shelf surface from leg 1302 to leg 1306. Shelf deck 1310 is supported by horizontal bars of upper section 1320 of leg 1302 and the upper section of leg 1304 in a similar manner.

Figure 20A:
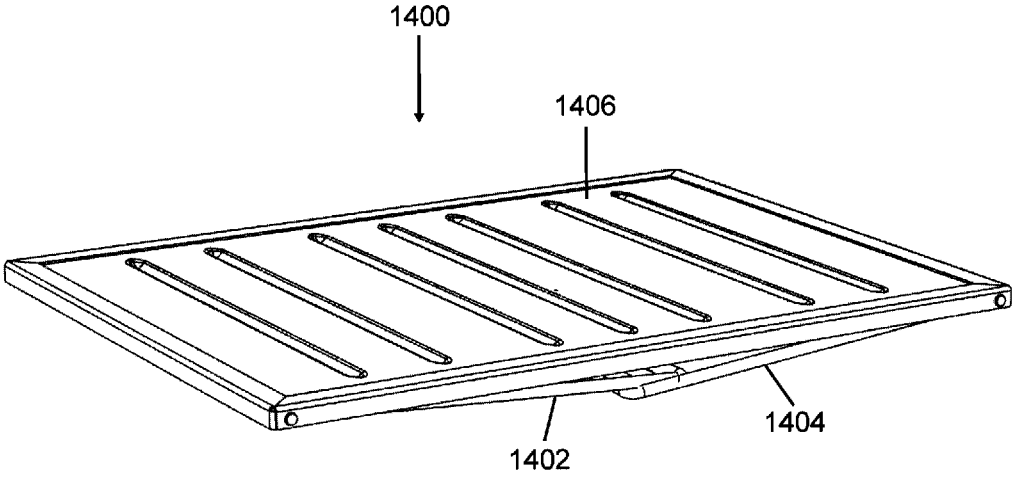
FIG. 20A is a perspective view of a fourteenth alternative embodiment of add-on shelf having legs that fold with respect to a shelf deck.
Figure 20B:
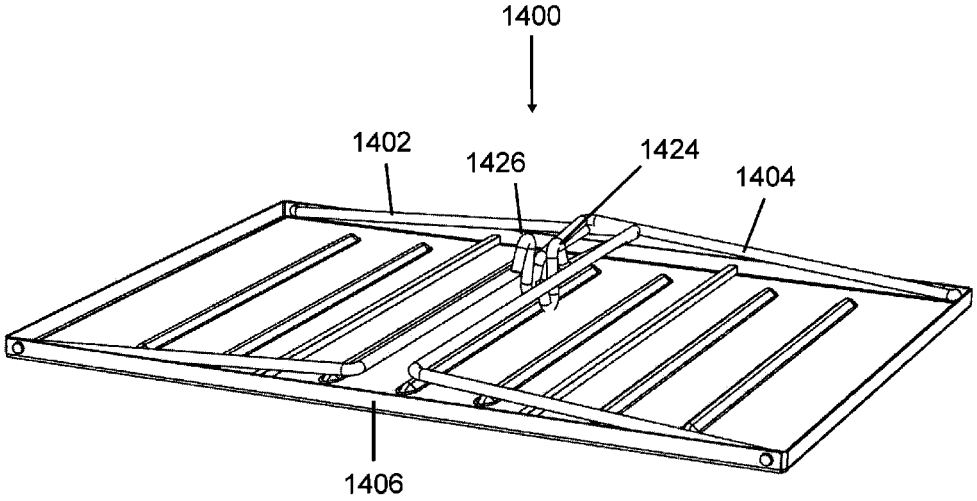
FIG. 20B is a perspective view of an underside of the shelf of FIG. 20A.
Figure 20C:
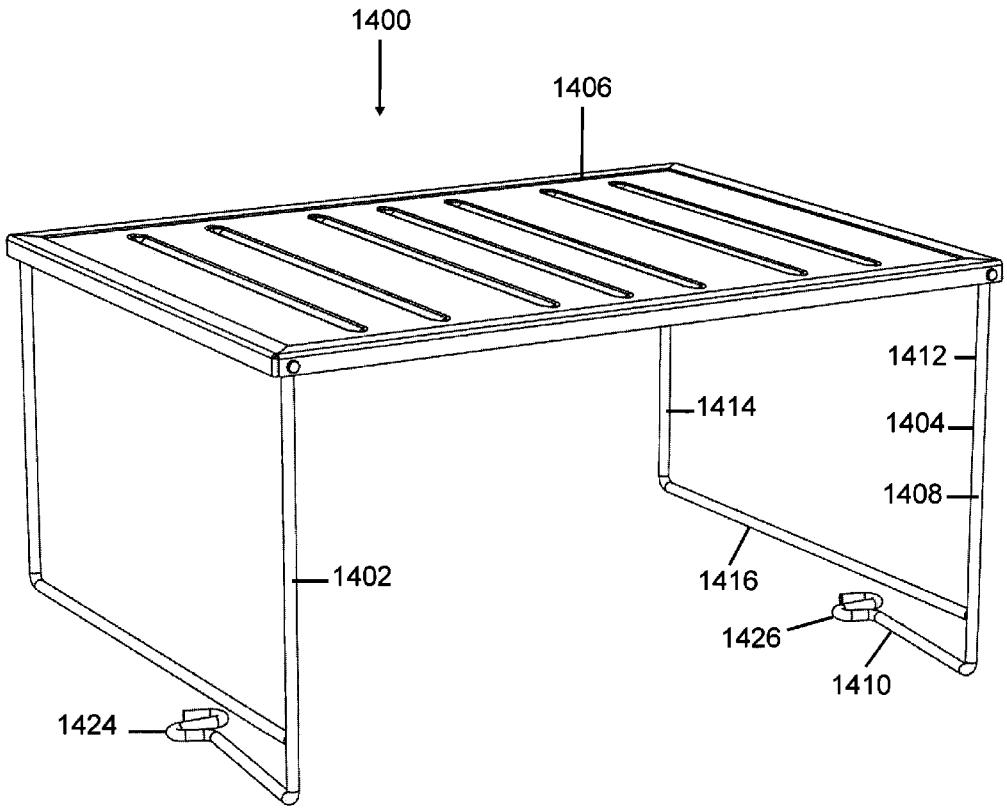
FIG. 20C is a perspective view of the shelf of FIG. 20A showing the legs unfolded.
Figure 20D:
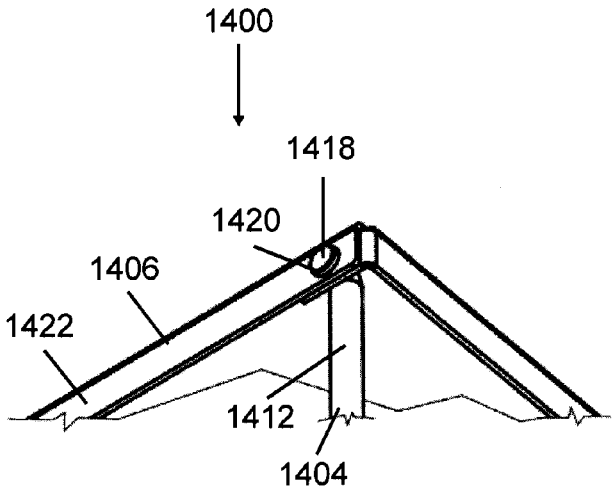
FIG. 20D is a detail view of a connection between a leg and the shelf deck of the shelf of FIG. 20A.

A fourteenth alternative embodiment of add-on shelf 1400 is shown in FIGS. 20A-20D. Shelf 1400 has legs 1402 and 1404 which are operable to fold underneath a shelf deck 1406 so that the shelf 1400 is generally planar for storage. The legs 1402 and 1404 are substantially similar. Accordingly, only leg 1404 is described in detail herein. Referring to FIG. 20C, leg 1404 includes a support structure 1408 integral with a locking structure 1410 extending downward from the support structure 1408. The locking structure 1410 is substantially similar to the locking structure 310 shown in FIG. 9A and described above. Accordingly, it is not described in detail herein. The support structure 1408 includes vertical front and rear bars 1412 and 1414 each integral with a horizontal bottom bar 1416. Referring to FIG. 20D, an upper end 1418 of front bar 1412 is bent perpendicular to the remainder of the bar 1412. The upper end 1418 is inserted into an opening 1420 in a front wall 1422 of shelf deck 1406. An upper end of rear bar 1414 is inserted into an opening (not shown) in a rear wall (not shown) of shelf deck 1406. The leg 1404 is pivotable with respect to shelf deck 1406 about the upper end 1418 of front bar 1412 and the upper end (not shown) of rear bar 1414 between the assembled, operating position shown in FIG. 20C and the folded, storage position shown in FIGS. 20A and 20B. In the storage position, the legs 1402 and 1404 are generally parallel to the shelf deck 1406. In the operating position, the legs 1402 and 1404 are generally perpendicular to the shelf deck 1406. Referring to FIG. 20B, in the folded position, S-shaped ends 1424 and 1426 of the locking structure of the legs 1402 and 1404 are positioned adjacent to the shelf deck 1406. The curvature of the S-shaped ends 1424 and 1426 protect the shelf deck 1406 by preventing a portion of the locking structure from piercing or damaging the shelf deck 1406 in the storage position. Besides the openings that receive upper portions of the legs 1402 and 1404, the shelf deck 1406 is substantially similar to the shelf deck 18 shown in FIG. 1 and described above and the shelf deck 106 shown in FIG. 7.

Figure 21:
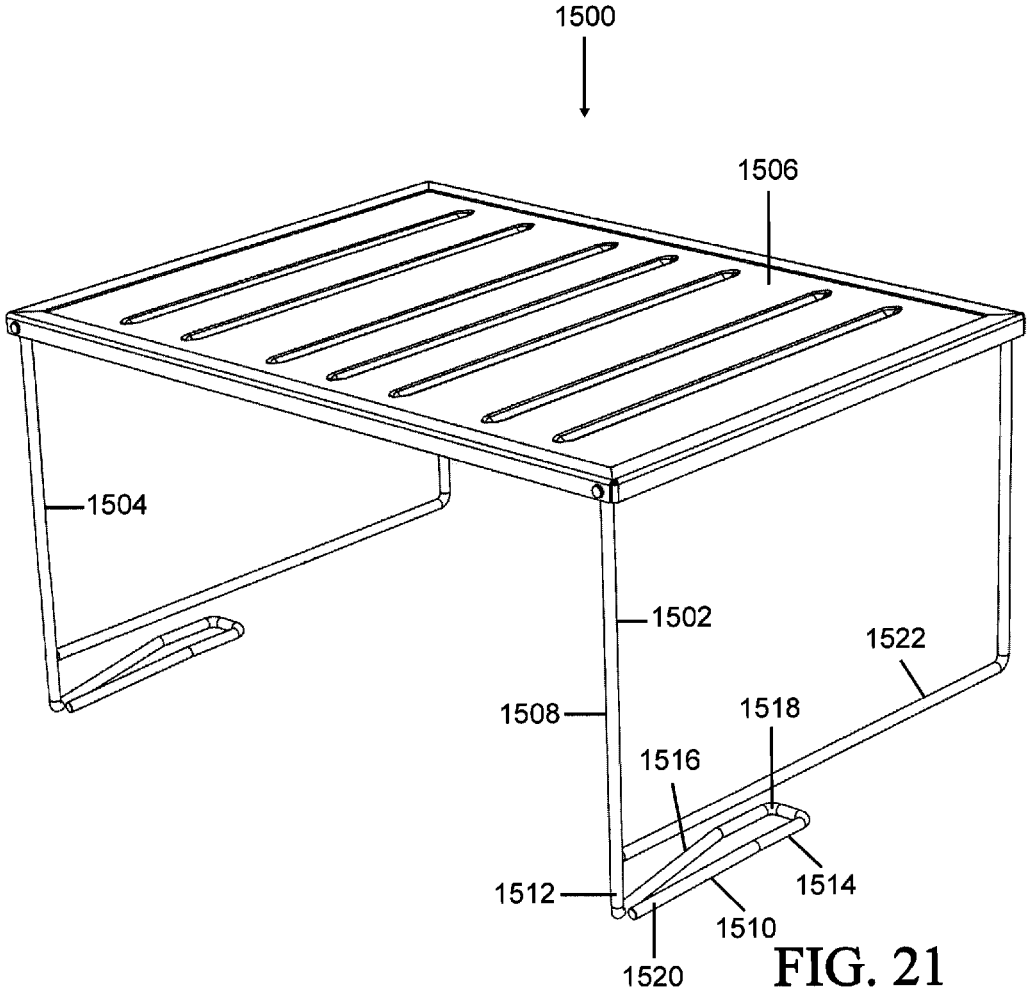
FIG. 21 is a perspective view of a fifteenth alternative embodiment of add-on shelf having legs that fold with respect to a shelf deck.

FIG. 21 shows a fifteenth alternative embodiment of add-on shelf 1500. The shelf 1500 has legs 1502 and 1504 that support a shelf deck 1506. The legs 1502 and 1504 and shelf deck 1506 are substantially similar to the legs 1402 and 1404 and shelf deck 1406 of shelf 1400 shown in FIG. 20A and described above. Accordingly, only the differences are described in detail herein. Legs 1502 and 1504 are substantially similar. Accordingly, only leg 1502 is described in detail herein. Leg 1502 has a support structure 1508 and a locking structure 1510 that is integral with and extends downward from support structure 1508. The locking structure 1510 is the only difference between leg 1502 and leg 1402 described above. Shelf deck 1506 is substantially similar to the shelf deck 1406 described above.

The locking structure 1510 includes a vertical section 1512 integral with and extending downward from support structure 1508. A horizontal loop 1514 is integral with vertical section 1512 and extends perpendicular from the vertical section 1512 beneath the support structure 1508. The loop 1514 includes a first section 1516 integral with vertical section 1512. The first section 1516 extends from the vertical section 1512 and angles slightly laterally inward below the shelf deck 1506. A U-shaped section 1518 is integral with and extends outward from the first section 1516. A straight section 1520 is integral with and extends from the U-shaped section 1518 back toward the vertical section 1512. Due to the first section 1516, the horizontal loop 1514 of the locking structure 1510 extends laterally outward from the remainder of leg 1502, which besides the locking structure 1510 is positioned in a substantially vertical plane. The laterally extending portions of locking structure 1510 engage a lower surface of a shelf in a similar manner as the stabilizer bar 52, shown in FIG. 4, to substantially prevent the leg 1502 from rotating about an axis aligned with a bottom bar 1522 of support structure 1508. The locking structure 1510 otherwise performs in a substantially similar manner as the locking structure 20, shown in FIG. 3, in that it flexes away from support structure 1508 to receive and lock a shelf between the support structure 1508 and locking structure 1510.

The design of the locking structure 1510 is advantageous because when the legs 1502 and 1504 are in a folded, storage position, similar to the position of legs 1402 and 1404 shown in FIGS. 20A and 20B, the locking structure 1510 does not have any pointed structures that would readily pierce or damage the shelf deck 1506. Additionally, the locking structure 1510 is designed so that when the legs 1502 and 1504 are in a folded, storage position, the locking structure 1510 permits the legs 1502 and 1504 to be folded so that they are substantially parallel to the shelf deck 1506.

Figure 22:
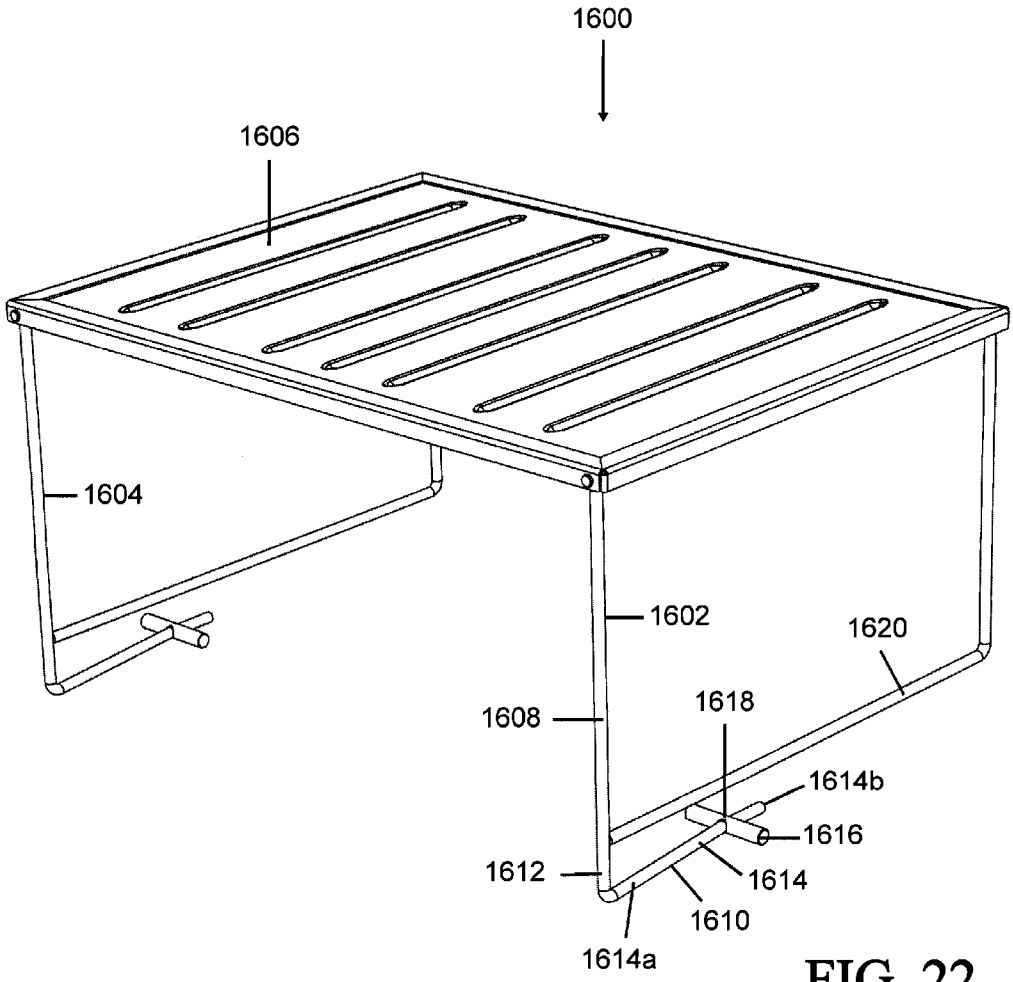
FIG. 22 is a perspective view of a sixteenth alternative embodiment of add-on shelf having legs with a locking structure that includes a removable stabilizer.

A sixteenth alternative embodiment of add-on shelf is shown in FIG. 22 as 1600. The shelf 1600 has legs 1602 and 1604 that support a shelf deck 1606. The legs 1602 and 1604 and shelf deck 1606 are substantially similar to the legs 1402 and 1404 and shelf deck 1406 of shelf 1400 shown in FIG. 20A and described above. Accordingly, only the differences are described in detail herein. Legs 1602 and 1604 are substantially similar. Accordingly, only leg 1602 is described in detail herein. Leg 1602 has a support structure 1608 and a locking structure 1610 that is integral with and extends downward from support structure 1608. The locking structure 1610 is the only difference between leg 1602 and leg 1402 described above. Shelf deck 1606 is substantially similar to the shelf deck 1406 described above.

The locking structure 1610 is a generally L-shaped clamp having a vertical section 1612 integral with and extending downward from support structure 1608, and a horizontal section 1614 integral with and extending outward from vertical section 1612 beneath support structure 1608. The horizontal section 1614 includes a first portion 1614*a* that extends at an angle upward from the vertical section 1612 toward the support structure 1608 and a second portion 1614*b* that extends at an angle downward from the first portion 1614*a* in a similar manner as the locking structure 20 shown in FIG. 3 and described above. A removable stabilizer 1616 slides on the horizontal section 1614 and preferably removably locks to the section 1614. The stabilizer 1616 has an opening 1618 that receives the horizontal section 1614. The stabilizer 1616 extends laterally outward from either side of the remainder of leg 1602, which besides stabilizer 1616 is positioned in a substantially vertical plane. The laterally extending stabilizer 1616 engages a lower surface of a shelf in a similar manner as the stabilizer bar 52, shown in FIG. 4, to substantially prevent the leg 1602 from rotating about an axis aligned with a bottom bar 1620 of support structure 1608. The locking structure 1610 otherwise performs in a substantially similar manner as the locking structure 20, shown in FIG. 3, in that it flexes away from support structure 1608 to receive and lock a shelf between the support structure 1608 and locking structure 1610.

The removable stabilizer 1616 is advantageous because it can be removed before the legs 1602 and 1604 are folded to a storage position similar to the position of legs 1402 and 1404 shown in FIGS. 20A and 20B. When the stabilizer 1616 of each leg 1602 and 1604 is removed, the legs 1602 and 1604 will fold so that they are substantially parallel to the shelf deck 1606 and no portion of the legs 1602 and 1604 will extend upward into the shelf deck 1606. Thus, the legs 1602 and 1604 will not pierce or damage the shelf deck 1606 when the stabilizer 1616 is removed and the legs 1602 and 1604 are folded into their storage position.

Figure 23A:
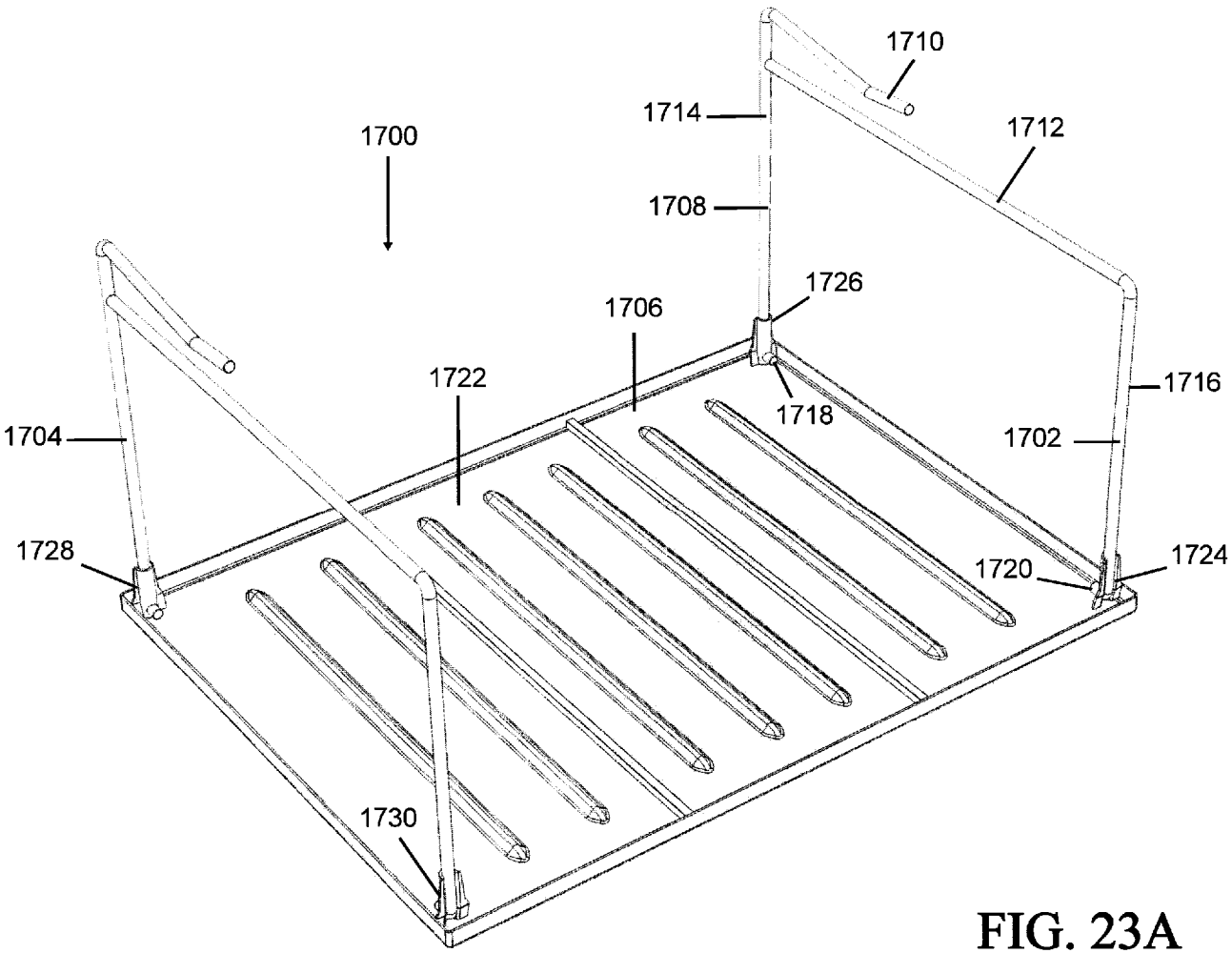
FIG. 23A is a perspective view of a seventeenth alternative embodiment of add-on shelf having legs that fold with respect to a shelf deck.
Figure 23B:
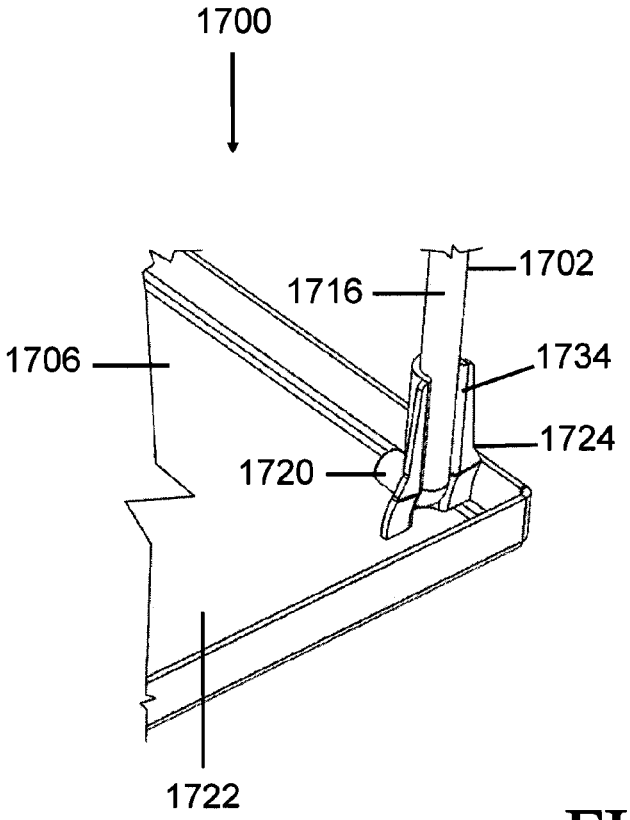
FIG. 23B is a detail view of a portion of the shelf of FIG. 23A showing a leg locked in an unfolded position.
Figure 23C:
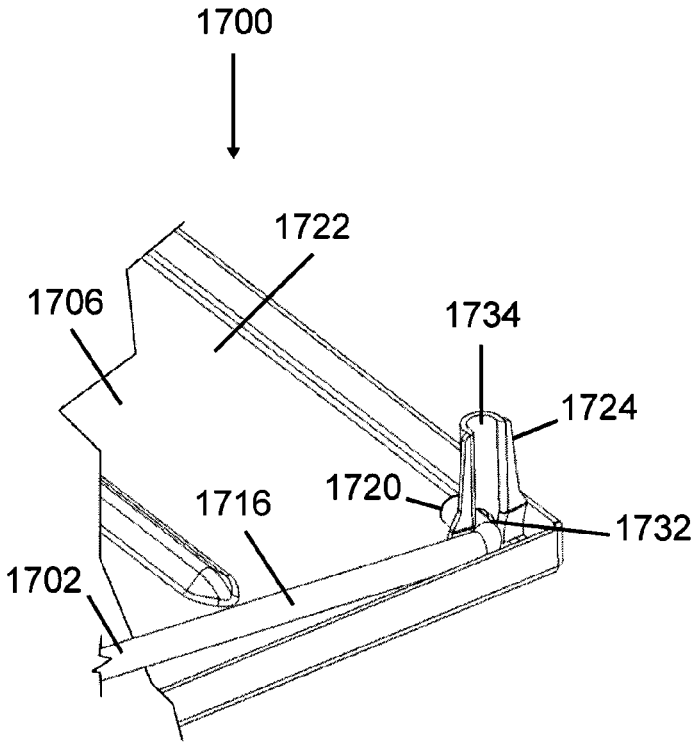
FIG. 23C is a detail view of a portion of the shelf of FIG. 23A showing a leg unlocked and in a folded position.

FIGS. 23A-C show a seventeenth alternative embodiment of add-on shelf 1700. Shelf 1700 includes legs 1702 and 1704 that support a shelf deck 1706 and that are operable to rotate with respect to the shelf deck 1706 between the operating position shown in FIGS. 23A and 23B and the storage position shown in FIG. 23C. The legs 1702 and 1704 are substantially similar. Accordingly, only leg 1702 is described in detail herein. Leg 1702 includes a support structure 1708 and a locking structure 1710 integral with and extending downward from the support structure 1708. The locking structure 1710 is substantially similar to the locking structure 1610 shown in FIG. 22 and described above except that locking structure 1710 does not have a removable stabilizer 1616 as does locking structure 1610. Due to the similarities between locking structures 1610 and 1710, locking structure 1710 is not described in detail herein. Support structure 1708 includes a horizontal bottom bar 1712 and vertical front and rear bars 1714 and 1716 each integral with bottom bar 1712 and extending upward from an end of bottom bar 1712. Upper ends 1718 and 1720 of the front and rear bars 1714 and 1716, respectively, are bent generally perpendicular to the remainder of the bars 1714 and 1716.

Shelf deck 1706 is substantially similar to the shelf deck 1406 shown in FIG. 20A and described above except for the manner in which the legs 1702 and 1704 are pivotably attached to the shelf deck 1706. Accordingly, only that difference in shelf deck 1706 is described in detail herein. The shelf deck 1706 has a lower surface 1722 and leg locks 1724, 1726, 1728, and 1730 each joined to a corner of the lower surface 1722 and extending downward from the lower surface 1722. The leg locks 1724, 1726, 1728, and 1730 are substantially similar. Accordingly, only leg lock 1724 is described in detail herein with reference to FIGS. 23B and 23C. The leg lock 1724 includes an opening 1732 (FIG. 23C) that receives the upper end 1720 of rear bar 1716 to pivotably couple leg 1702 to the leg lock 1724 and shelf deck 1706. The leg lock 1724 also includes a slot 1734 that is sized for removably receiving an upper portion of rear bar 1716 as shown in FIG. 23B. The slot 1734 is preferably sized so that it is slightly smaller than the rear bar 1716 so that the rear bar 1716 snaps into the slot 1734 and is frictionally engaged by the slot 1734 when in the position shown in FIG. 23B. When the leg 1702 is in the operating position shown in FIGS. 23A and 23B, the rear bar 1716 frictionally engages the slot 1734 to removably lock the leg 1702 to the shelf deck 1706. The leg 1702 can be moved from the operating position shown in FIG. 23B to the storage position shown in FIG. 23C by flexing the leg 1702 away from the leg lock 1724 until the rear bar 1716 snaps out of the slot 1734. The front bar 1714 is operable to removably engage leg lock 1726 in a similar manner, and the front and rear bars of leg 1704 are operable to removably engage leg locks 1728 and 1730, respectively, in a similar manner.

When the legs 1702 and 1704 removably engage the leg locks 1724, 1726, 1728, and 1730, as shown in FIG. 23A, the legs 1702 and 1704 are removably fixed to the shelf deck 1706 to substantially prevent the legs 1702 and 1704 from moving with respect to the shelf deck 1706. Thus, the leg locks 1724, 1726, 1728, and 1730 stabilize the legs 1702 and 1704 with respect to the shelf deck 1706 so that the shelf 1700 is substantially stable when in its operating position and the shelf deck 1706 can support items placed thereon by a user.

An eighteenth alternative embodiment of add-on shelf 1800 is shown in FIGS. 24A-24F. The shelf 1800 is a width adjustable storage apparatus including a pair of legs, or supports, 1802 and 1804 that support a two part, expandable width shelf deck 1806. The shelf deck 1806 includes a first section 1806*a* that is integral with and extends generally perpendicular from leg 1802 and a second section 1806*b* that is integral with and extends generally perpendicular from leg 1804.

Figure 24A:
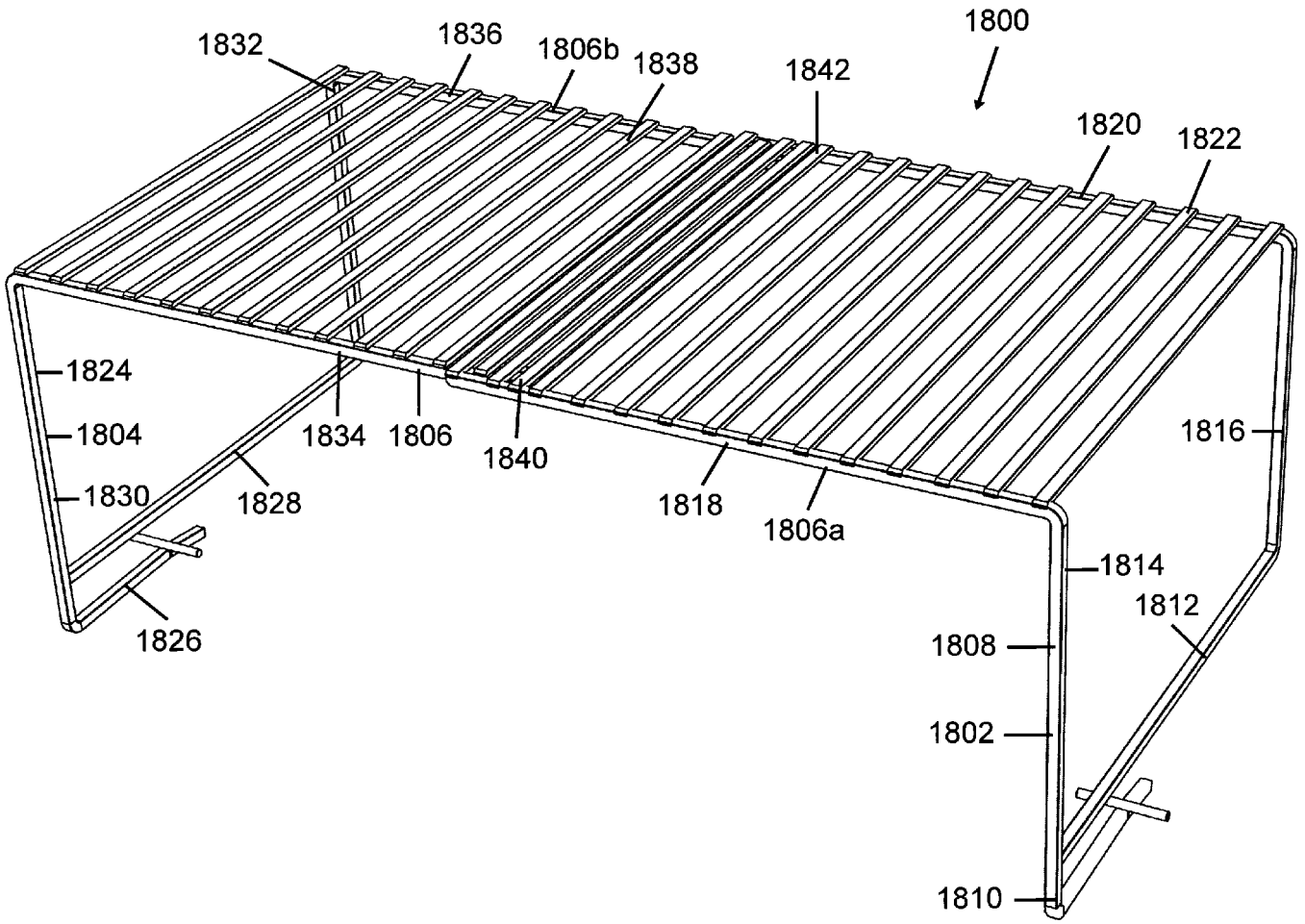
FIG. 24A is a perspective view of an eighteenth alternative embodiment of add-on shelf having a shelf deck with an expandable width.
Figure 24B:
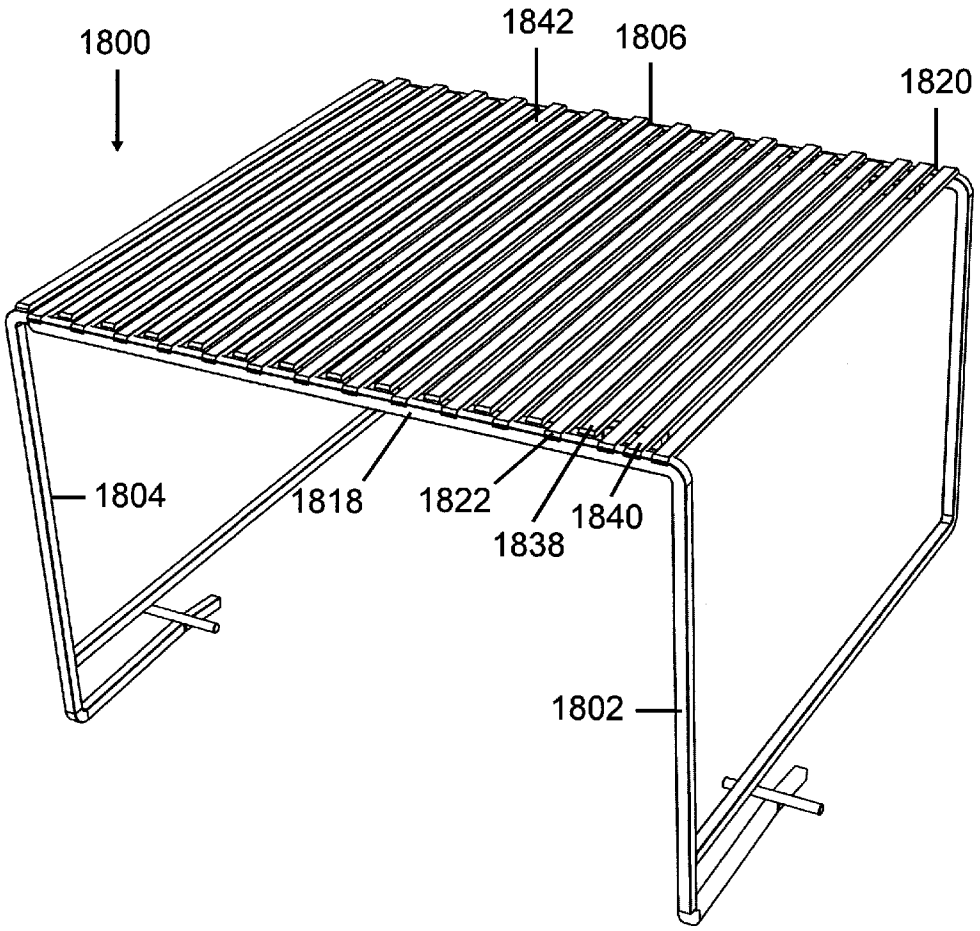
FIG. 24B is a perspective view of the shelf of FIG. 24A showing the shelf deck with a reduced width.

Referring to FIG. 24A, leg 1802 includes a support structure 1808 and a locking structure 1810 integral with and extending downward from support structure 1808. The locking structure 1810 is substantially similar to the locking structure 20, shown in FIG. 3 and described above. Accordingly, locking structure 1810 is not described in detail herein. The support structure 1808 includes a horizontal bottom bar 1812 and a pair of vertical front and rear bars 1814 and 1816 each joined to an end of the bottom bar 1812 and extending upward in a generally perpendicular manner from the bottom bar 1812. The first section 1806*a* of shelf deck 1806 includes front and rear, generally parallel frame bars 1818 and 1820 that are integral with and extend generally perpendicular from the front and rear bars 1814 and 1816, respectively. Referring to FIG. 24F, the frame bars 1818 and 1820 are spaced apart a distance A. A plurality of support bars, one of which is shown as 1822, spaced equidistant from each other are joined with and extend between the frame bars 1818 and 1820 such that they are generally perpendicular to the frame bars 1818 and 1820.

Leg 1804 includes a support structure 1824 and a locking structure 1826 integral with and extending downward from support structure 1824. The locking structure 1826 is substantially similar to the locking structure 20, shown in FIG. 3 and described above. Accordingly, locking structure 1826 is not described in detail herein. The support structure 1824 includes a horizontal bottom bar 1828 and a pair of vertical front and rear bars 1830 and 1832 each joined to an end of the bottom bar 1828 and extending upward in a generally perpendicular manner from the bottom bar 1828. The second section 1806*b* of shelf deck 1806 includes front and rear, generally parallel frame bars 1834 and 1836 that are integral with and extend generally perpendicular from the front and rear bars 1830 and 1832, respectively. Referring to FIG. 24E, the frame bars 1834 and 1836 have first ends 1834*a* and 1836*a*, respectively, and second ends 1834*b* and 1836*b*. Each of the frame bars 1834 and 1836 is formed with a curved portion 1834*c* and 1836*c* adjacent second ends 1834*b* and 1836*b* so that the second ends 1834*b* and 1836*b* are horizontally offset a distance B from the remainder of the frame bars 1834 and 1836 such that the distance between first ends 1834*a* and 1836*a* is greater than the distance between second ends 1834*b* and 1836*b*. A plurality of support bars, one of which is shown as 1838, spaced equidistant from each other are joined with and extend between the frame bars 1834 and 1836 such that they are generally perpendicular to the frame bars 1834 and 1836. Referring to FIG. 24E, each of the support bars 1838 has a length C that is less than the distance A between frame bars 1818 and 1820. An interlocking bar 1840 is joined to and extends between the second ends 1834*b* and 1836*b*. The interlocking bar 1840 has a length D that is greater than the distance A between frame bars 1818 and 1820.

Because the length D of the interlocking bar 1840 is greater than the distance A between frame bars 1818 and 1820, the interlocking bar 1840 is operable to be supported by the frame bars 1818 and 1820 in a plurality of adjustable positions between adjacent support bars 1822 for altering the width of the shelf 1800. Additionally, because the gap between adjacent support bars 1822 is slightly larger than the width of interlocking bar 1840, the width of the shelf 1800 is adjustable in small increments even when the interlocking bar 1840 is supported by frame bars 1818 and 1820 between an adjacent pair of support bars 1822. FIGS. 24A and 24B show the interlocking bar 1840 supported by the frame bars 1818 and 1820 between different pairs of adjacent support bars 1822. FIG. 24A shows the shelf 1800 in an expanded position in which it has a relatively large width, and FIG. 24B shows the shelf 1800 in a position with a relatively small width. The shelf 1800 is also width adjustable between the positions shown in FIGS. 24A and 24B by positioning the interlocking bar 1840 so that it is between different adjacent pairs of support bars 1822. The support bars 1838 have a length C that is less than the distance A between frame bars 1818 and 1820 so that the support bars 1838 are operable to fit between the frame bars 1818 and 1820 when the interlocking bar 1840 is supported by the frame bars 1818 and 1820, as shown in FIGS. 24A and 24B. When the interlocking bar 1840 is supported by the frame bars 1818 and 1820, the support bars 1822 of section 1806*a* that are positioned between the interlocking bar 1840 and support 1804 are supported by the frame bars 1834 and 1836. When frame bars 1818 and 1820 support interlocking bar 1840 and frame bars 1834 and 1836 support one or more of support bars 1822, the shelf deck sections 1806*a* and 1806*b* support each other in a generally horizontal position and combine to form a horizontal shelf surface 1842.

Figure 24C:
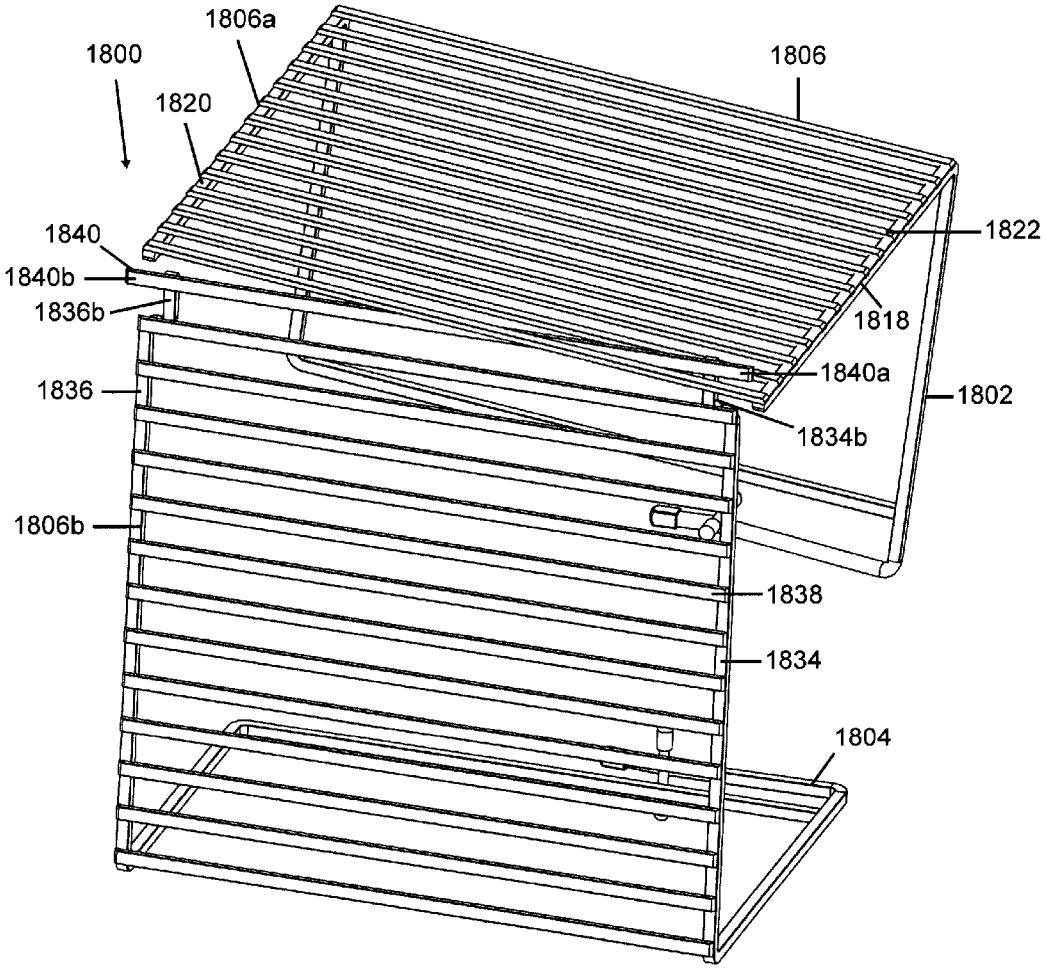
FIGS. 24C and 24D show intermediate stages of assembling the shelf deck of FIG. 24A.
Figure 24D:
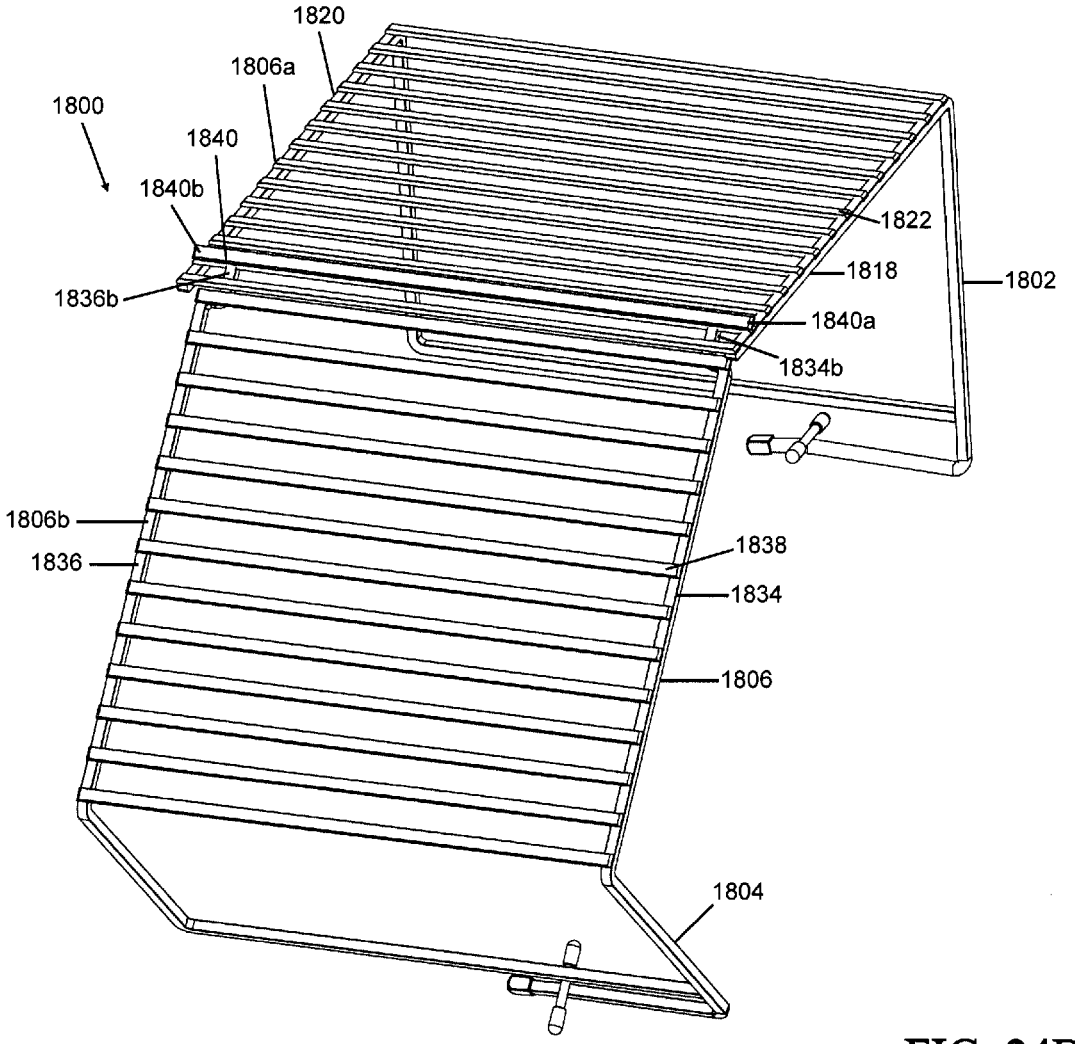
Figure 24E:
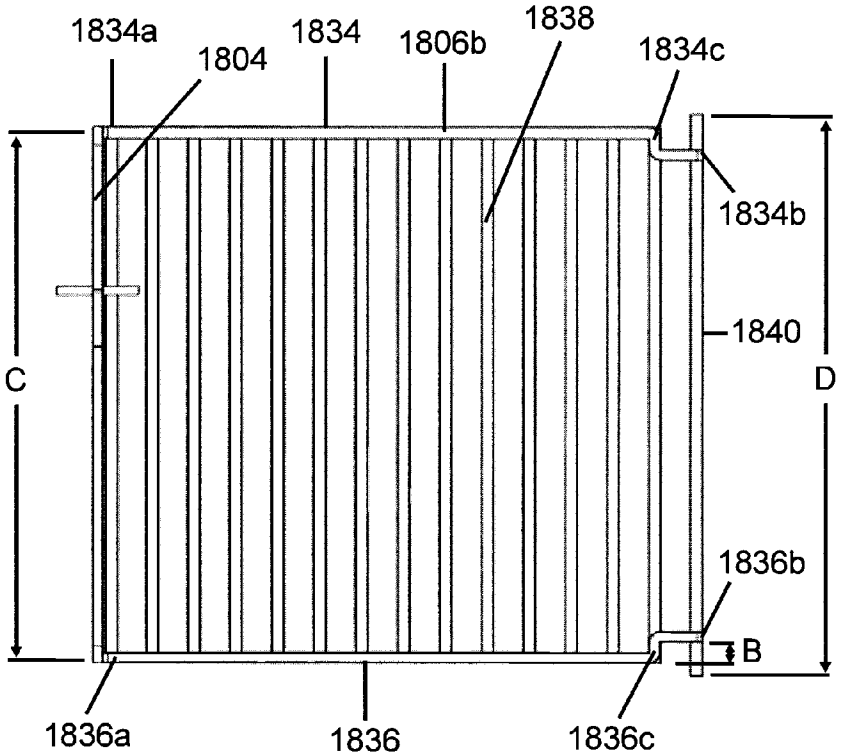
FIGS. 24E and 24F are bottom plan views, respectively, of first and second sections of the shelf of FIG. 24A.
Figure 24F:
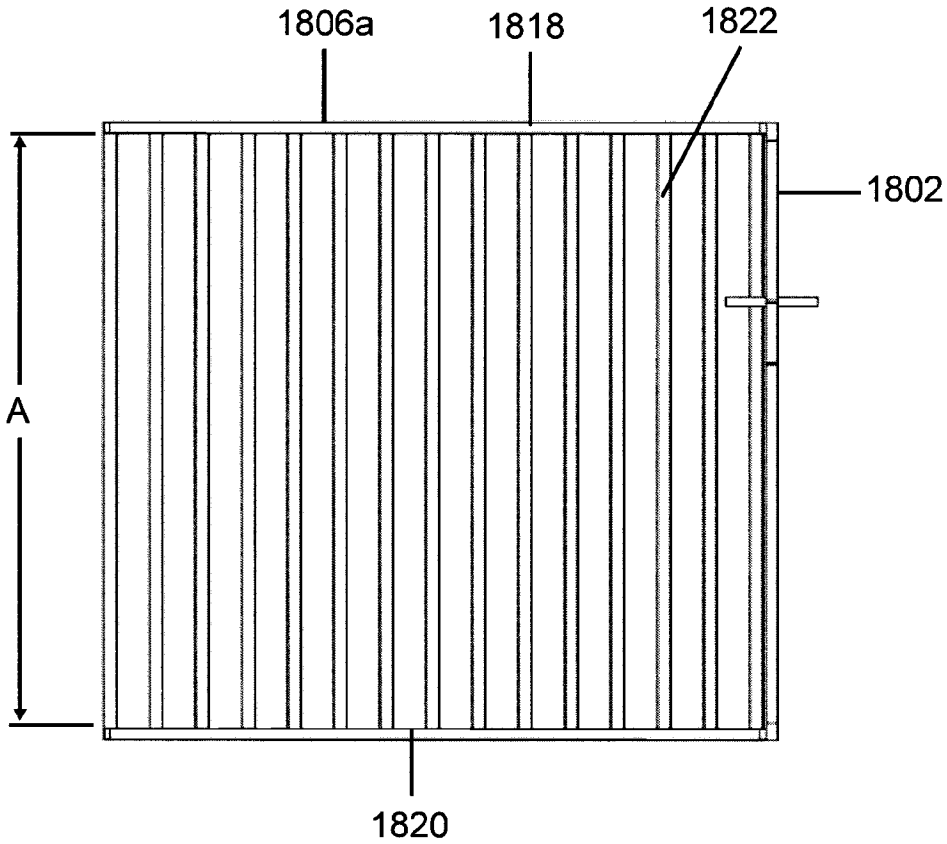

FIGS. 24C and 24D show steps in the process of positioning the interlocking bar 1840 so that it is supported by frame bars 1818 and 1820 between adjacent support bars 1822. The interlocking bar 1840 is first positioned below the support bars 1822. Then, as shown in FIG. 24C, one end 1840*a* of the interlocking bar 1840 is moved upward until it passes through the gap between adjacent support bars 1822 and is positioned above the frame bars 1818 and 1820. The interlocking bar 1840 is then moved horizontally until the end 1840*a* is positioned over the frame bar 1818 and the second end 1834*b* of frame bar 1834 is adjacent frame bar 1818. Moving the interlocking bar 1840 in this manner creates clearance for the opposite end 1840*b* of the interlocking bar 1840 so that it may also be inserted through the gap between the adjacent support bars 1822. The end 1840*b* of the interlocking bar 1840 is then moved upward through the gap between the adjacent support bars 1822. Next, the interlocking bar 1840 is moved horizontally toward frame bar 1820 until the end 1840*b* is positioned over the frame bar 1820 and the end 1840*a* is positioned over the frame bar 1818, as shown in FIG. 24D. Once in this position, the leg 1804 and shelf deck section 1806*b* are pivoted upward with respect to the leg 1802 and shelf deck section 1806*a* until the shelf deck sections 1806*a* and 1806*b* are substantially parallel as shown in FIG. 24A. In this position, the interlocking bar 1840 is supported by each of the frame bars 1818 and 1820 so that the two sections 1806*a* and 1806*b* of the shelf deck 1806 engage each other and combine to form the stable horizontal shelf surface 1842 positioned in a generally horizontal plane that is operable to support items placed thereon. The distance B (FIG. 24E) is greater than half of the difference between the length D of the interlocking bar 1840 and the distance A (FIG. 24F) between the frame bars 1818 and 1820 in order to create the necessary clearance for positioning both of the ends 1840*a* and 1840*b* of the interlocking bar 1840 through a gap between adjacent support bars 1822 in accordance with the steps described above.

In each of the width adjustable positions of the shelf deck sections 1806*a* and 1806*b*, the sections 1806*a* and 1806*b* engage each other and combine to present a shelf surface 1842 positioned in a generally horizontal plane. The shelf deck sections 1806*a* and 1806*b* do not generally extend above that generally horizontal plane when they engage each other in order to present a relatively flat, planar surface that does not contain obstructions extending above the horizontal plane. Further, as shown in FIGS. 24A and 24B, when the shelf deck sections 1806*a* and 1806*b* engage each other, there is a void space that is positioned between legs 1802 and 1804, the shelf surface 1842 created by the shelf deck sections 1806*a* and 1806*b*, and whatever existing structure, such as an existing shelf, to which the locking structures 1810 and 1826 are clamped. That space is void so that items may be placed on a surface, such as an existing shelf, beneath the shelf surface 1842 without obstruction.

In an alternative embodiment, the legs 1802 and 1804 of the shelf may be pivotably joined to the shelf deck sections 1806*a* and 1806*b*, respectively, so that the legs 1802 and 1804 are operable to pivot into a storage position that is generally parallel to the shelf deck sections 1806*a* and 1806*b*. The legs 1802 and 1804 and shelf deck sections 1806*a* and 1806*b* may be pivotably joined and operate in a manner similar to any of the legs and shelf decks of the shelves 1400, 1500, 1600, and 1700 shown in FIGS. 20A-23C and described above.

Figure 25:
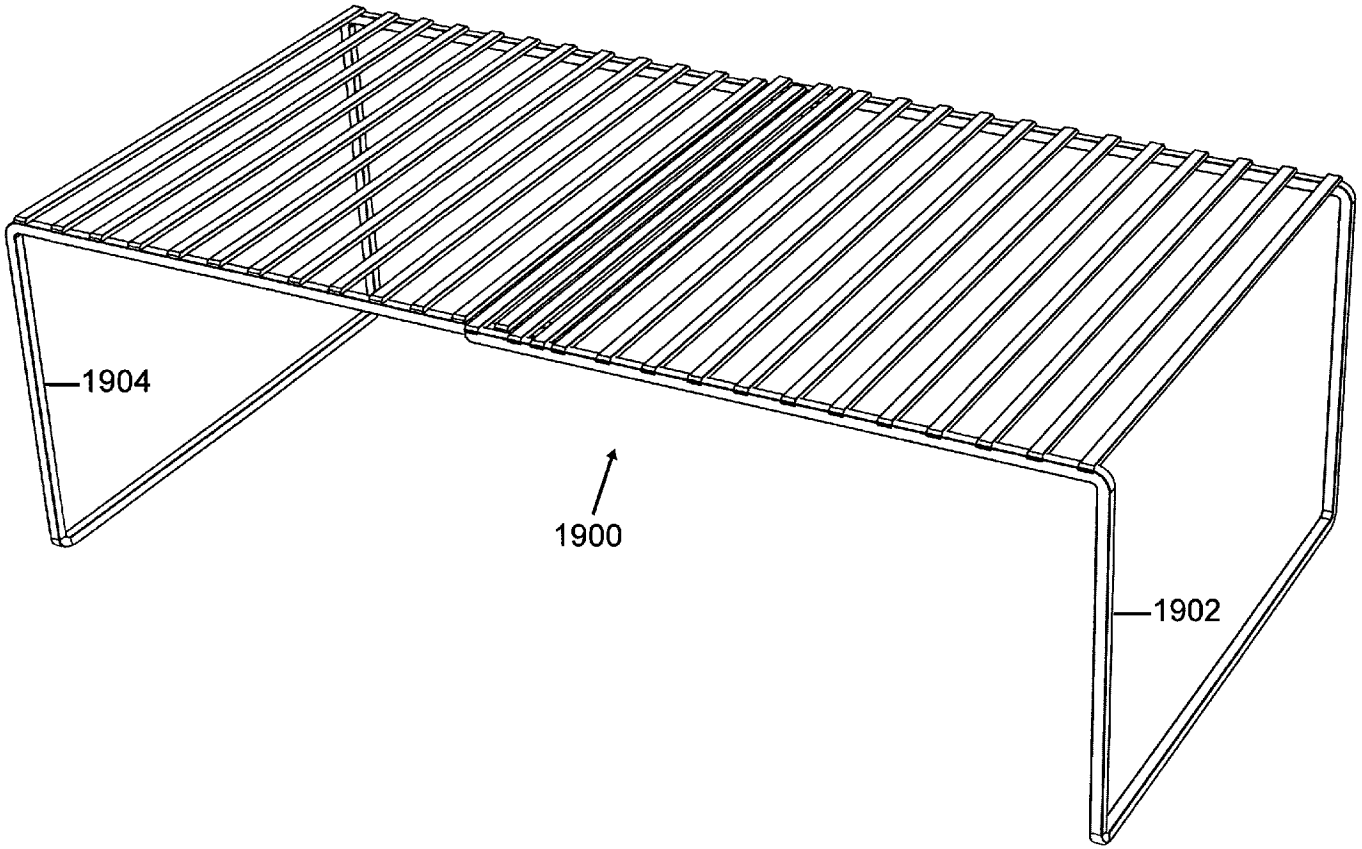
FIG. 25 is a perspective view of a width adjustable storage apparatus.

FIG. 25 shows a width adjustable storage apparatus 1900 that is substantially similar to the storage apparatus 1800 shown in FIGS. 24A-24F and described above except that the storage apparatus 1900 does not have locking structures such as the locking structures 1810 and 1826 of apparatus 1800. Instead, the storage apparatus 1900 has legs, or supports, 1902 and 1904 that are supported by an existing surface such as a shelf without locking to that surface. Besides the absence of locking structures, the apparatus 1900 is substantially similar to the apparatus 1800 and thus is not described in detail herein.

Figure 26:
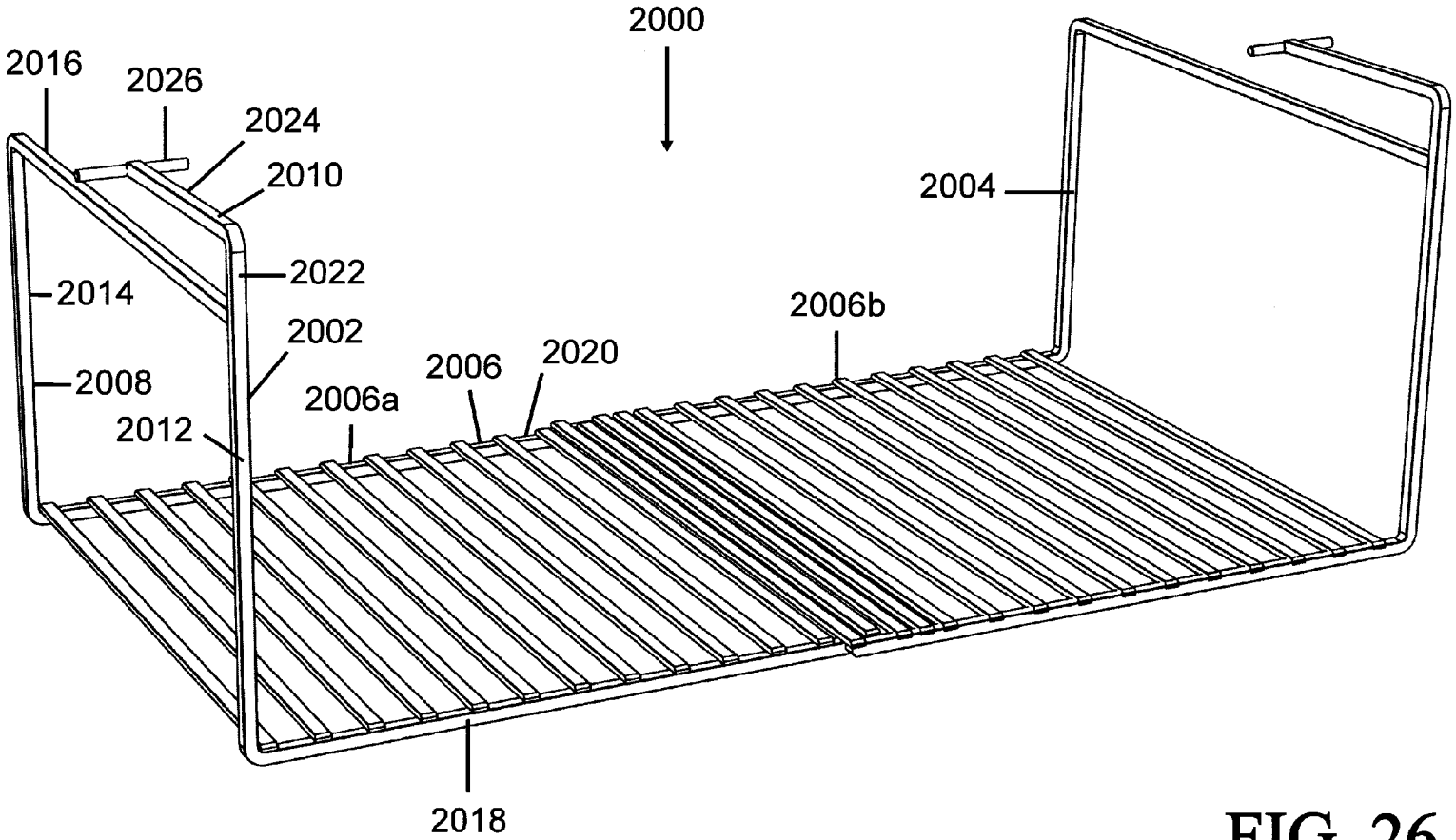
FIG. 26 is a perspective view of a width adjustable storage apparatus operable to lock to an existing structure and hang below the structure.

FIG. 26 shows an alternative embodiment of add-on shelf, or width adjustable storage apparatus, 2000. The storage apparatus 2000 is substantially similar to the storage apparatus 1800 shown in FIGS. 24A-24F and described above except that the storage apparatus 2000 is designed to hang below an existing structure such as an existing shelf, while the storage apparatus 1800 has a shelf deck 1806 which is positioned above an existing structure. The storage apparatus 2000 has legs, or supports, 2002 and 2004, which support an adjustable width shelf deck 2006 having first and second sections 2006*a* and 2006*b* that operate in substantially the same manner as the shelf deck sections 1806*a* and 1806*b* shown in FIG. 24A and described above. The legs 2002 and 2004 are substantially similar. Accordingly, only leg 2002 is described in detail herein. Leg 2002 includes a support structure 2008 and a locking structure 2010 that is integral with and extends upward from the support structure 2008. The support structure 2008 includes front and rear bars 2012 and 2014 that are each integral with and extend generally perpendicular downward from a top bar 2016. The shelf deck section 2006*a* includes front and rear bars 2018 and 2020 that are each integral with and extend generally perpendicular from the front and rear bars 2012 and 2014, respectively. The shelf deck section 2006*a* is otherwise substantially similar to the shelf deck section 1806*b* shown in FIG. 24A and described above. Leg 2002 differs from leg 1804 shown in FIG. 24A and described above in that the support structure 2008 of leg 2002 extends upward from the shelf deck section 2006*a* while the support structure 1824 of leg 1804 extends downward from the shelf deck section 1806*b*.

The locking structure 2010 is an L-shaped clamp with a vertical section 2022 integral with and extending upward from front bar 2012 and a horizontal section 2024 integral with and extending generally perpendicular from vertical section 2022 over top bar 2016. An optional horizontal stabilizer bar 2026 is joined with the horizontal section 2024 and extends laterally outward from both sides of the horizontal section 2024 for stabilizing the leg 2002 when it is locked to an existing shelf in a similar manner as described above with respect to the locking structure 20 shown in FIG. 3. When the locking structure 2010 engages an existing shelf, the top bar 2016 is positioned underneath the existing shelf and the horizontal section 2024 and stabilizer bar 2026 are positioned above the existing shelf. The shelf deck 2006 is positioned below the existing shelf to which the legs 2002 and 2004 are locked.

The embodiments of add-on shelves described above and shown in the drawings are preferred embodiments, and there are many alternative embodiments of add-on shelves that are within the scope of the present invention. For example, the locking structures 20, 208, 310, 410, 510, 610, 710, 810, 910, 1124, 1316, 1410, 1510, 1610, 1710, 1810, and 2012 are interchangeable such that any of them may be used in place of another on an add-on shelf having a locking structure. It is also within the scope of the invention for any of the add-on shelves with locking structures described above and shown in the drawings to have only one leg with a locking structure instead of two or more legs with locking structures. Additionally, it is within the scope of the invention for any of the add-on shelves 10, 100, 200, 300, 400, 500, 600, 700, 800, 900, 1000, 1100, 1200, 1300, 1400, 1500, 1600, 1700, and 1800 to be modified so that they are operable to hang from an existing structure in a similar manner as the add-on shelf 2000 shown in FIG. 26. It is also within the scope of the present invention for any of the add-on shelves 10, 100, 200, 300, 400, 500, 600, 700, 800, 900, 1000, 1100, 1200, 1300, 1800, 1900, and 2000 to be modified to have legs that are coupled with the shelf deck in a similar manner as the legs of add-on shelves 1400, 1500, 1600, and 1700 shown in FIGS. 20A-23C such that the legs are operable to pivot with respect to the shelf deck. Additionally, the shelves described above may be made from any suitable material, and parts which are described as being integral with each other may be formed from two materials that are permanently joined via welding or another process. It is also within the scope of the invention for any of the shelf decks described above to be formed as a bin or a basket having sides that extend upward from a horizontal surface.

A width adjustable storage apparatus in accordance with the present invention is configured to be supported by an existing structure. The apparatus comprises the following:

first and second sections that are operable to engage each other in a plurality of adjustable positions, wherein in each of the adjustable positions the first and second sections combine to present a shelf surface positioned in a generally horizontal plane, wherein the first and second sections do not extend above the generally horizontal plane when engaging each other, and wherein each of the adjustable positions corresponds to a different width of the shelf surface; and first and second supports coupled with the first and second sections, respectively, wherein each of the supports is operable to engage the existing structure, wherein there is a space positioned between the supports, the shelf surface, and the existing structure, and wherein the space is substantially void.

The supports may be operable to engage the existing structure for supporting the shelf surface above the existing structure, or below the existing structure.

The first section may comprise a first pair of generally parallel frame bars and a first plurality of spaced apart support bars each supported by the first pair of frame bars and positioned generally perpendicular to the first pair of frame bars, and wherein the second section comprises a second pair of generally parallel frame bars and a second plurality of spaced apart support bars each supported by the second pair of frame bars and positioned generally perpendicular to the second pair of frame bars, wherein at least one of the second plurality of support bars is operable to be supported by the first pair of frame bars in the plurality of adjustable positions in which the at least one of the second plurality of support bars is positioned between adjacent support bars of the first plurality of support bars, wherein in each of the adjustable positions the first and second plurality of support bars in combination present the shelf surface.

The first pair of frame bars may be spaced apart a first distance, wherein the second pair of frame bars comprises first and second ends, and wherein the second plurality of spaced apart support bars comprises a set of bars spaced apart from the first end to adjacent the second end and each comprising a length of a second distance that is less than the first distance and an interlocking bar joined to the second end and comprising a length of a third distance that is greater than the first distance, wherein the interlocking bar is operable to be supported by the first pair of frame bars in the plurality of adjustable positions.

At least one of the first plurality of support bars may be supported by the second pair of frame bars.

The second end of at least one of the second pair of frame bars may be horizontally offset a fourth distance from the remainder of the frame bar.

The first and second sections may be integral with the first and second supports, respectively.

The first and second supports may comprise a locking structure that is configured to removably lock the support to the existing structure.

The first and second supports may be pivotably joined to the first and second sections, respectively, and moveable between a storage position, in which the support is generally parallel with the respective first and second section, and an operating position, in which the support is positioned at an angle relative to the respective first and second section.

A width adjustable storage apparatus configured to be supported by an existing structure in accordance with the present invention comprises the following:

a first section comprising a first pair of generally parallel frame bars and a first plurality of spaced apart support bars each supported by the first pair of frame bars and positioned generally perpendicular to the first pair of frame bars;

a second section comprising a second pair of generally parallel frame bars and a second plurality of spaced apart support bars each supported by the second pair of frame bars and positioned generally perpendicular to the second pair of frame bars, wherein at least one of the second plurality of support bars is operable to be supported by the first pair of frame bars in a plurality of adjustable positions in which the at least one of the second plurality of support bars is positioned between adjacent support bars of the first plurality of support bars, wherein in each of the adjustable positions the first and second plurality of support bars in combination present a shelf surface positioned in a generally horizontal plane, wherein the first and second sections do not generally extend above the horizontal plane when engaging each other, and wherein each of the adjustable positions corresponds to a different width of the shelf surface; and first and second supports coupled with the first and second sections, respectively, wherein each of the supports is operable to engage the existing structure.

The first pair of frame bars may be spaced apart a first distance, wherein the second pair of frame bars comprises first and second ends, and wherein the second plurality of spaced apart support bars comprises a set of bars spaced apart from the first end to adjacent the second end and each comprising a length of a second distance that is less than the first distance and an interlocking bar joined to the second end and comprising a length of a third distance that is greater than the first distance, wherein the interlocking bar is operable to be supported by the first pair of frame bars in the plurality of adjustable positions.

The second end of at least one or both of the second pair of frame bars may be horizontally offset a fourth distance from the remainder of the frame bar.

The fourth distance may be greater than half of the difference between the third and first distances.

The supports may be operable to engage the existing structure for supporting the shelf surface above or below the existing structure.

The first and second sections may be integral with the first and second supports, respectively.

Each of the first and second supports may comprise a locking structure that is configured to removably lock the support to the existing structure.

The first and second supports may be pivotably joined to the first and second sections, respectively, and moveable between a storage position, in which the support is generally parallel with the respective first and second section, and an operating position, in which the support is positioned at an angle relative to the respective first and second section.

At least one of the first plurality of support bars may be supported by the second pair of frame bars.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. An add-on shelf that is configured to engage an existing structure, comprising:

a pair of legs, wherein at least one of said legs has a support structure comprising a front and a rear, wherein the at least one of said legs has a locking structure comprising a first section that is coupled with and extends vertically away from the front of the support structure, wherein the locking structure comprises a second section that extends from the first section toward the rear of the support structure, wherein at least a portion of the second section is collocated in a vertical plane with at least a portion of the support structure to define a slot positioned between the support structure and the first and second sections of the locking structure, and wherein the slot is configured to receive at least a portion of an existing structure to removably lock said leg to the existing structure; and a shelf deck supported by said legs, wherein there is a void space positioned between said legs, said shelf deck and said existing structure for providing access to said existing structure between said shelf deck and said existing structure.

2. The add-on shelf of claim 1, wherein said locking structure is configured to engage the existing structure to support each of said legs in a generally vertical position.

3. The add-on shelf of claim 2, wherein the at least one of said legs comprises a stabilizer that is configured to engage the existing structure and that extends laterally from the locking structure or the support structure.

4. The add-on shelf of claim 1, wherein the first and second sections of said locking structure form a generally L-shaped clamp such that said locking structure is operable to clamp said existing structure between said second section and said support structure.

5. The add-on shelf of claim 4, wherein said locking structure comprises a stabilizer coupled with and extending laterally from said second section, and wherein said stabilizer is configured to engage the existing structure.

6. The add-on shelf of claim 4, wherein said second section has a first end joined with said first section and a second end, and wherein said clamp flexes with respect to said support structure such that said second end is operable to move toward and away from said support structure.

7. The add-on shelf of claim 1, wherein each of said legs comprises a support structure that supports said shelf deck, and wherein said shelf deck removably engages each of said legs such that said legs substantially prevent lateral movement of said shelf deck with respect to said legs.

8. The add-on shelf of claim 7, wherein said support structure of each of said legs comprises a frame comprising front and rear bars each joined to a top bar that supports said shelf deck.

9. The add-on shelf of claim 8, wherein said support structure comprises a bottom bar that is joined to said front and rear bars and is configured to be supported by said existing structure.

10. The add-on shelf of claim 7, wherein at least one of said shelf deck and said support structure comprises an opening for receiving a portion of said other of said shelf deck and said support structure.

11. The add-on shelf of claim 10, wherein said support structure of each of said legs comprises front and rear bars each joined to a top bar, wherein said top bar comprises a first portion and a second portion that is raised relative to said first portion, and wherein said shelf deck comprises a bottom surface with openings for receiving said second portion of each of said legs.

12. The add-on shelf of claim 1, wherein each of said legs comprises a support structure that supports said shelf deck, and wherein said locking structure extends downward from said support structure.

13. The add-on shelf of claim 1, wherein the first section of the locking structure extends downward from the support structure, and wherein no portion of the support structure extends below any portion of the first section of the locking structure.

14. The add-on shelf of claim 1, wherein each of said legs has a locking structure that is configured to removably lock said leg to an existing structure.

15. An add-on shelf that is configured to engage an existing structure, comprising:

a pair of legs, wherein at least one of said legs has a locking structure that is configured to removably lock said leg to an existing structure, wherein each of said legs comprises a support structure comprising front and rear bars each joined to a top bar, wherein said top bar comprises a first portion and a second portion that is raised relative to said first portion; and a shelf deck comprising a bottom surface with openings each operable to receive the second portion of one of said legs for substantially preventing lateral movement of the shelf deck, wherein said shelf deck is operable to removably engage each of said legs by being moved vertically downward until the openings receive the second portion of the legs, wherein the shelf deck is operable to removably disengage each of said legs by being moved vertically upward until the openings do not receive the second portion of the legs, and wherein there is a void space positioned between said legs, said shelf deck and said existing structure for providing access to said existing structure between said shelf deck and said existing structure when the shelf deck engages the pair of legs.

16. The add-on shelf of claim 15, wherein the at least one of said legs has a support structure comprising a front and a rear, wherein the locking structure comprises a first section that is coupled with and extends vertically downward from the front of the support structure, wherein the locking structure comprises a second section that extends from the first section toward the rear of the support structure, wherein at least a portion of the second section is collocated in a vertical plane with at least a portion of the support structure to define a slot positioned between the support structure and the first and second sections of the locking structure, wherein the slot is configured to receive at least a portion of an existing structure that is configured to removably lock said leg to the existing structure, and wherein no portion of the support structure extends below any portion of the first section of the locking structure.

* * * * *